US008464887B2

(12) United States Patent
Cherian

(10) Patent No.: US 8,464,887 B2
(45) Date of Patent: Jun. 18, 2013

(54) PT1-2 PULL TAB

(76) Inventor: Gabe Cherian, Sun Valley, ID (US)

( * ) Notice: Subject to any disclaimer, the term of this patent is extended or adjusted under 35 U.S.C. 154(b) by 10 days.

(21) Appl. No.: 12/613,549

(22) Filed: Nov. 6, 2009

(65) Prior Publication Data

US 2011/0253719 A1 Oct. 20, 2011

Related U.S. Application Data

(62) Division of application No. 10/941,797, filed on Sep. 14, 2004, now Pat. No. 7,617,945.

(60) Provisional application No. 60/503,823, filed on Sep. 19, 2003.

(51) Int. Cl.
*B65D 17/32* (2006.01)
*B65D 17/34* (2006.01)

(52) U.S. Cl.
USPC ..... 220/269; 220/270; 220/906

(58) Field of Classification Search
USPC ..... 220/268–271, 906
See application file for complete search history.

(56) References Cited

U.S. PATENT DOCUMENTS

| | | | | | |
|---|---|---|---|---|---|
| 4,266,688 | A * | 5/1981 | Reid | 220/273 |
| 5,224,618 | A * | 7/1993 | Garbiso | 220/269 |
| 5,248,053 | A * | 9/1993 | Lundgren | 220/269 |
| 5,397,014 | A * | 3/1995 | Aydt | 220/269 |
| 5,456,378 | A * | 10/1995 | DeMars | 220/269 |
| 5,653,355 | A * | 8/1997 | Tominaga et al. | 220/269 |
| 6,026,971 | A * | 2/2000 | Lundgren | 220/269 |
| 6,138,856 | A * | 10/2000 | Ghim et al. | 220/269 |
| 6,575,325 | B2 * | 6/2003 | Dickie et al. | 220/269 |
| 2002/0088804 | A1 * | 7/2002 | Omura | 220/269 |
| 2003/0132230 | A1 * | 7/2003 | Gitelman et al. | 220/269 |
| 2005/0224497 | A1 * | 10/2005 | Wook | 220/269 |

* cited by examiner

*Primary Examiner* — Mickey Yu
*Assistant Examiner* — Niki Eloshway

(57) ABSTRACT

The invention covers a number of alternative improvements to the prior art pull-tab used to open container such as soda cans. One improvement is by forming the nose of the pull tab at a certain angle to the body of the tab, thus allowing the user to tilt the tab thus lifting the pull tip higher and providing more room for the user to insert the finger tip under the pull tip thus making it easier to open the container. Another improvement is by rotating the pull tab a certain angle and making it follow a caming surface thus lifting the pull tip and again providing more room to insert the finger tip and making it easier to open the container.

16 Claims, 123 Drawing Sheets

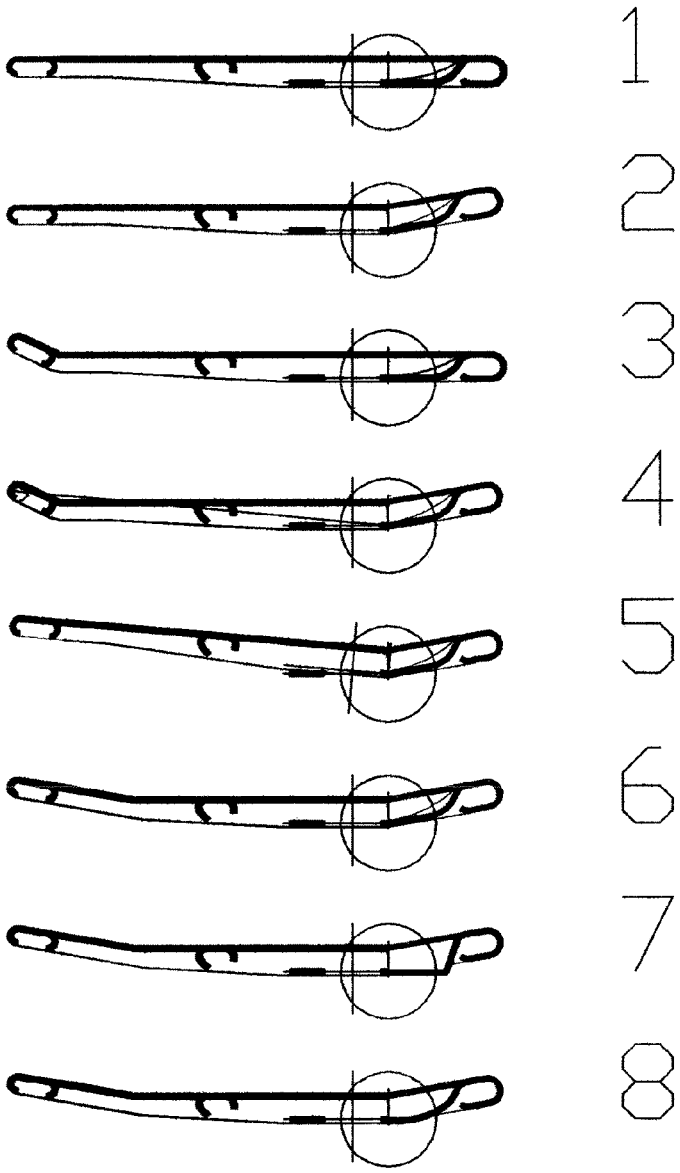
FIG. 31-A

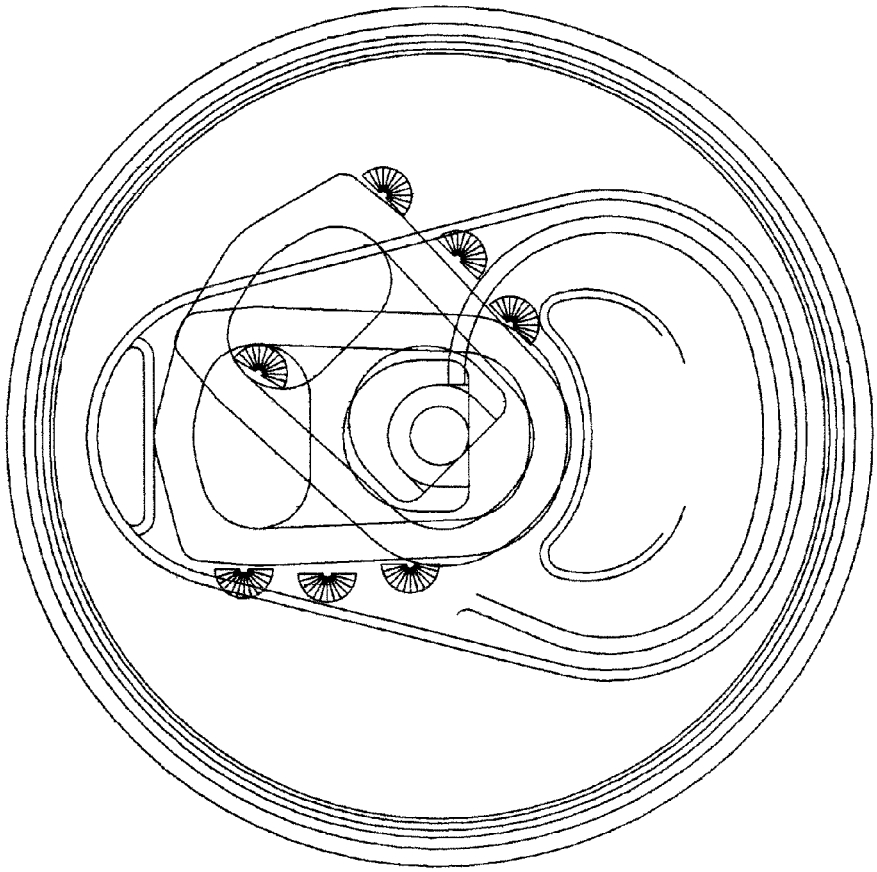
FIG. 31-B

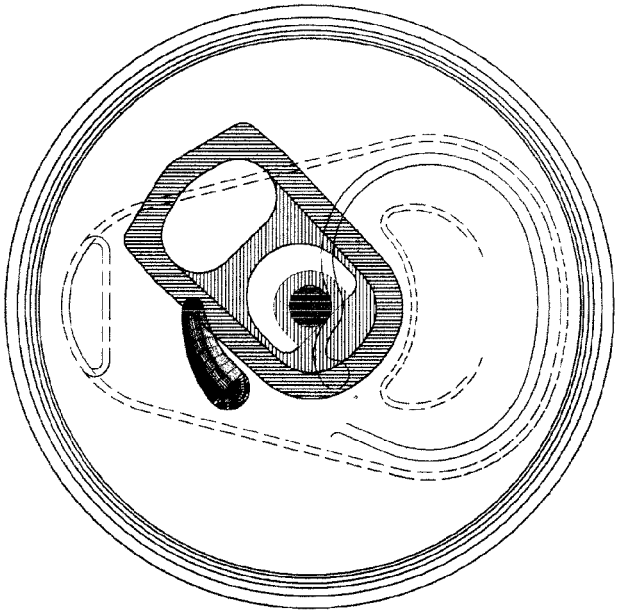
FIG. 61-A
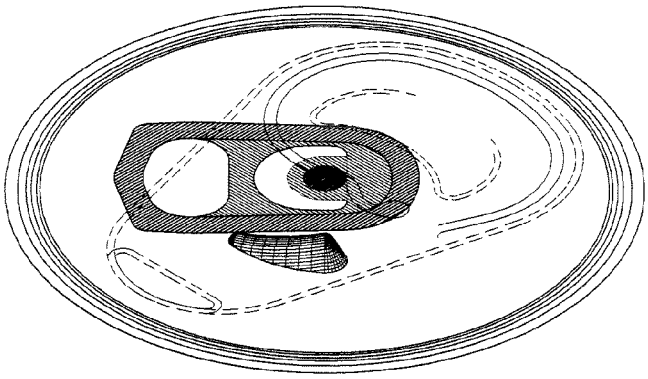
FIG. 61-B
FIG. 61

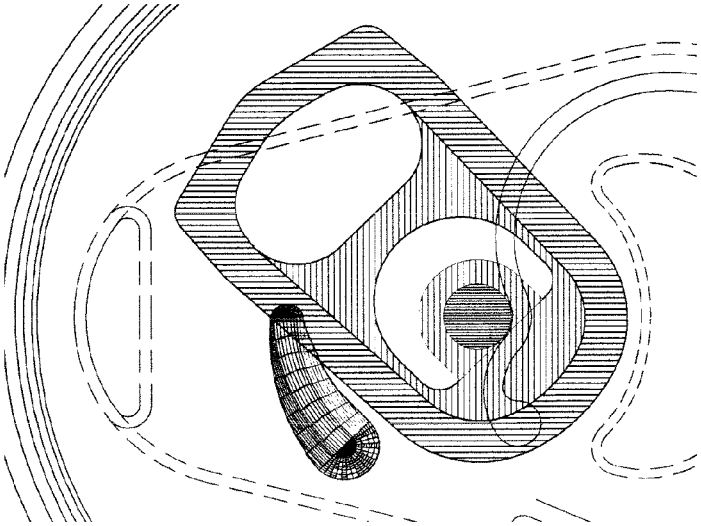
FIG. 62-A
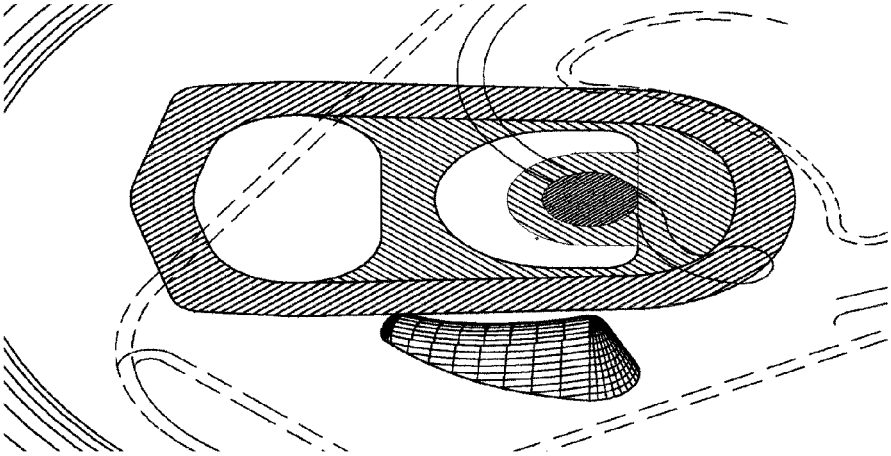
FIG. 62-B
FIG. 62

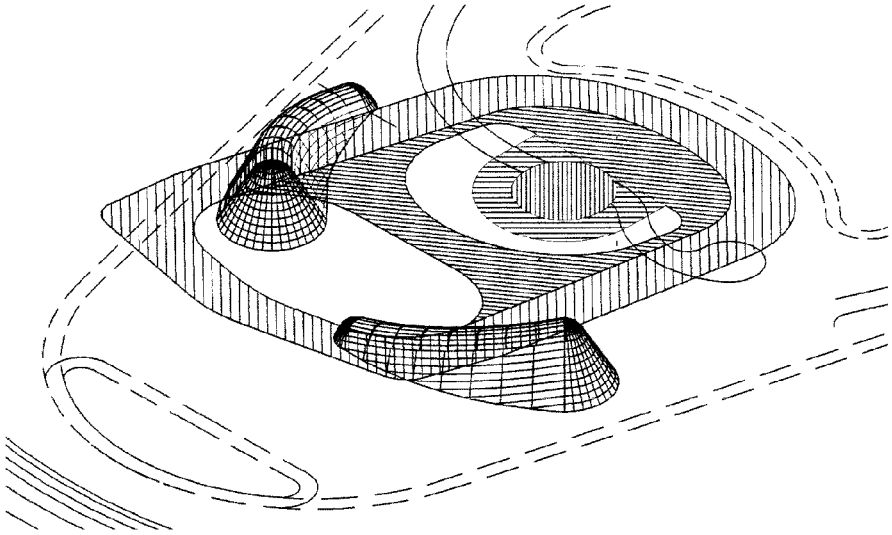
FIG. 63-A
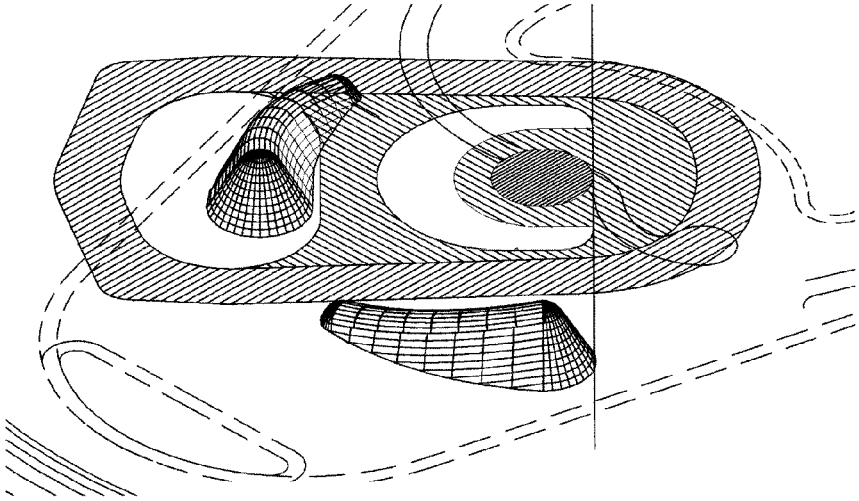
FIG. 63-B
FIG. 63

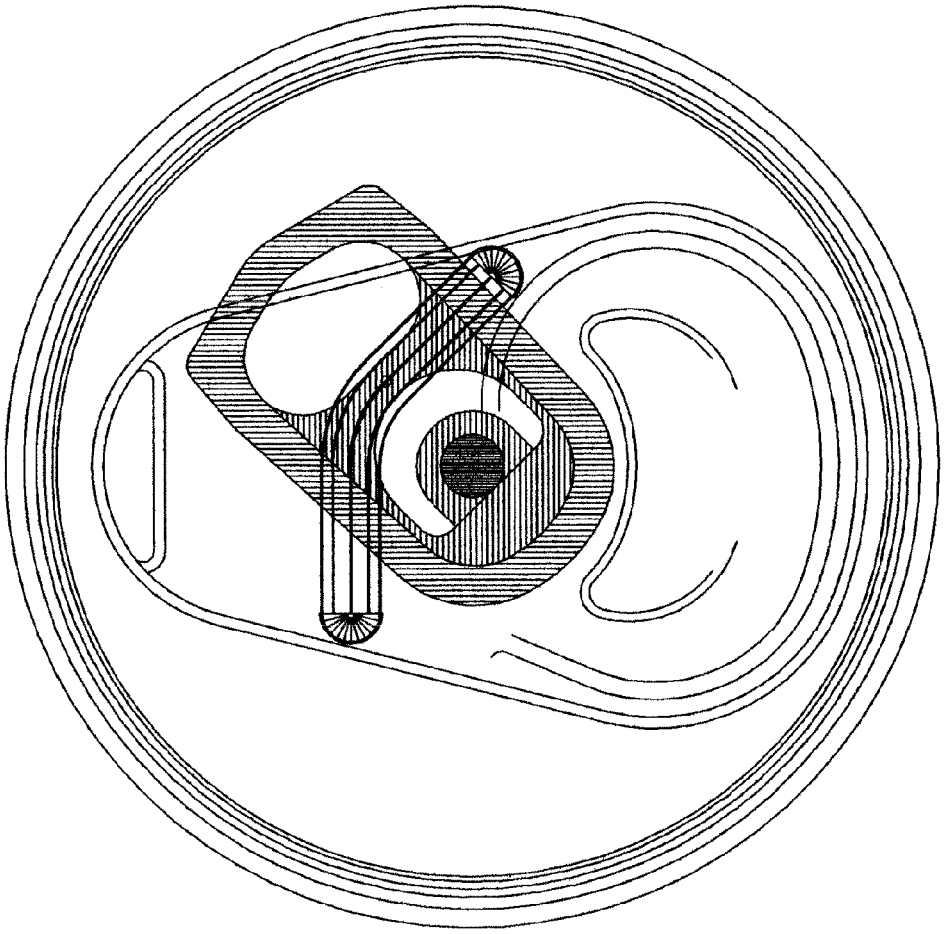
FIG. 64-A

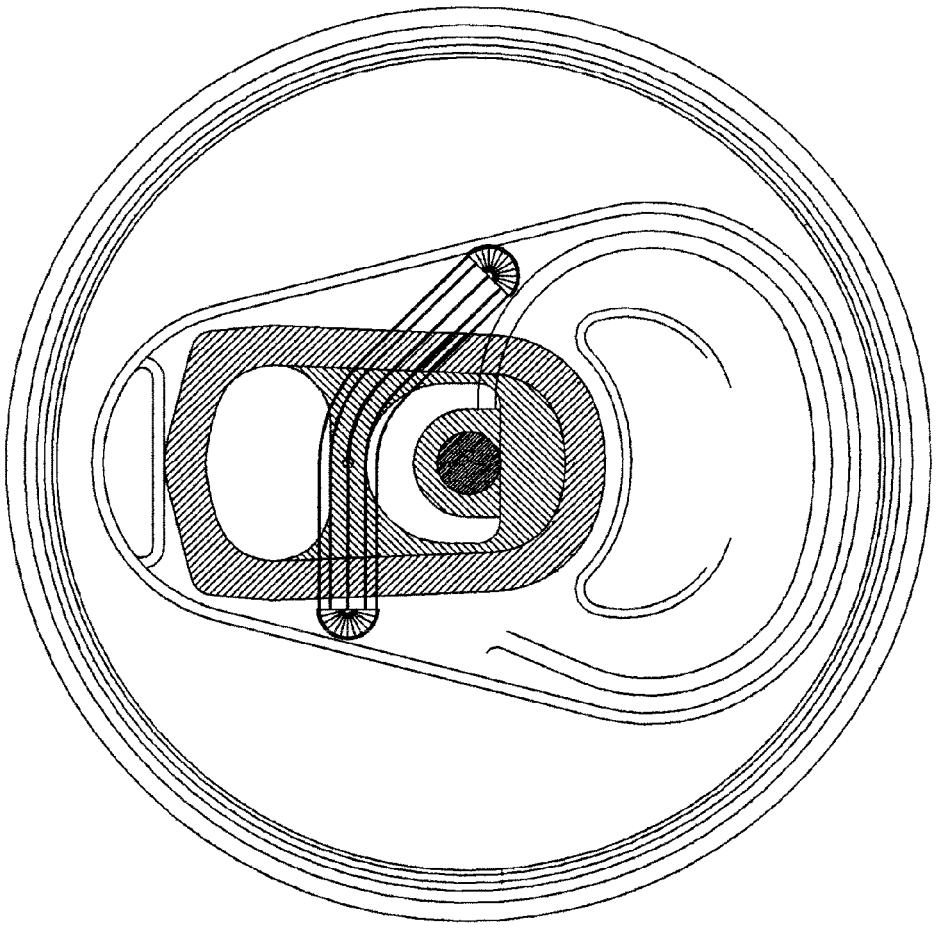
FIG. 64-B

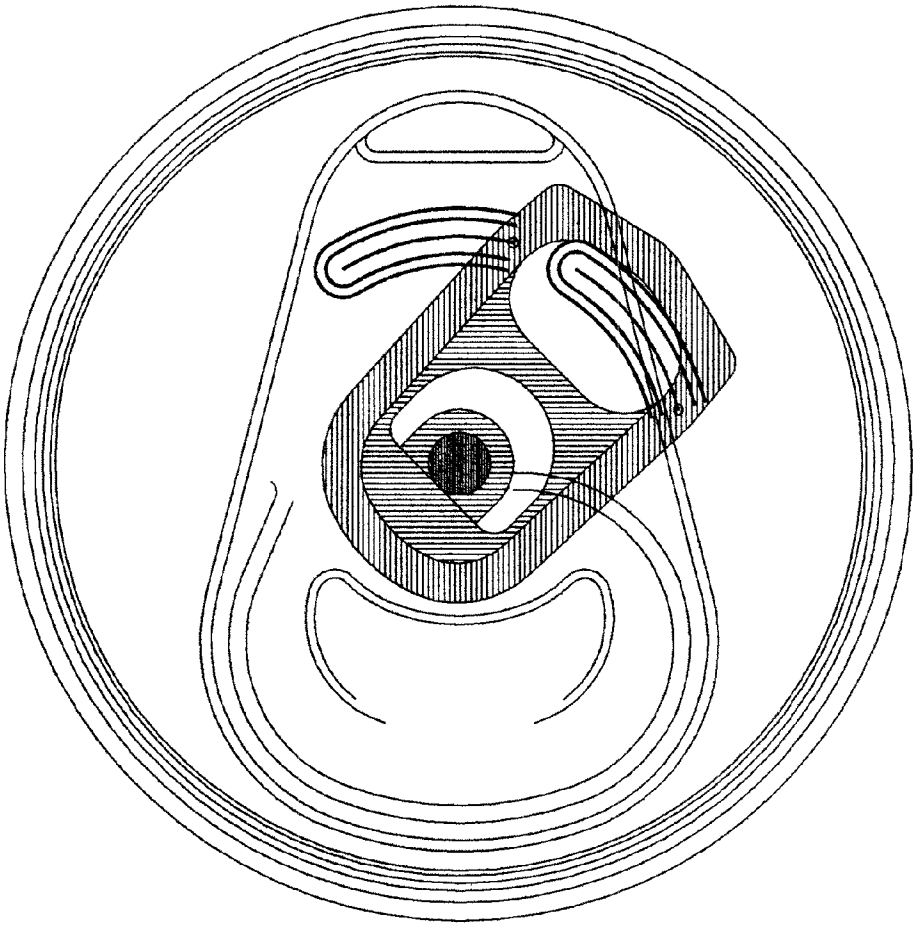
FIG. 65-A

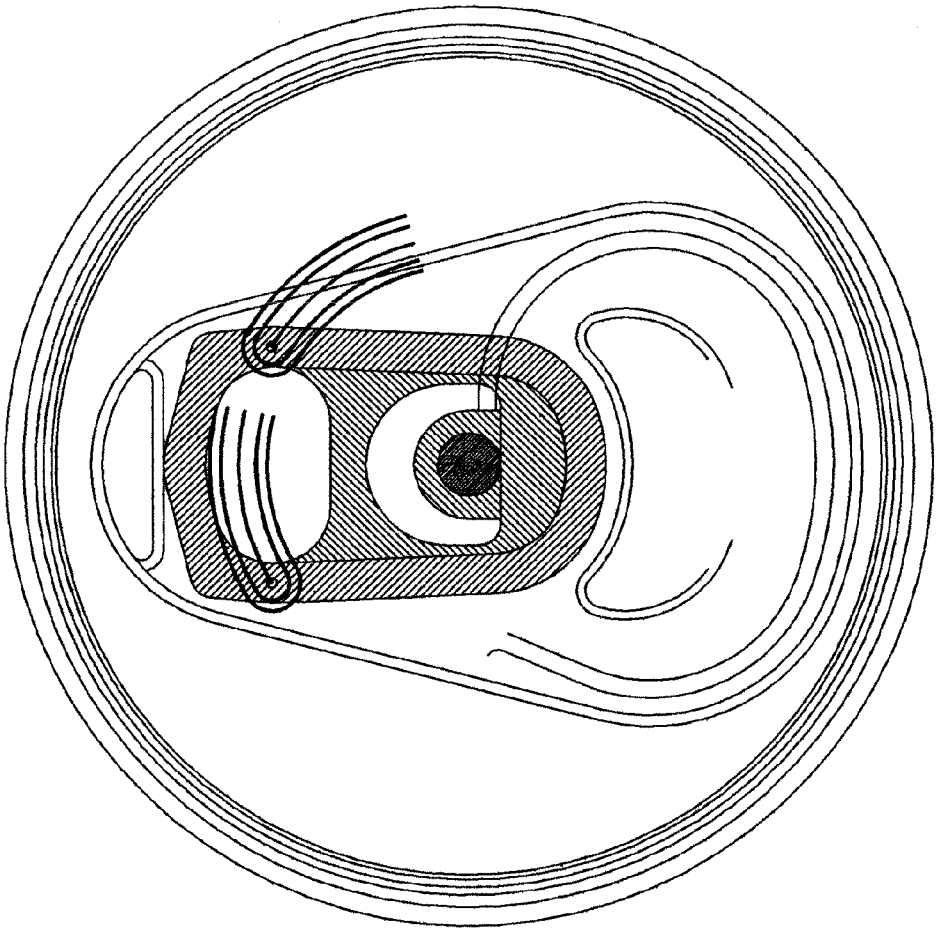
FIG. 65-B

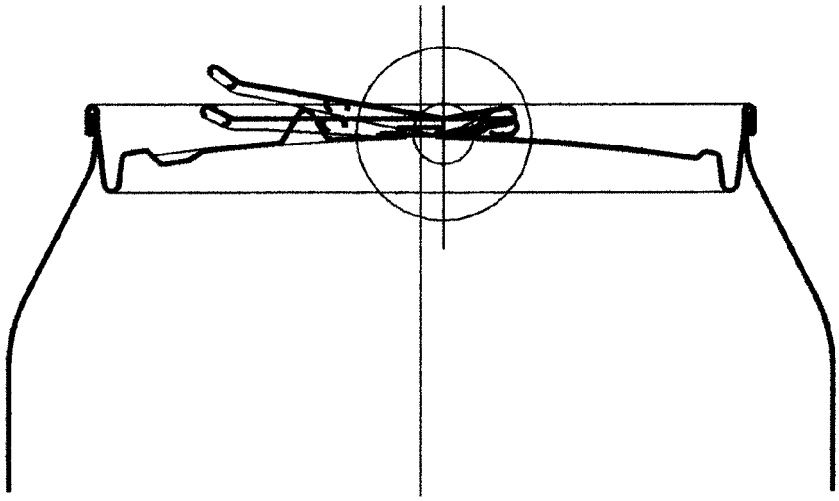
FIG. 66-A
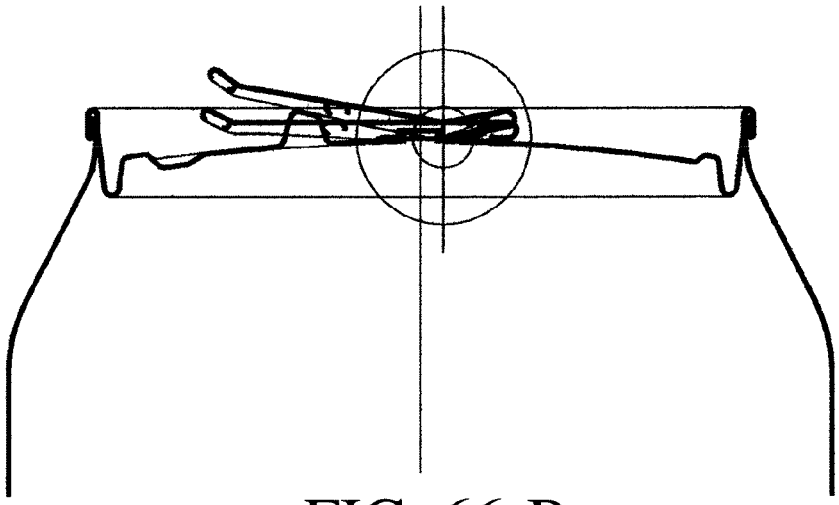
FIG. 66-B
FIG. 66

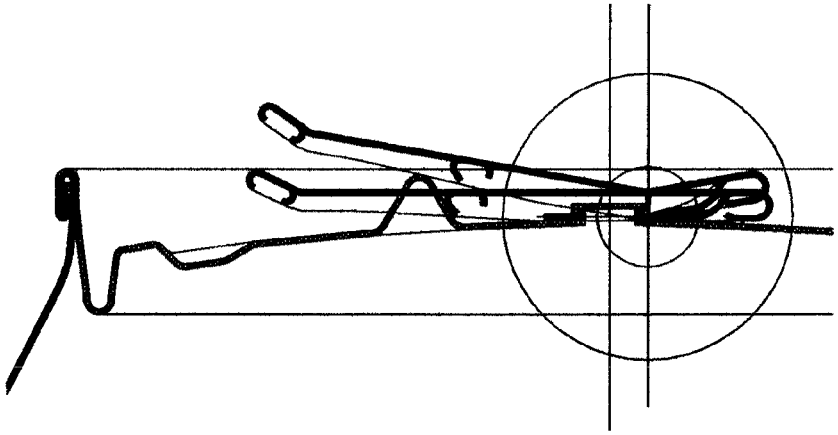
FIG. 67-A
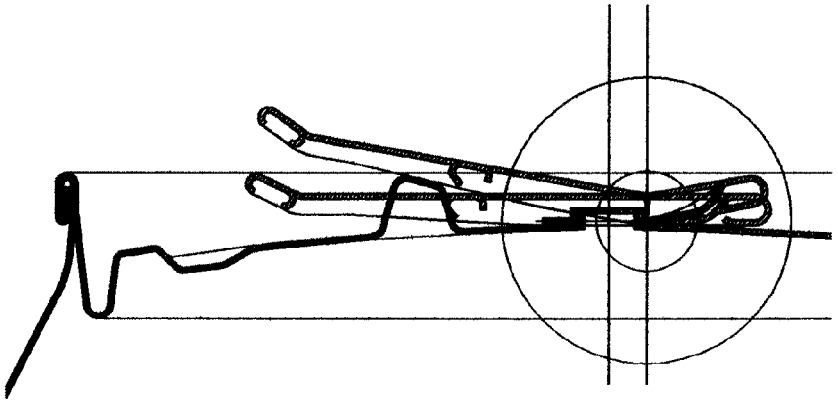
FIG. 67-B
FIG. 67

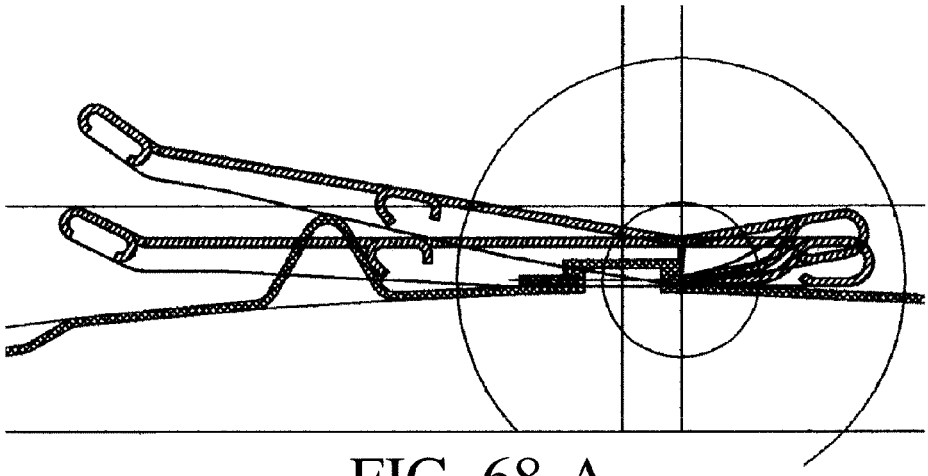
FIG. 68-A
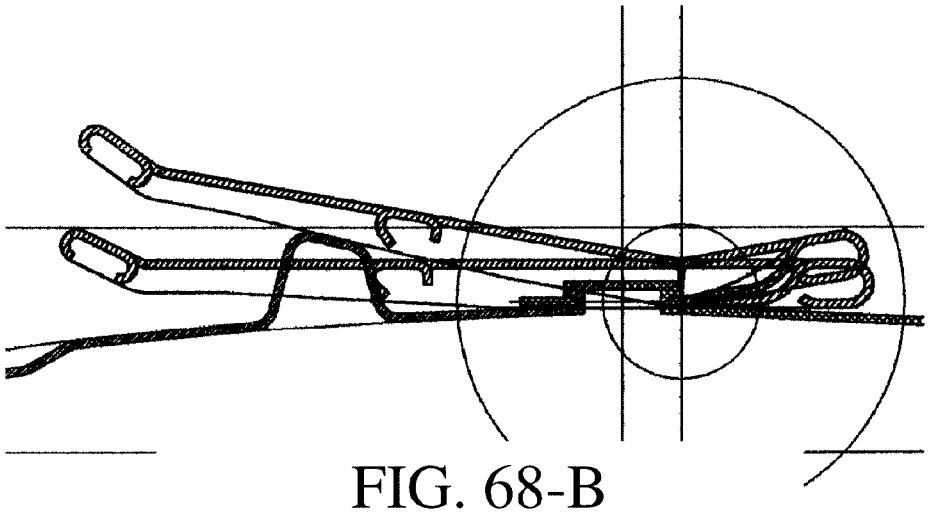
FIG. 68-B
FIG. 68

PT-D-76
4-45

PT-D-77

4-46

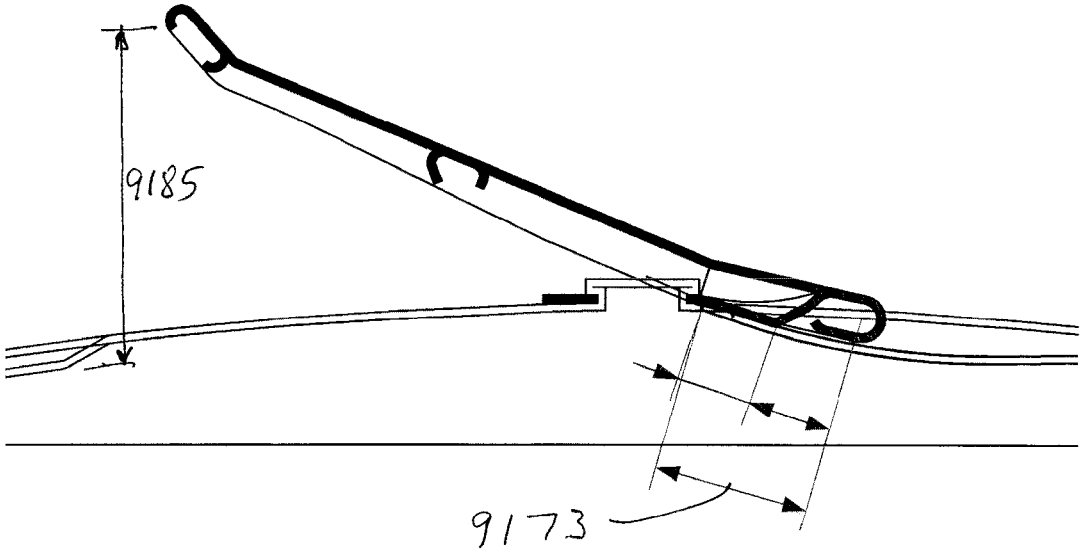
FIG. 93-A
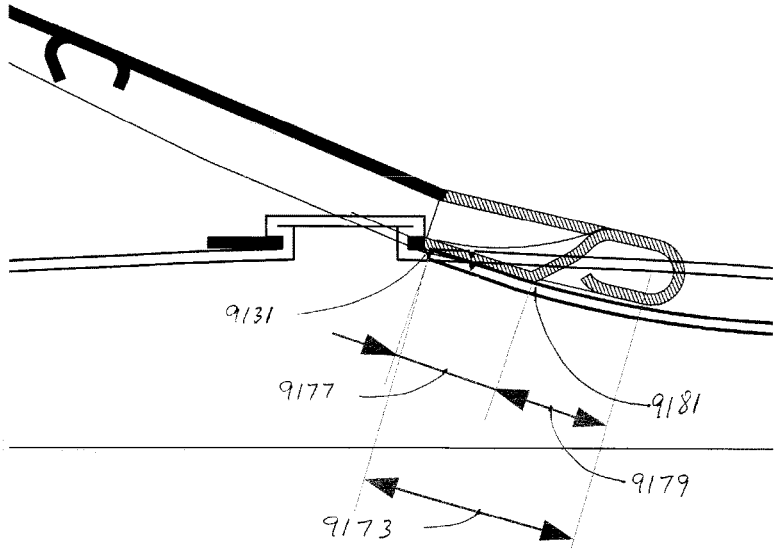
FIG. 93-B
FIG. 93

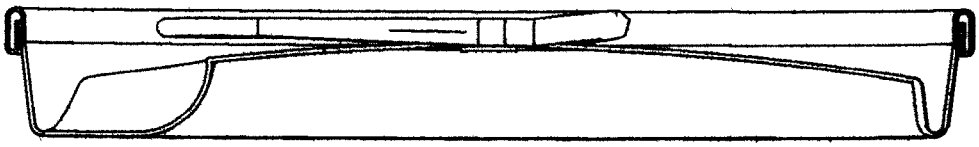
FIG. 101-A
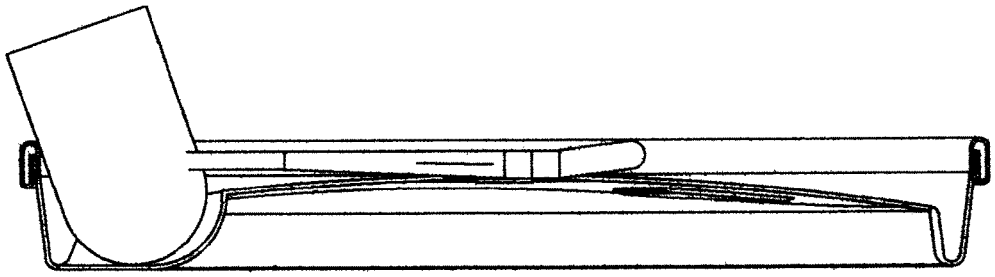
FIG. 101-B
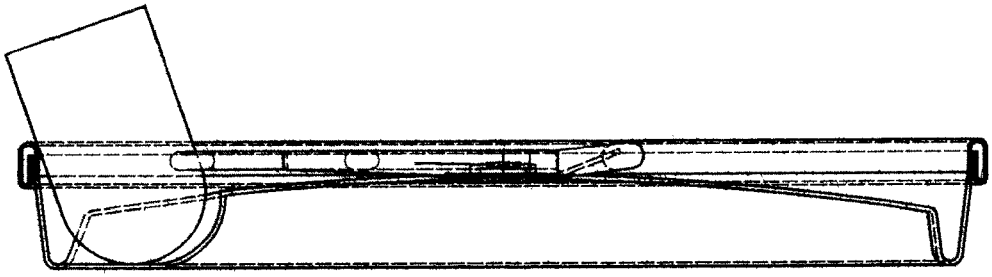
FIG. 101-C
FIG. 101

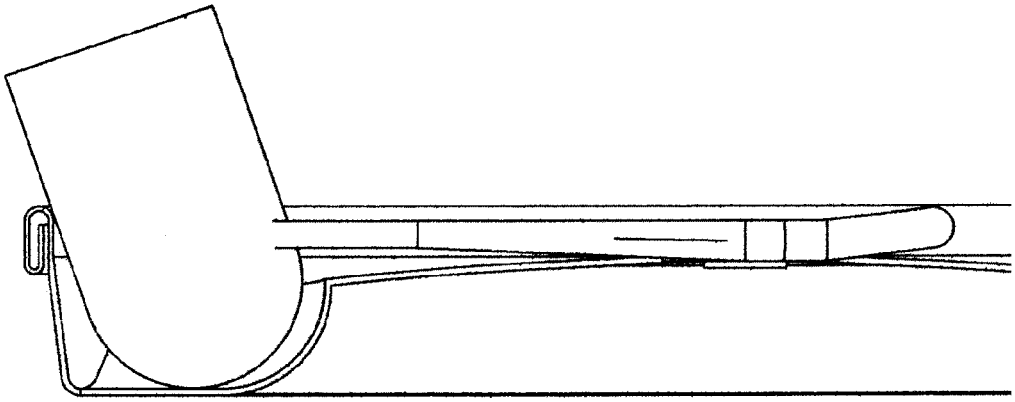
FIG. 102-A
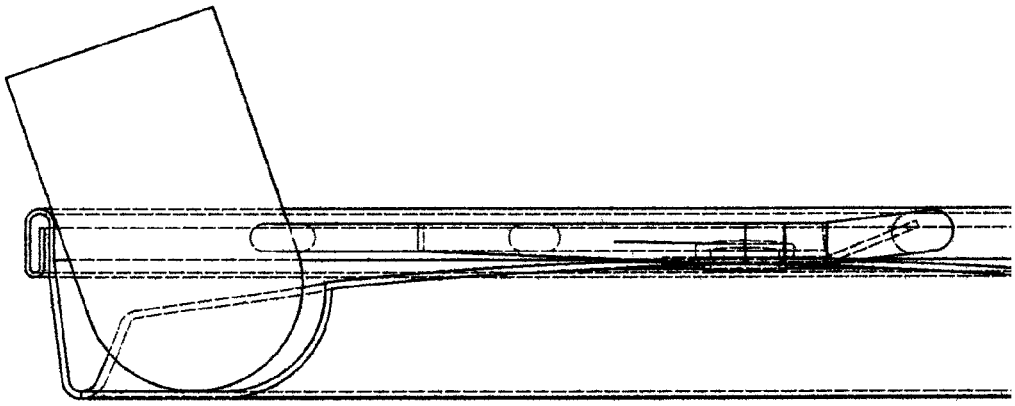
FIG. 102-B
FIG. 102

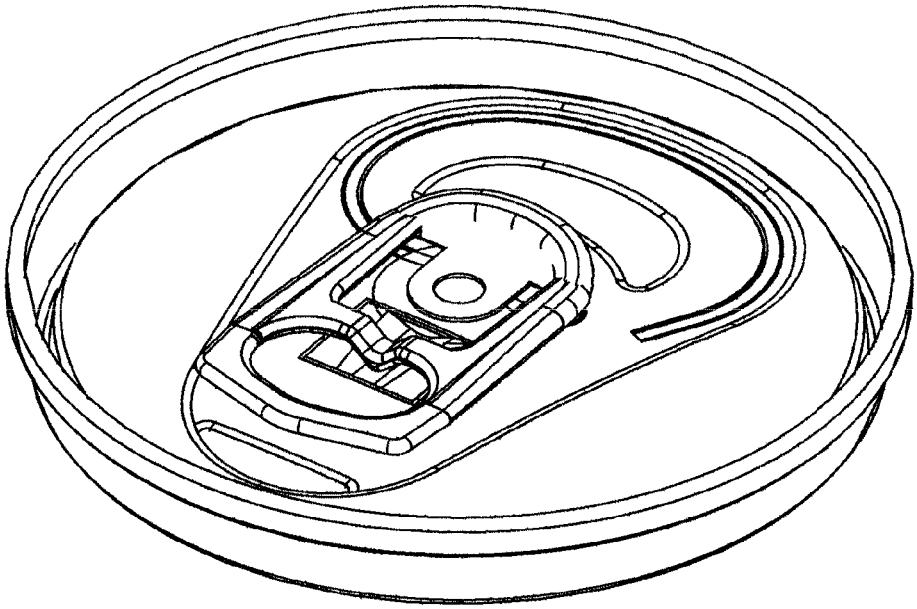
FIG. 110-A
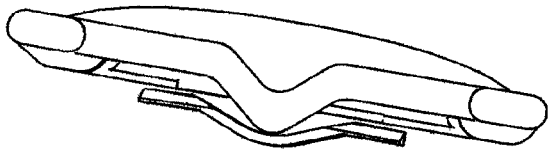
FIG. 110-B
FIG. 110

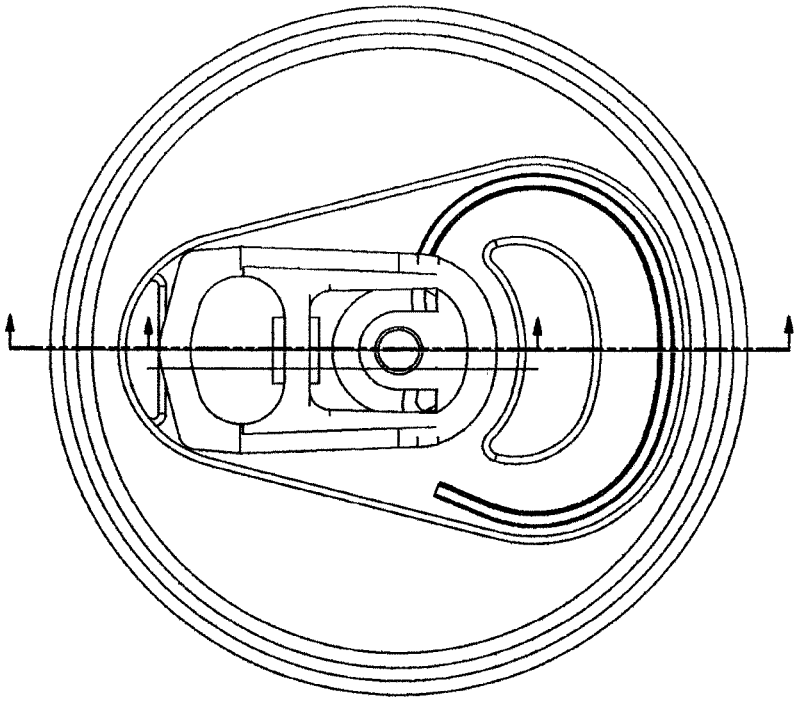
FIG. 111-A
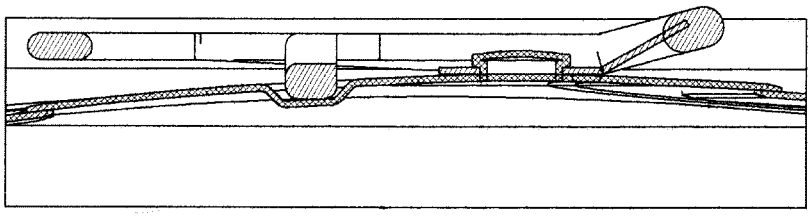
FIG. 111-B
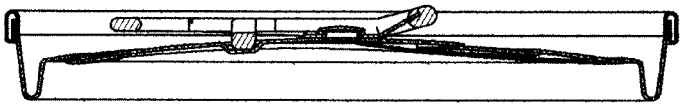
FIG. 111-C

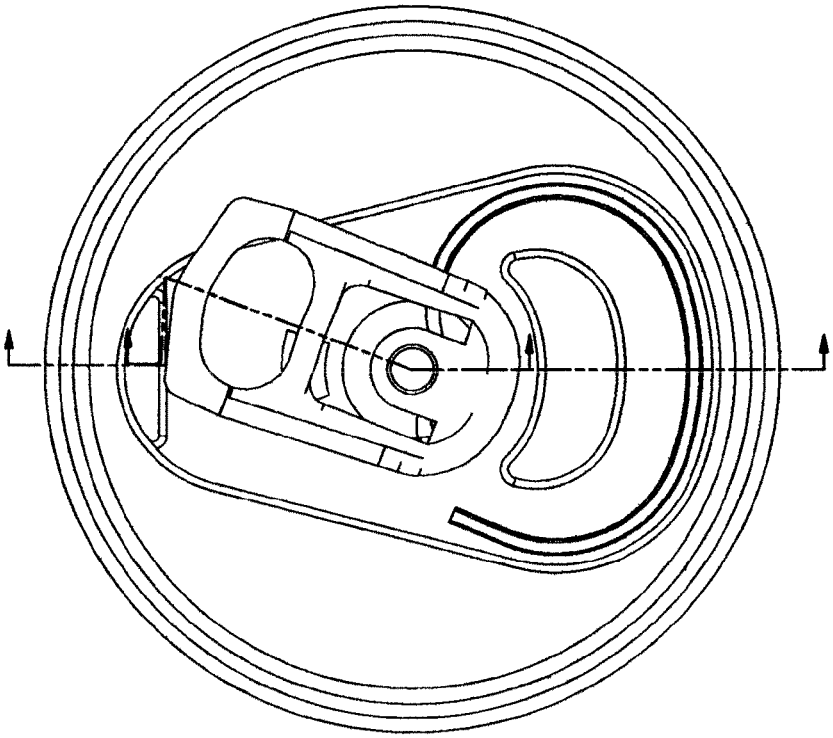
FIG. 111-D
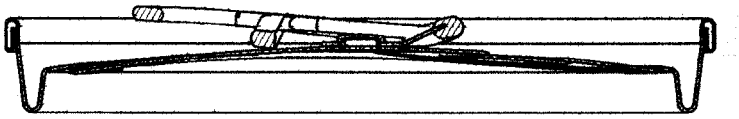
FIG. 111-E
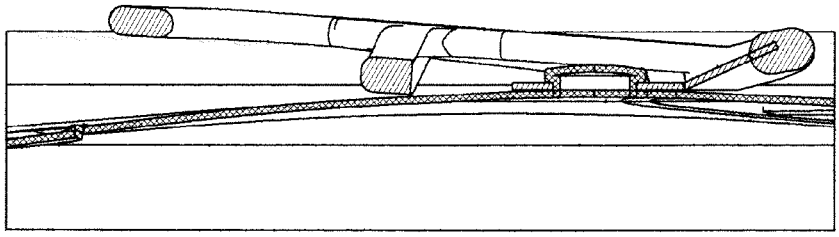
FIG. 111-F

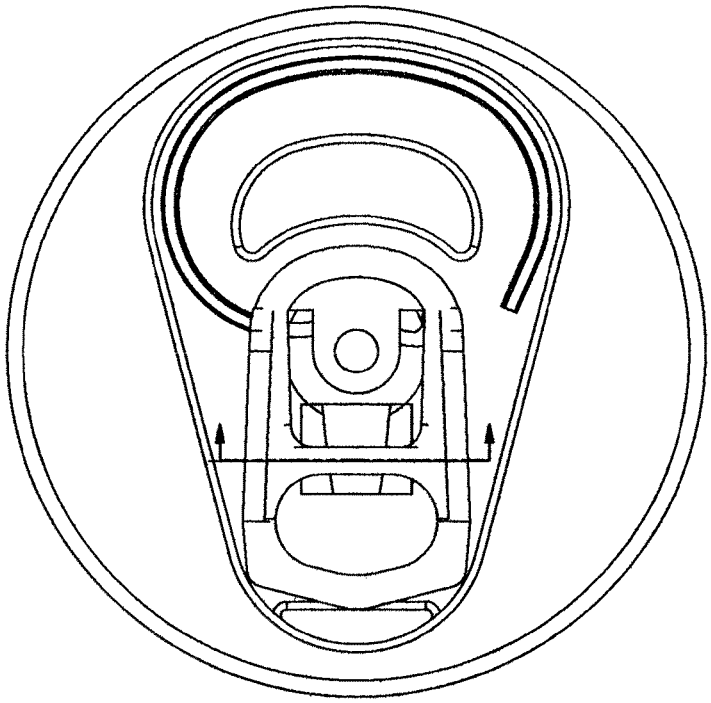
FIG. 112-A
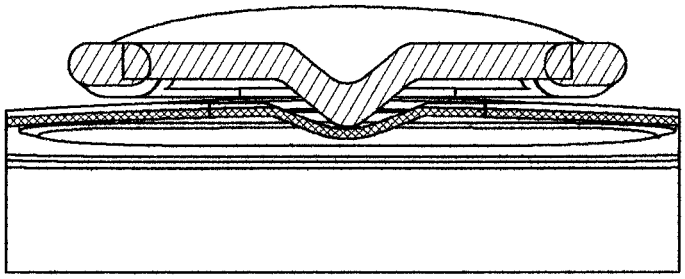
FIG. 112-B

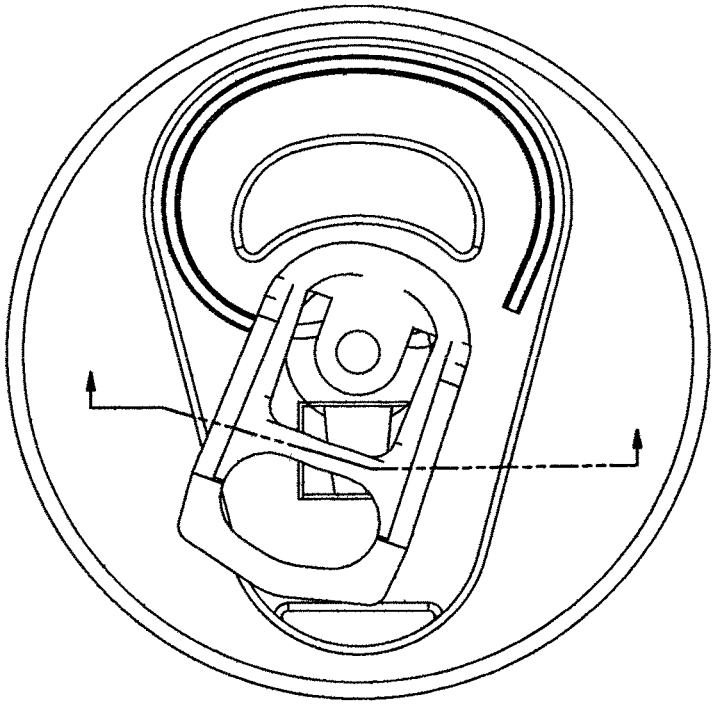
FIG. 112-C
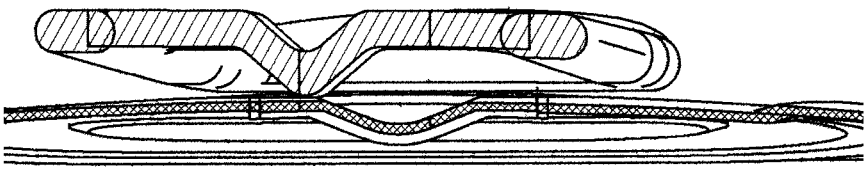
FIG. 112-D

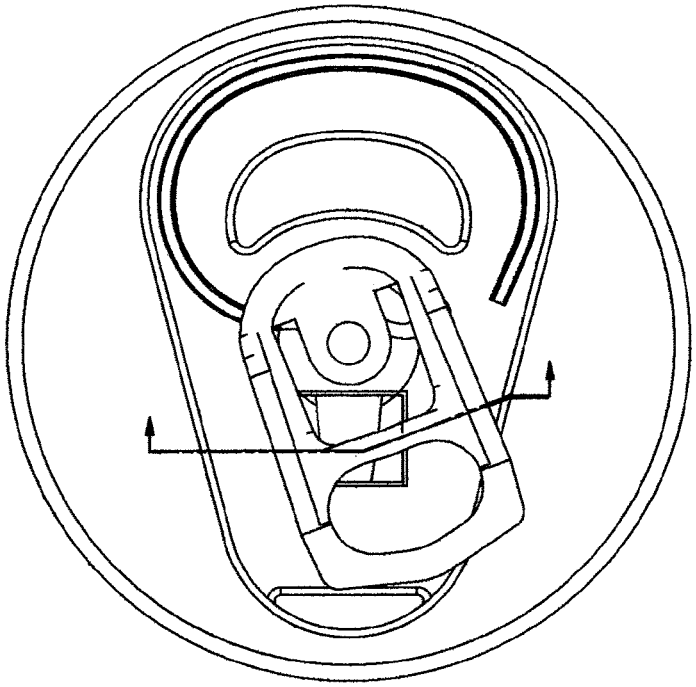
FIG. 112-E
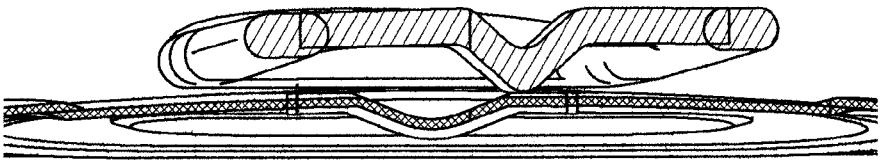
FIG. 112-F

PT1-2 PULL TAB

CROSS-REFERENCE TO RELATED APPLICATIONS

This present application is a DIVISIONAL non-provisional utility patent application, DIVISIONAL from MOTHER application Ser. No. 10/941,797, Filing Date: Sep. 14, 2004, now U.S. Pat. No. 7,617,945 Art Unit: 3781, Examiner: NIKI MARINA ELOSHWAY, and is claiming the priority and benefits of that mother patent application, and which is incorporated herein in its entirety by reference. Said mother application will be referred to as Ref 2.

Said mother application, Ref 2, was in turn claiming the priority and benefits of Provisional Patent Application Ser. No. 60/503,823, filed Sep. 19, 2003, titled "Pull Tab", which will be referred to as Ref 1, and which is incorporated herein in its entirety by reference, as well.

STATEMENT REGARDING FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON A COMPACT DISK

Not Applicable

SEQUENCE LISTING

Not Applicable

BACKGROUND OF THE INVENTION

1. Field of the Invention

The present invention generally relates to means for opening cans and container, which have a pull tab that the user lifts and/or pulls to open the can.

Specifically, the invention relates to cans used to contain soft drinks, or beer or soups or sardines or drinks and foods in general or the like. The pull-tab is usually lifted by the user to break a seal of some sort or shape. The pull-tabs presently used on the market are difficult to grab and lift and some users revert to special tools to start the lifting process.

The present invention relates to means and methods of making the tab lifting process more user friendly, and to do so without special tools.

2. Background Information

Many of the soda cans, beer cans, soup cans, or similar containers or the like, presently on the market, have a pull tab, which is supposed to help the user/consumer to open the can and partake of its contents. Usually the pull-tab is relatively flush with the surface of the lid. See the "Tutorial & Definitions" Section for more detailed explanations of some terms used here.

Since I am not directly working with and using these terms on a daily basis, I have copied many of these terms and phrases from a couple of existing patents that have been issued to companies that are in this line of business. I particularly like the words used in U.S. Pat. No. 6,375,029 to Anthony et al., assigned to Alcoa Inc., Pittsburgh, Pa. (USA) and U.S. Pat. No. 6,405,889 to Neiner, assigned to Metal Container Corporation, St. Louis, Mo. (USA). I have included some of their writings and teachings in the "Tutorial & Definitions" Section, elsewhere in this specification. Additional references used include the following, other than those listed in the "Prior Art" section below.

1. U.S. Pat. No. 4,276,993, to Hasegawa, entitled "EASY-OPENING CONTAINER WITH NON-DETACH TAB",
2. U.S. Pat. No. 6,375,029 B2, to Anthony et al, entitled "EASY-OPEN MISTING CONTAINER",
3. U.S. Pat. No. 6,405,889 B1, to Neiner, entitled "STAY-ON-TAB CONTAINER CLOSURE HAVING TEAR PANEL WITH LOW-RELIEF CONTOUR FEATURES ON THE UPPER SURFACE", It is usually hard to get at the pull-tab and to lift it from its resting position. If you try to lift it with your fingernails, you may break the fingernail, because you need a large force to lift the tab. If you try to push your fingertip under the tab tip, in order to use the tip of the finger instead the fingernail, there usually is not enough room to get your fingertip under the tab tip, and you would not be able to get a good "grip" on the ring.

Some users revert to using special tools to lift the tab at least a little bit, so that the user can get his/her fingertip under the tab tip, to be able to grab the tab lifter and lift it and open the seal. Such tools vary across the board. They can be a knife, a fork, a spoon, a screwdriver or the like. There is even now on the market a special tool, designed and being marketed specifically for this purpose, which basically is a short metal piece, which has a thin edge that can fit in the tight space between the top surface of the lid and the bottom surface of the tab tip. The tip of the tool is inserted in that space and is forced in and/or twisted, so as to lift the tab tip enough to insert the user finger there and then to fully lift the tab lifter.

TECHNICAL FIELD OF THE INVENTION

This invention relates generally to closures of the type used for metal beverage containers and, more particularly, to stay-on-tab closures in which an attached tab is lifted to partially sever and displace a tear panel to create an opening for dispensing the contents of the container. The current invention relates to a stay-on-tab closure having a tear panel with low-relief contour features on the upper surface.

BACKGROUND OF THE INVENTION (CONTINUED)

It is well known to use closures, also referred to as "ends" or "lids," for sealing metal beverage containers of the type used for packaging beer, carbonated soft drinks, juice, tea, water, and other liquids or fluids. These closures are typically formed of an aluminum alloy or steel, although other materials such as metal-plastic laminates or composites can also be used. A common type of closure, often referred to as a "stay-on-tab" closure, incorporates an attached tab which is lifted to partially sever and displace a tear panel defined by a frangible curvilinear score line. The downward displacement of the tear panel creates an opening for dispensing the contents of the container without the use of a separate opening tool. Both the tear panel and the tab remain attached to the closure after opening.

Conventional stay-on-tab closures typically include a center panel having a generally planar or slightly upwardly domed surface. A tear panel is defined by a curvilinear, but non-closed, frangible score line formed on the center panel which defines the general periphery of the tear panel but leaves a narrow integral hinge connecting the tear panel to the remainder of the center panel. An opening tab is secured to the center panel of the closure by a rivet or other such fastener hingedly connected to the tab. When one tab end is lifted upward, the tab applies forces to the tear panel and center panel to rupture the score line and displace the tear panel down into the associated container to form an opening through which the container contents can be dispensed. The non-closed portion of the score line forms a hinge, which retains the tear panel with the closure. Similarly, the tab remains attached to the closure by its hinged connection to the rivet.

To facilitate the easy bending of the tear panel into the container during opening, conventional stay-on-tab closures connect the tear panel to the center panel using a narrow hinge, i.e., a hinge having a width less than about 25% of the maximum width of the tear panel. Unconventional container closures having displaceable panels and permanently affixed tabs are also known, such as described in U.S. Pat. No. 5,405,039 to Komura, and such closures may be referred to by some as "stay-on-tab" closures. The displaceable panels in such unconventional closures, however, are connected to the center panel by a hinge having a width significantly greater than 25% of the maximum width of the displaceable panel. For example, one closure in the previously mentioned Komura '039 patent provides a displaceable panel comprising approximately one-half of the top of the lid and a hinge having a width of approximately 100% of the maximum width of the displaceable panel.

ADDITIONAL DEFINITIONS AND ABBREVIATIONS

LR=Low Resistance
HR=High Resistance
IR=Immediate Resistance
DR=Delayed Resistance
SL=Starting Lift
POP Pop
CS=Crack Seal
HT=Half Tear
CT=Complete Tear
FB=Folding/Bending The following individual pairs of expressions are use in this specification as being equivalent and synonymous:

free or empty space, free clearance;
lid, container lid, can lid;
pull tab opener, opener, pull tab;
tail end, tail tip, tab tip, pull tab tip;
tail portion, lifter portion;
lifter portion, tab lifter, pull tab lifter.

PRIOR ART

A patent search has revealed the following patents in the prior art.

1. U.S. Pat. No. 5,248,053, to Lundgren, entitled "OPERATING LEVER FOR BEVERAGE CONTAINER LEVER OPERATED OPENER",
2. U.S. Pat. No. 6,026,971, to Lundgren, entitled "LEVER OPERATED OPENER FOR CONTAINER",
3. U.S. Pat. No. 6,575,325 B2, to Dickie et al., entitled "ARTICULATED PULL TAB OPENER FOR CONTAINER",
4. U.S. Pat. No. 6,253,946 B1, to Makinen, entitled "CLOSURE FOR A CAN OF DRINK WHICH CAN BE OPENED WITH ONE HAND",
5. U.S. Pat. No. 6,588,617 B1, to Majcen et al., entitled "ROTATIVE CLOSURE FOR BEVERAGE CONTAINERS",
6. U.S. Pat. No. 6,347,720, to Schley, entitled "BEVERAGE CAN RESEALABLE LID HAVING ROTATABLE COVER MEMBER AND BIASING PULL TAB",
7. U.S. Pat. No. 6,443,323 B1, to DeRose, entitled "PROTECTIVE SEAL FOR CANS",
8. U.S. Pat. No. 6,202,881 B1, to Chiang, entitled "BEVERAGE CONTAINER WITH EASY CLEANING UPPER PANEL", and
9. U.S. Pat. No. 6,126,029, to Storgaard, entitled "CAN WITH A COVER PROVIDED WITH A PULL RING".

BRIEF SUMMARY OF THE INVENTION

Objective

The Object of this Invention is to create and to provide means and methods to facilitate the opening of cans and containers that have opening pull tabs, by hand, without the need for external tools. The route to do so, is basically by providing ways to increase the space or gap between the tab tip and the lid, so as to allow the user to more easily and readily insert a finger or at least a finger tip, in that space or gap, so as to have a better grip, or at least a better hold or pull on the pull tab lifter and hence be able to lift the tab lifter and to open the can, or rather the can seal.

Another object is to manufacture the pull tab and/or the lid in a new shape, so as to provide such a desirable space (gap) between the pull tab tip and the lid.

Yet another object is to make the pull tab, such that it can be lifted more easily.

A further object is to make the lid with certain protrusions or depressions, and assemble the pull tab to such a lid, so that the user would rotate the tab and thus move its tab tip higher so as to provide the desirable space/gap between the tab tip and the lid.

An additional object is to ensure that any of the above features would still allow the cans to be stacked up, one on top of the other, and still have enough room or space to accommodate the stacking.

A yet another further object is to combine two or more of the above features and improvements, and to get a multiplication of the ensuing benefits.

A yet another object is to be able to use some or all the above features with other containers.

BRIEF DESCRIPTION OF THE INVENTION

The Problem

The problem with the present/conventional pull tabs is that it is difficult for a consumer/user to get his/her finger, or at least finger tip, under the edge of the tab tip of the pull tab lifter.

The words "consumer" or "user" or "you" are used as synonymous terms to indicate any person trying to open a can with a pull-tab and to access its contents.

FIG. 1 through 5 show examples of one of the present conventional cans on the market.

FIG. 6 through 10 show how normal people would try to open the present conventional cans. And the kind of difficulties they may have. They may break their fingernails or hurt their fingertips.

You need to lift the tip of the tab ring, high enough, to at least get the tip of the finger under the tab tip of the lifter, so that you have some "good grip" on it to lift up the tab lifter.

The pull tab is riveted to the lid in such a strong way and in a way that the pull tab is flat and pretty close to the top surface of the lid, leaving hardly any space/room to get your finger under it, or at least under the tab tip of the lifter. Many cans have a small shallow recess in the top surface of the lid near the tab tip of the lifter, but usually that recess is so small and so shallow that it is almost worthless.

So the main object of this present invention is to provide such a space, i.e. to provide some space between the top surface of the lid and the bottom surface of the tab tip of the lifter, such a space will be referred to herein after as the finger tip gap, so that a consumer, at least a consumer with normal fingers sizes, would be able to push/insert his/her finger tip in this finger tip gap and get a reasonable good grip/grab, so as to be able to pull the lifter up, high enough to be able to pull the lifter further and finally open the can, or rather the can seal.

The present invention proposes several methods and means to accomplish this goal and to attain these objectives.

There are at least the following approaches or groups of solutions, which I will describe here by some keywords, and will describe in more details later:

1. Provide Deeper Finger Recesses.
2. Provide elevated tab tip of the lifter.
3. Reduce the resistance against starting the pull, using the "Push-Pull" method.
4. Reduce the resistance against starting the pull, by using the "Rotate-Pull" method.
5. Use a combination of any of the above.

BRIEF DESCRIPTION OF THE SEVERAL VIEWS OF THE DRAWINGS

FIG. 4 shows some typical dimensions.

FIG. 24 shows the pull tab bent upward at the nose portion of the pull tab, and the pull tab is at rest and the user is ready to open the can. FIG. 25 shows the user pushing on the nose portion of the pull tab, which urges the lifter portion and the lifter end of the pull tab to rise and to create a considerable gap/free space between it and the underlying surface the lid. FIG. 26 shows the user placing his/her finger tip in the resulting gap under the lifter tip of the pull tab.

FIGS. 30 and 31-A show various shapes of pull tabs, bent at various positions, to achieve the same end results as just described in FIGS. 24 through 26 and in FIGS. 27 through 29.

FIGS. 31-B through 79 show several embodiments, with one main general important feature. The pull tab of these embodiments will have two degrees of freedom. One degree of freedom is exactly like the conventional tabs, where the tab will rotate "vertically" with respect to the surface of the lid, i.e. where the lifter end of the pull tab will move upwards and away from and above the surface of the lid, while the nose end of the pull tab will move downwards and into the surface of the lid, to open the seal. The second degree of freedom is where the pull tab will rotate "horizontally", i.e. parallel to the surface of the lid. This horizontal rotation will get the pull tab to go over some "camming" surfaces, which will ultimately generate a vertical motion, which in turn will ultimately accomplish the same end result, i.e. it will get the lifter end of the pull tab to rise and to create a gap between it and the underlying surface of the lid and consequently allow easier access to open the can. It can also at the same time, force the nose end of the pull tab to go down towards the surface of the lid. It would be a design option, to either have the nose end start to crack the seal during the horizontal rotation or wait until the end of that horizontal rotation before starting the "cracking" of the seal.

FIG. 31-B shows some "stops" to control and to limit the horizontal rotation of the pull tab.

Of course, the flanges could be longer as well. But no sense repeating every individual feature. It is obvious that this is doable.

Figure 58:
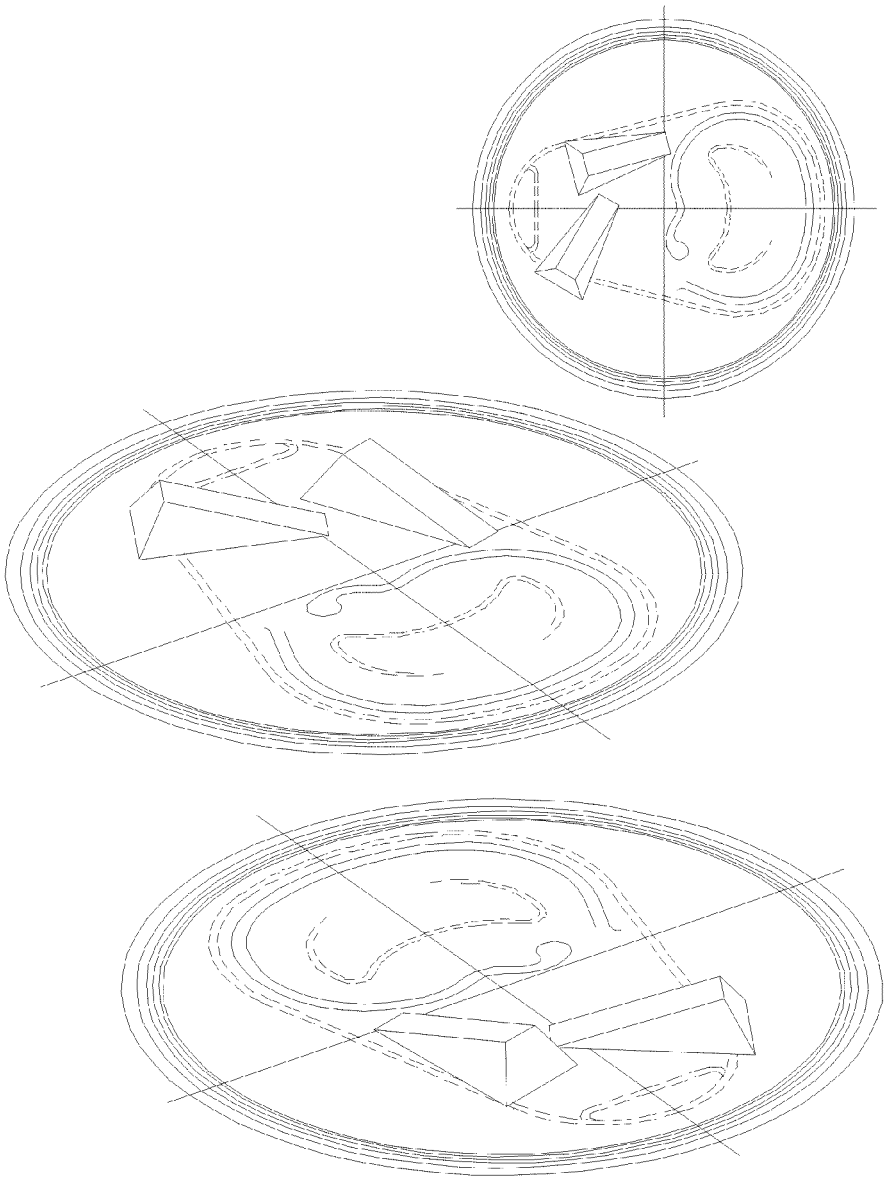
Figure 59:
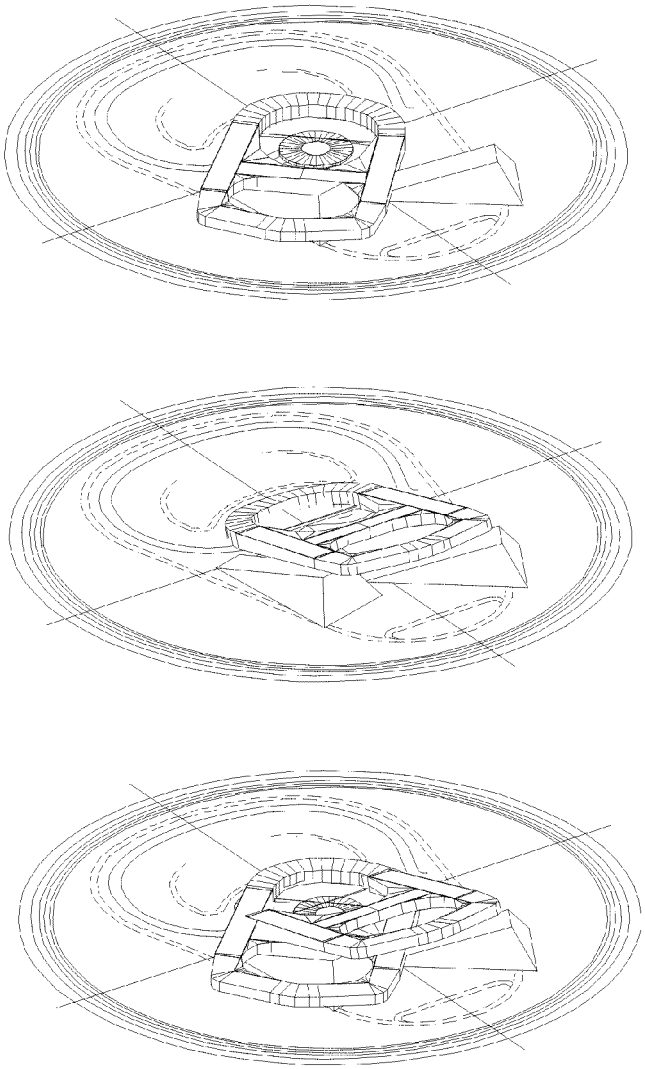
Figure 60:
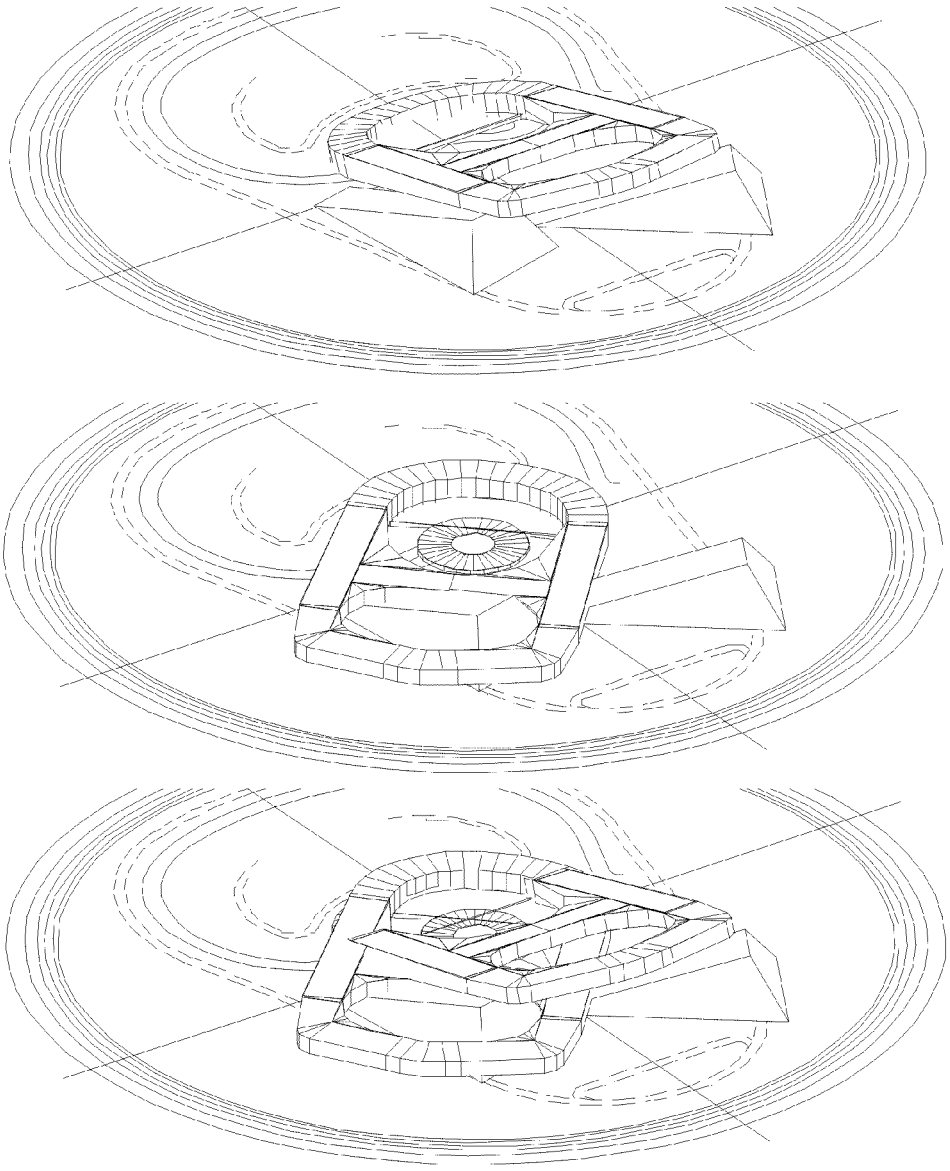

FIGS. 58 through 60 show another similar setup except that the cams here look a bit different. The original vertical walls of the cams have been slanted to a certain angle to make them easier to manufacture. Otherwise the metal may become too weak or too thin to form these cams out of the original flat sheet metal of the lid.

FIGS. 61 through 63 show again a similar setup, except that the cam has been "filleted" all around, to make it even easier yet to manufacture and to make it more smooth to the touch of the user. FIGS. 61 and 62 show the lid having only one cam, while FIG. 63 has two cams. It is possible to use only one cam, especially it is positioned so as to interact with the central portion of the lifter portion of the pull tab, the portion connecting the two long edges of the pull tab in that area. In the case where two cams are being used, then the cams could interact on the two long edges of the lifter portion of the pull tab.

FIGS. 64-A and 64-B show the two stops at the ends of the cam, which is interacting on the central connecting portion of the lifter portion of the pull tab.

FIGS. 65-A and 65-B show a top view of a set up similar to one shown in FIGS. 63-A and 63-B. The cams are shown to have a uniform width, as opposed to the conical shape, just to show the various possible shapes of cams.

FIGS. 66 through 68 show a cross-sectional view through the lid and the cam, with the pull tab on top of the cam and behind the cam. The top "-A views" show the top of the cam being round nosed, while the lower "-B views" show the top of the cam being almost trapezoidal, so that its top surface would match the surface of the pull tab at that "mating" position.

FIGS. 69 through 79 show a group of lids and pull tabs, where the lid has two break-away seals instead of just one. The basic idea is to provide an easier way for the users to horizontally rotate the pull tab in either a clockwise or a counter-clockwise direction and in either case, the pull tab will encounter a seal that can be opened. A number of different shapes and options are shown.

Figure 80:
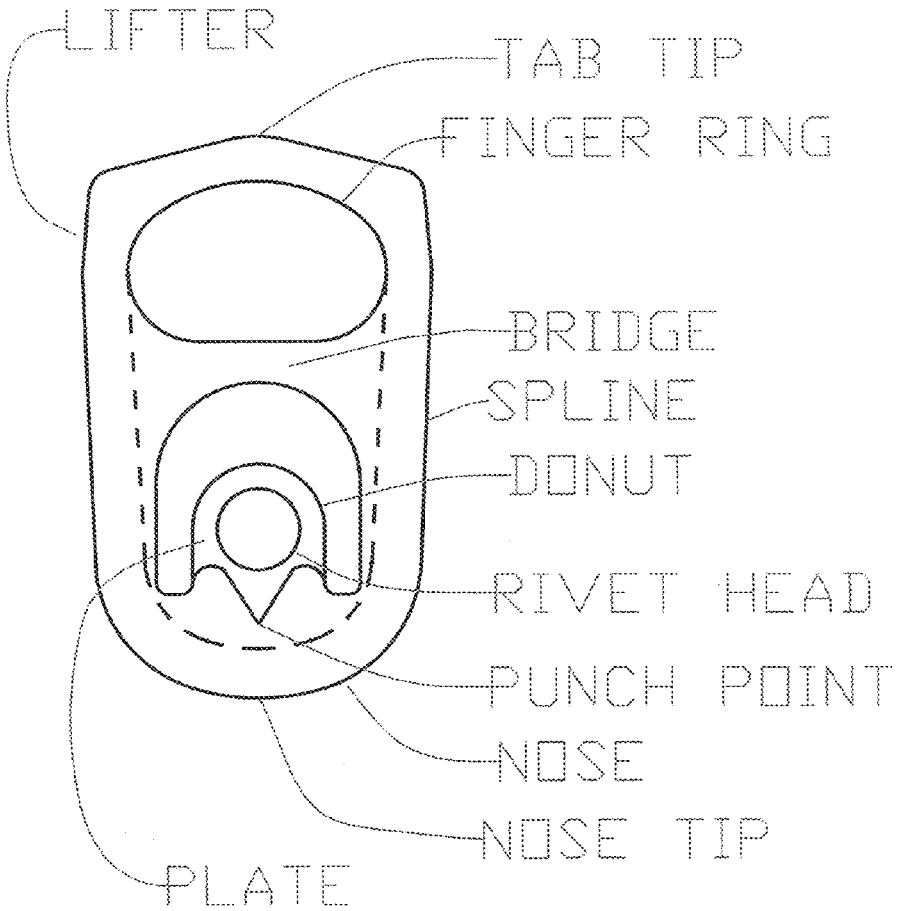

FIG. 80 shows another improvement that can be introduced in the pull tab. It is the "punch point", where this punch point can help in breaking/popping the seal.

Figure 81:
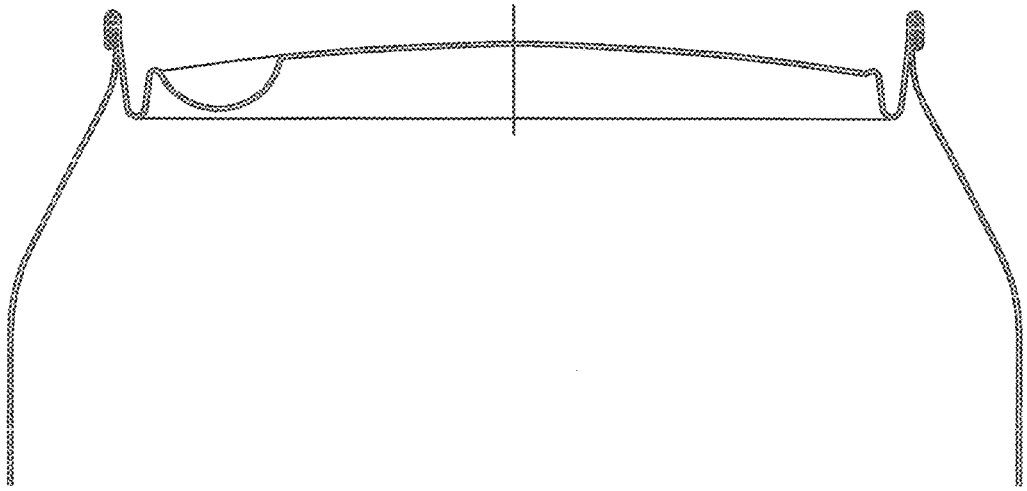
Figure 82:
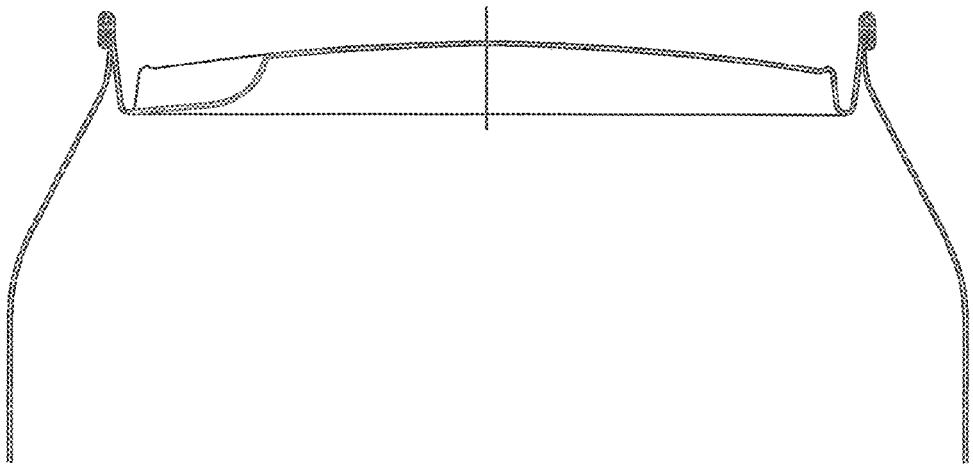

FIGS. 81 and 82 show two alternatives that could be introduced in the lid, to create a larger gap under the lifter end of the pull tab, to make it easier for the user to insert the finger tip under the tab, to lift it and to open the can.

FIGS. 83 through 100 is a group of figures that show two things. First, FIGS. 83 through 88 show the prior art/conventional pull tab/lid interaction and the forces involved in lifting the pull tab and the incremental steps and forces involved during the lifting of the tab and the breaking of the seal and opening the can. Second, FIGS. 89 through 100 show the corresponding details, but for a pull tab/lid combination according to one of the embodiments as per the present invention.

FIGS. 101 through 109 show the interaction between the pull tab and the lid, which has a deep finger well as per FIG. 81 or 82. The tab in this case has a "raised" nose portion, in addition to having the deep finger well in the lid. It is not necessary to raise the nose portion of the pull tab to have some benefit of the deep finger well, but the raised nose provide an even greater benefit.

FIGS. 110 through 117 show a pull tab/lid set up with a camming action, providing a similar benefit as the embodiments shown in FIGS. 31.B through 79, but with one major difference. In this case, the cam in below the general surface of the lid, instead of being above it.

DETAILED DESCRIPTION OF THE INVENTION

This specification covers a number of embodiments or groups of embodiments, based on the present invention. Each embodiment will be described in detail here below.

Embodiment Group 1

Deeper Finger Recesses

FIGS. 11 through 15 show some proposed method to facilitate the process of opening a can with pull tab.

Also, FIG. 81 and FIG. 82 show additional proposed finger recesses or finger wells.

Basically, the idea is to make the finger recess deeper and possibly wider. We can even bring the recess closer to the edge, but leaving enough room for the tools, which seal the lid to the container's body to create the seals. This can be the "rolling" or sealing operation or the like. Sometimes it is called the "double seam" operation.

Embodiment Group 2

Elevated Tip of the Pull Tab Ring

FIGS. 16 through 21 show the general shape of the proposed shapes of the pull tab. Either the tip of the pull tab lifter would be bent up or "arched" up, or the whole length of the pull tab would be bent up, so that there would be enough room/space, or what I referred to as finger tip gap, for the user to insert a bigger portion of his finger or rather finger tip under the pull tab tip and to get a better grip on it, to be able to lift it up and then pull on it. There should be plenty of room at the bottom of the can to allow for this modification of the shape of the pull tab, if and when the cans were to be stacked up one on top of the other, because the bottom of the cans is domed deep enough, creating a cavity/space that provides plenty of room for such an arrangement. With this in mind, we should limit the amount of bending up of the tab tip or of forming the pull-tab in general, so that the whole thing would still fit in the available space. Another thing to keep in mind is that you do not want to create a "catch" condition, where parts of the tab would protrude too far above the rim of the can. This may create a condition, where the tab would accidentally get pulled or pushed during handling and would open the can inadvertently. You can make the can with a higher lip at the edge of the lid, or make the lid deeper to accommodate that, if necessary.

Embodiment Group 3 & 4

Reduced Resistance to Starting the Pull

FIGS. 23 through 31-A show the general idea of the proposed shapes of the pull-tab under this embodiment. In addition, FIGS. 81, 82 and 89 through 109 give more details of the proposed methods and FIGS. 83 through 88 shows the prior art methods and details, as a comparison against the new proposed methods.

The basic reasoning for these embodiments is the following.

When a person tries to lift the tip of the pull-tab lifter, he is working usually against a number of resisting forces, which act either sequentially and/or simultaneously.

The goal of the proposed embodiments is to delay the onset of the high resisting forces against the pull-tab, until the user gets a good hold on the tab tip. I will explain below, first, the existing "unfavorable" conditions that exist presently in conventional prior art embodiments, and then, second, the improvements set of conditions proposed by the present invention.

First, the Existing Prior Art "Unfavorable" Conditions

The forces involved while lifting the pull-tab and breaking the seal can be described and analyzed as follows. I will use the chart in FIG. 83 to illustrate these forces and to highlight the "timing" of when each force comes into play.

When we want to open a can having a pull-tab, we pull the tab tip of the lifter upwards, i.e. in a direction perpendicular to the general surface of the lid I will refer to it also as the "vertical" direction. This upward movement of the lifter creates a downward movement of the pull tap nose, which applies a downward force against the seal, and eventually breaks the seal open. The pull tab and the seal, and to a certain extent the lid itself, create some resistance against this action, which resistance materialized itself in a force at the lifter tab tip, which the user observes and will have to overcome, if he wants to open the can seal.

F1—Low Tab Flexing Resistance

If the tab was not acting against the lid seal and is simply held in place by the rivet and we wanted to lift the tab tip up, then we would have to "bend" the central portion or "plate", which is the part of the pull tab containing the "donut". The force required to bend the plate and the donut will be referred to hereinafter as F1. The pull tab is usually constructed to have a certain amount of rigidity/flexibility, and has been referred to in prior art patents as having "a controlled flex central portion, which I have referred to as the tab plate or tab donut, or simply the donut, which is disposed between the tab nose and the tab lifter. So, this F1 is the force provided by this controlled flex donut, against any attempt to lift the tab tip, assuming that there are no other resisting forces. So, I will refer to this force as the "tab flexing resistance" force, F1. F1 is usually pretty small compared to the other forces that I will describe next. In addition, it can be "controlled" to be larger or smaller, depending on the needs.

We can actually get a good feel of the magnitude of the F1, as follows. After we open a can, and bent the seal inwards inside the can, the pull-tab will be acting on its own from that moment on. If at this time, we go ahead and push or pull on the tab, we will be working against this "tab flexing resistance", which is what I will refer to as force F1. We will be able to see, to feel and to realize how small this resistance is, compared to the force required to open the can in the first place.

So, the donut enables the lifter to be lifted and moved upwards, presenting only a small amount of resistance, referred to hereinafter as the tab flexing resistance. This condition remains so, until the nose touches the seal.

F2—Seal Breaking Resistance

Upon further raising the lifter at the tab tip or by any other way, the nose would move further downward and would apply forces on the seal with the purpose of breaking the seal, all this happening in a sequence of events, as mentioned above. At first, the lower surfaces of the nose touch the upper surfaces of the lid and of the seal and transmits the upward movement and force applied at the lifter inversely to the seal. Upon increasing the force, the seal will start to break, at which time a pop may be heard. And upon further application of the movement and force, the seal will crack open to a larger extent, and gradually upon still further application of the movement and force, the seal will open fully.

The forces required to crack and break the seal itself can be calculated and predicted. Basically, it is a "shear" force, which is equal to the shear strength of the material multiplied by the surface area of the area to be sheared. If this happens gradually, then the area to be sheared is only the area that will be cracking at any particular instant. If the action is fast and/or sudden, then the affected or impacted area can be considerably larger. In any event, this force is much larger than the F1 force, the force required to simply flex the tab or the tab donut area.

In addition, if the container is pressurized, that is has some pressure inside it, say from having a carbonized liquid inside it, then this pressure will add to the resisting forces opposing the action of the pull tab.

So, again but in different words, if the tab body were attached to the donut by a frictionless hinge/connection, i.e. F1 would be equal to zero, and then we would try to lift the tip of the pull tab lifter to open the seal, then the only force resisting this lifting action would be the force required to crack and break the seal, which would be, a) the force required to shear the material of the lid along the "score" line, plus b) the force against the pressure inside the can, if the can is pressurized for example by some carbonated drink. We will refer to this force hereinafter as F2.

Actually, F2 can then be divided into two forces, which are: 1) the force required to just crack and break the seal along the score line and 2) the force to work against the internal pressure from inside the can.

F3—Seal Bending or Folding Resistance

After the seal is cracked and broken, we would still need to push the seal inwards to get it away from the opening. In other cases, like if we are opening a sardine can for example, the seal is usually pulled out. Here the resisting force is the force required to bend and fold the seal about the connecting neck or lip. We will refer to this force hereinafter as F3.

If we evaluate these various forces, we would most probably determine that F1 is the smallest of the three and that F2 is the largest one. These F1 and F2 forces are the two important forces that we want to address at this moment, especially since F3 does not come into play until we go through F1 and F2 first.

Figure 83:
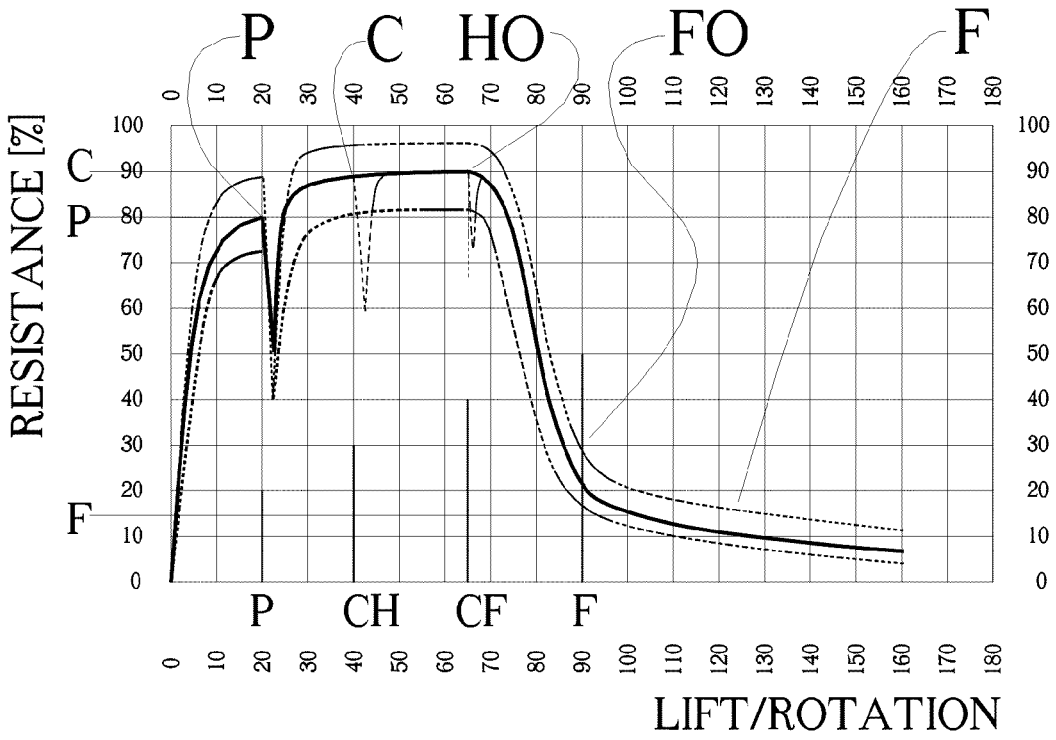
(PRIOR ART) FIG. 83

We can generally find that the graph/chart shown in FIG. 83 gives a good rough approximate relation between the magnitude of the forces and the position of the pull-tab. We could refer to the figures in the chart as "Force-Deflection" curves. The "deflection" will be measured by the lift of the pull tab tip, and/or the angular rotation of the tab body, measured above the surface of the lid.

Also, please keep in mind that the chart is exactly not to scale. First of all, different containers made of different material and different designed would have different forces or force levels. And depending on the design, sizes, dimensions, etc, the amount of lift required to reach certain events would be different as well. The chart simply gives a "comparable" picture, showing the approximate relation of the forces coming into play during these events. The vertical scale could be showing the "relative percentages" of the forces involved.

In addition, the chart shows three sets of curves. The middle solid dark curve is the most probable, and the dotted curves above and below it, show the possible variations in the level of the forces.

Also, please keep in mind that this chart represents the present existing or conventional method of opening the cans.

All the curves are illustrative approximations, and are not to scale, but they simply show the "relative" magnitudes of the various acting forces.

Please refer also to FIG. 84 through 88 in conjunction with the curve in FIG. 83.

At the start of the tab movement, i.e. at tab rotation of 0 degrees or at zero lift of the tab tip, the force is zero. This is represented by the point S on the curve in FIG. 83. When we start to pull upwards on the tab tip, we encounter a force that follows the curve from point S to point P. This is a combination of the forces F1 and F2-*a* mentioned above. At point P, the seal is just cracked and the pressure is released. We may also hear a "POP", and that is why I called this point P.

Figure 84:
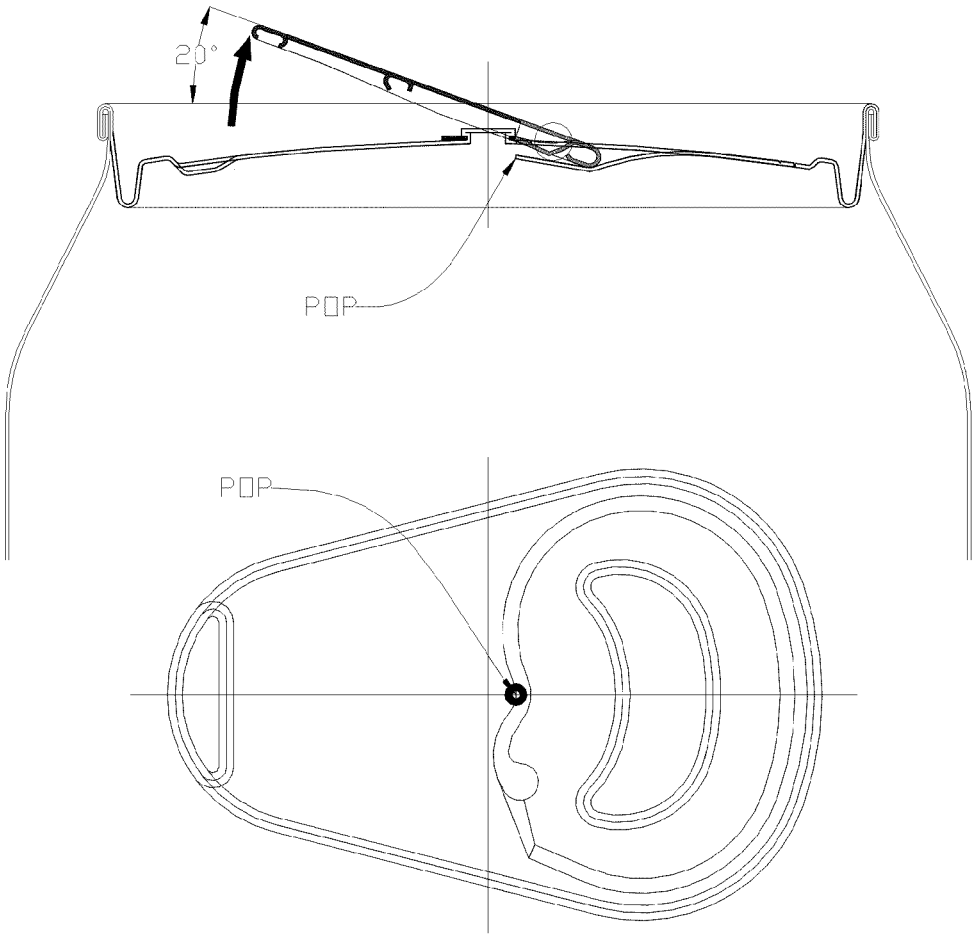
(PRIOR ART) FIG. 84

This is represented in FIG. 84, where the pull-tab has been lifted approximately 20 degrees from the surface of the can lid, or from the horizontal, assuming that we start with the can sitting on a horizontal table and the can lid is horizontal. FIG. 84 also shows the approximate location of where the seal begins its cracking and creates this "pop"

At this moment, we would notice a sudden dip in the force required for keeping the tab at this position. If we go slowly in lifting the tab tip, the point will be pretty noticeable. I called this low level of force the point P2 on the curve in FIG. 83.

Figure 85:
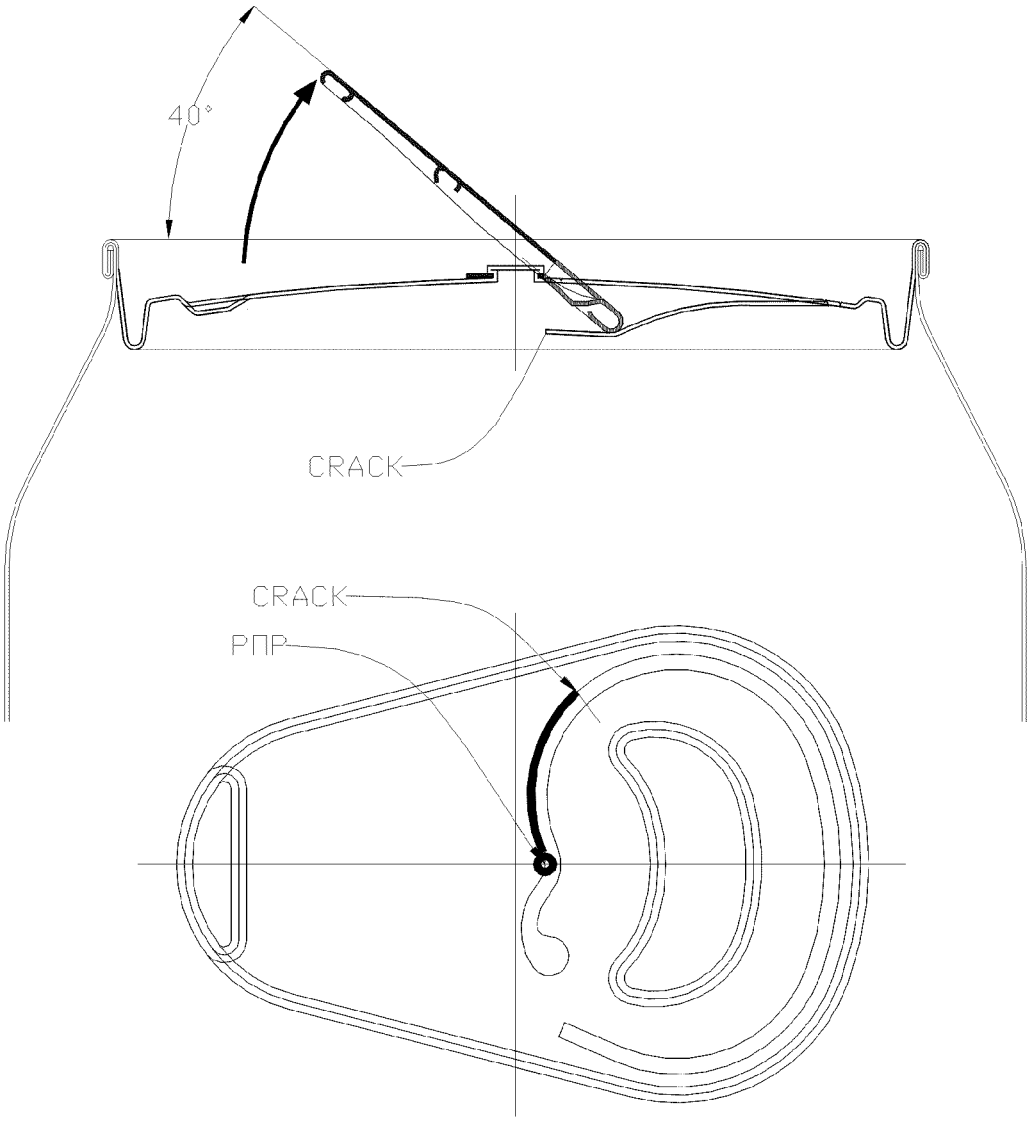
(PRIOR ART) FIG. 85

Then we notice that, if we keep pulling on the tab tip, i.e. try to lift it further, then the force would rise back up and may reach the level shown by point C. This is a point where a certain length of the seal score has sheared through, almost at the same time. It is the darkened length of the seal score that I have highlighted between the "Pop and the "Crack" in FIG. 85. FIG. 85 shows also that the pull-tab has been lifted approximately 40 degrees from the surface of the can lid, or from the horizontal. We can see that this portion of the seal is approximately parallel to the y-axis, and practically all the points along that section of the seal would crack roughly at the same time. So, the shear force would be equal its total length multiplied by the shear strength of the material. This is why the force required to do this part of the job may be pretty high, as seen on the chart.

At this moment, we may feel a sudden dip in the amount of resistance, where the resisting force may dip to some point like point C2.

Figure 86:
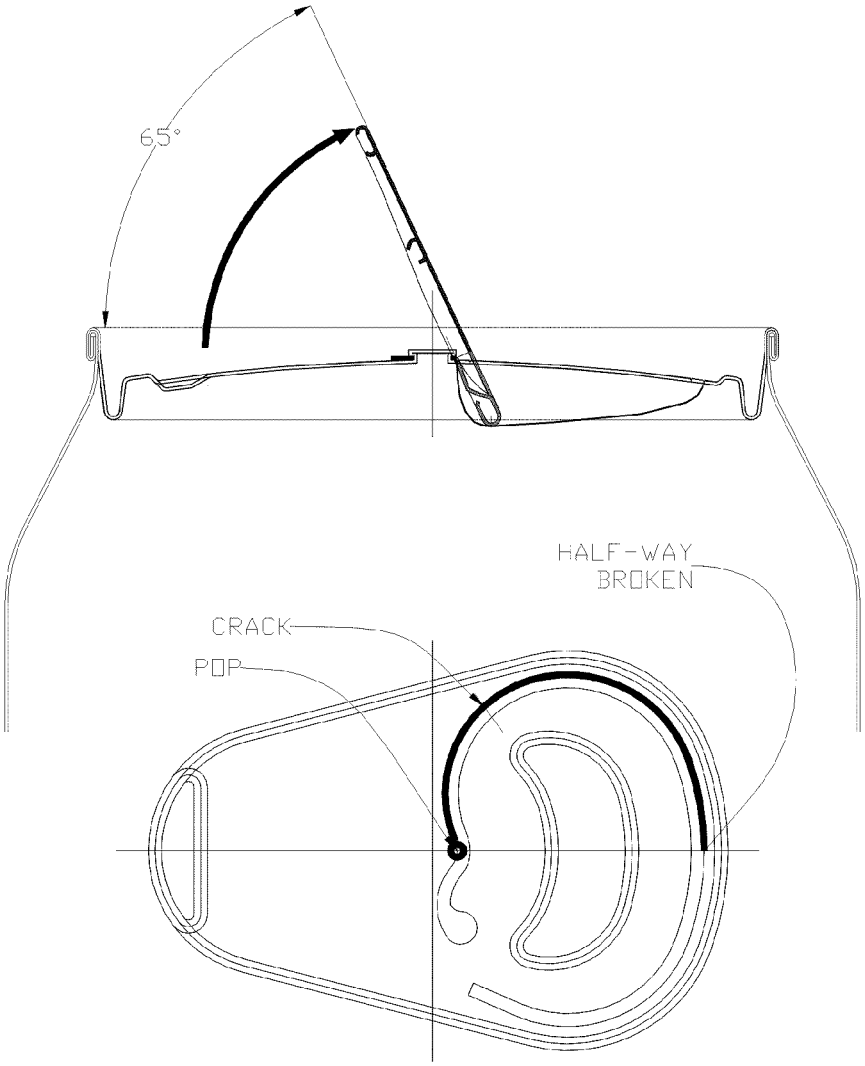
(PRIOR ART) FIG. 86

Upon lifting the tab tip higher, the force curve continues further until it reaches point HO. See chart in FIG. 83 and the drawing in FIG. 86. At this moment, the seal is roughly "HALFWAY BROKEN" or "HALF OPEN", hence "HO". FIG. 86 highlights that portion of the seal. It also shows that the pull-tab is at approximately 65 degrees.

Figure 87:
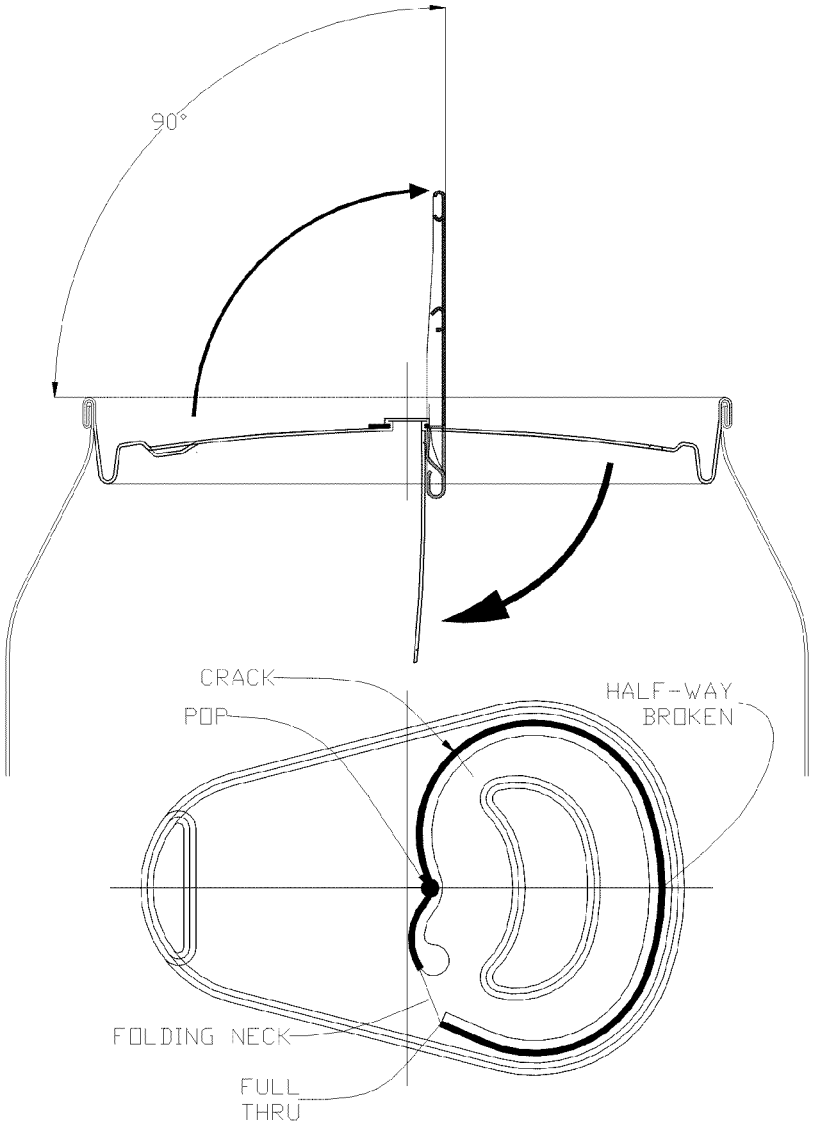
(PRIOR ART) FIG. 87
Figure 88:
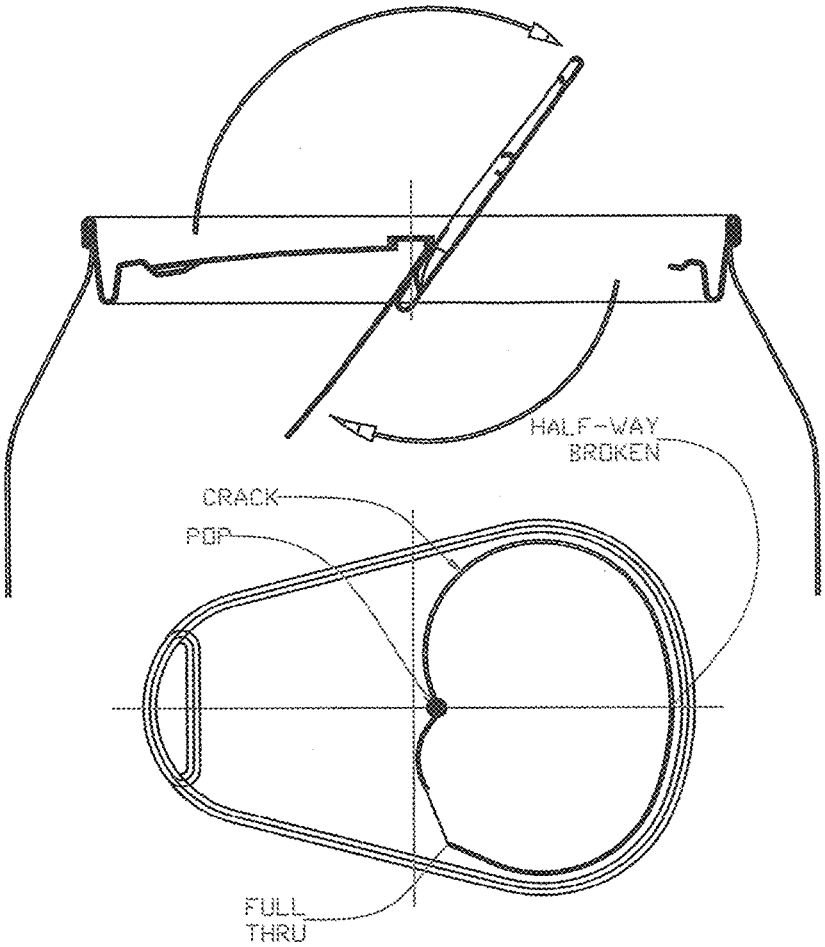
(PRIOR ART) FIG. 88

From this point on, the force-deflection curve shows that the force will start to diminish rapidly until point FO, "Fully Open". FIG. 87 shows the highlighted broken seal, and shows the pull-tab almost vertical, i.e. perpendicular to the lid surface.

At this moment, the seal is hanging on to the lid only by a narrow strip of material, which I refer to as the neck. If we push the pull tab farther, rather rotate it through a larger angle in that same direction as before, then the tab nose will push the seal inwards, inside the can. In this case, the only force resisting the movement will be the force required to "bend" or "fold" the neck of the seal through the traveled angle. This force is relatively small, as any user could feel when actually opening any similar can. This force stays relatively constant for as long as we want to keep folding the seal further inside the can. See the relatively flat curve in FIG. 83, marked "F", and the position of the seal and the pull-tab in FIG. 88.

At this moment, the seal at the score line has been fully broken and the seal will dip inside the can. During this stage, the forces resisting the movement of the tab are F1 and F3.

From this point on, the curve shows that the remaining resisting force is pretty small. Actually, the forces acting here are F1 and F3 and a smaller portion of F2-*b*.

Again, I am showing three probable shapes of the curve, which I called 1-Conventional High, 2-Conventional Steep, and 3-Conventional Most Probable. These are simply illustrative representations and do not come into play at the beginning of the operation, i.e. at the time we start to lift the tip of the tab.

The important parts of the curve are at the beginning of the operation, starting from 0 degrees to approximately 25 degrees. This is where the finger needs to be inserted and placed under the tip of the tab to start the lifting process.

We can see that almost from the "get go", we have to overcome a high resisting force (F1 plus F2).

Proposals As Per Present Invention

As will be shown down below, I have at least two different ways to reduce this resisting force.

First, I will show how to decrease the starting resisting forces from the present curve shape to a more favorable one. I will refer to this lower curve shape as the "F1-Only" Curve, or the "LOW STARTING AND DELAYED RESISTANCE".

Second, I will show how to decrease the resisting forces against the lifting of the tab tip one more step yet. I will refer to this curve as the "Zero F1/F2" Curve, or the "ROTATE FIRST AND LIFT SECOND".

One Proposed Preferred Embodiment

Embodiment Group 3

Reduced Resistance to Starting the Pull, by Using the "Push-Pull" Method

Again, FIGS. 23 through 29 show the method of accomplish this embodiment.

Figure 23:
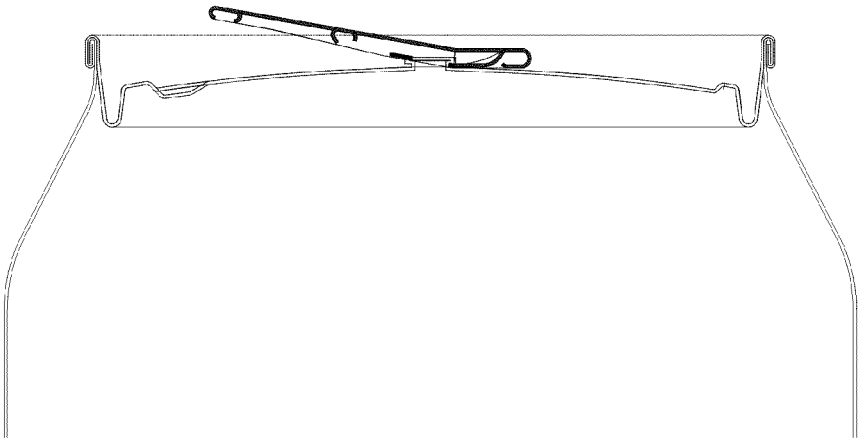
FIG. 23 shows one of the embodiments as per the present invention. The pull tab body has been bent and shaped as shown, to allow a larger gap under the lifter tip of the pull tab, to provide the user with easier access under the lifter tip. The bend can be either at the nose portion of the pull tab, or at the lifter portion or at both of them.
Figure 24:
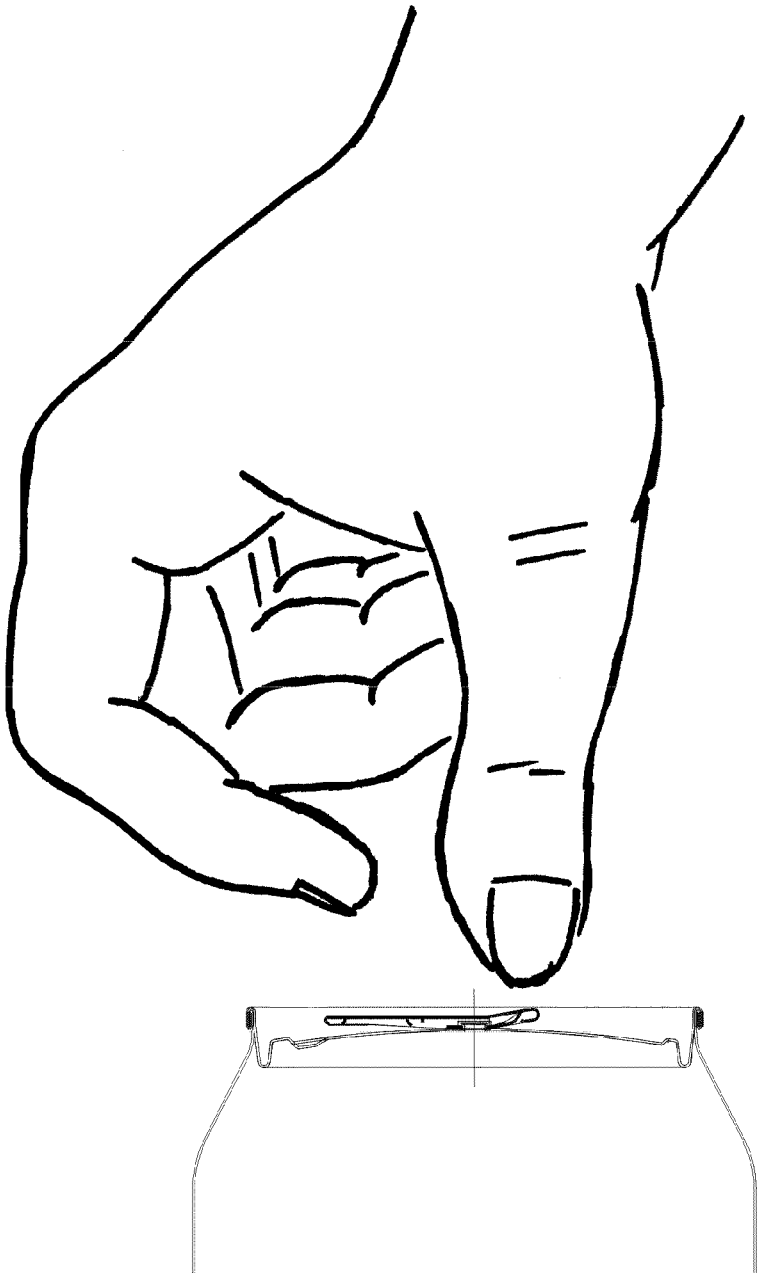
FIGS. 24 through 26 show the basic action.
Figure 25:
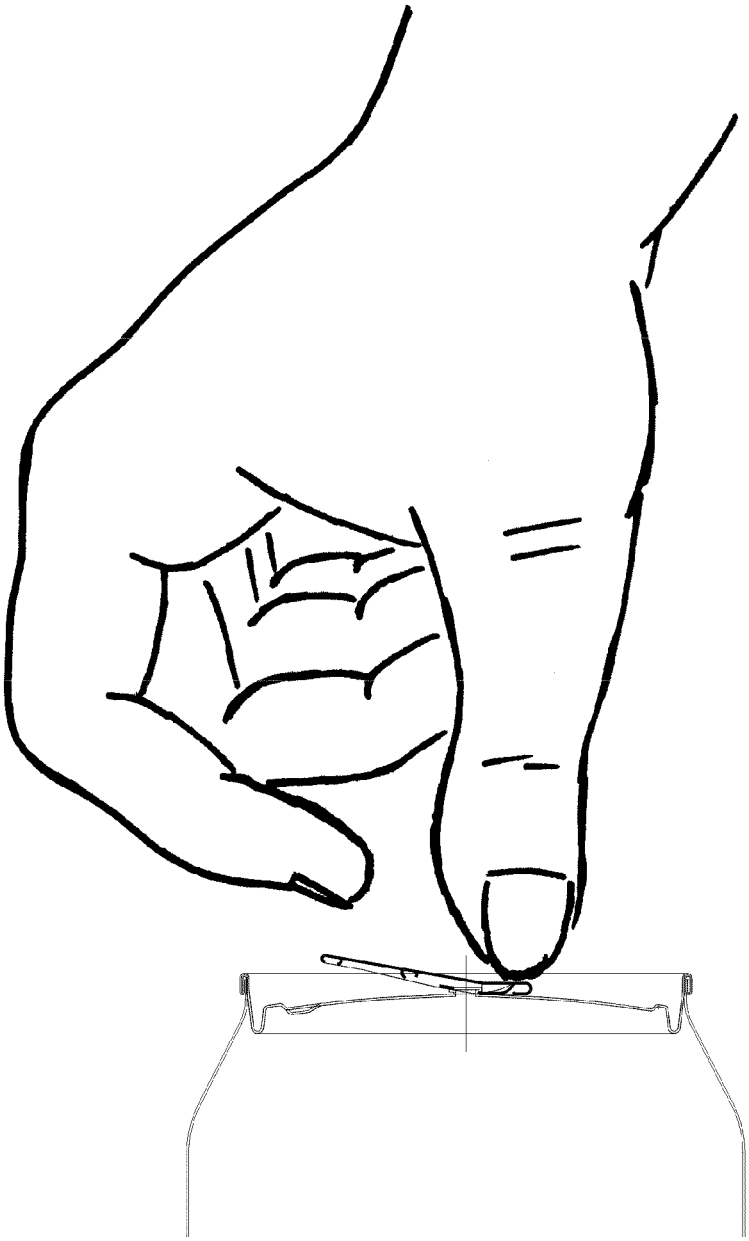
Figure 26:
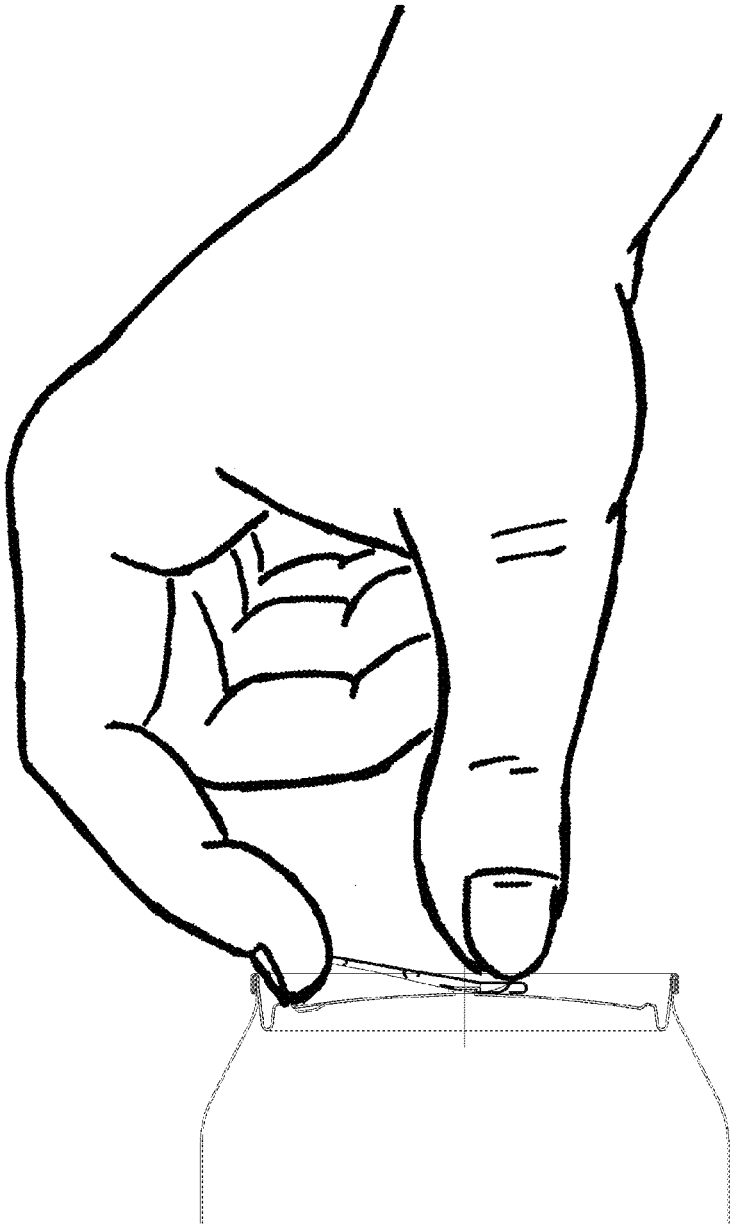

In FIG. 23 the tab has been bent up from about the area of the donut or the rivet out to the tab tip of the lifter. FIG. 24 shows the tab in the rest position, as made at the manufacturer.

The tab tip is down, but the "nose" is raised up at a certain distance away from the lid and its seal. This distance will be referred to hereinafter as the "Initial Nose Seal Clearance". The user would push his thumb down on the nose, as in FIG. 25, thus lifting the tab tip up as shown. The user would then have an easier time inserting the tip of the (index or any other) finger under the tab tip of the pull-tab lifter, as in FIG. 26, and then lifting the tab.

Figure 27:
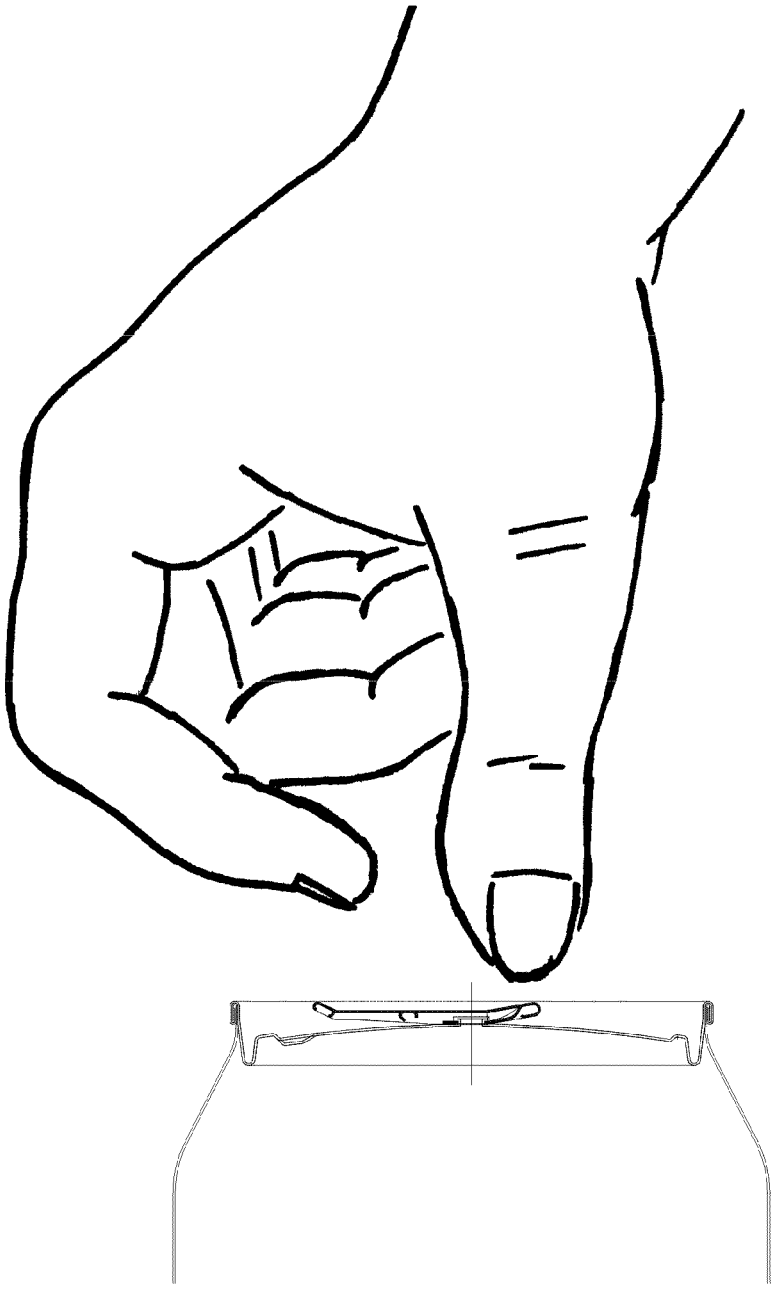
FIGS. 27 through 29 show a similar situation as in FIGS. 24 through 26, except that the pull tab in this case is bent in addition at the lifter end of the pull tab as well.
Figure 28:
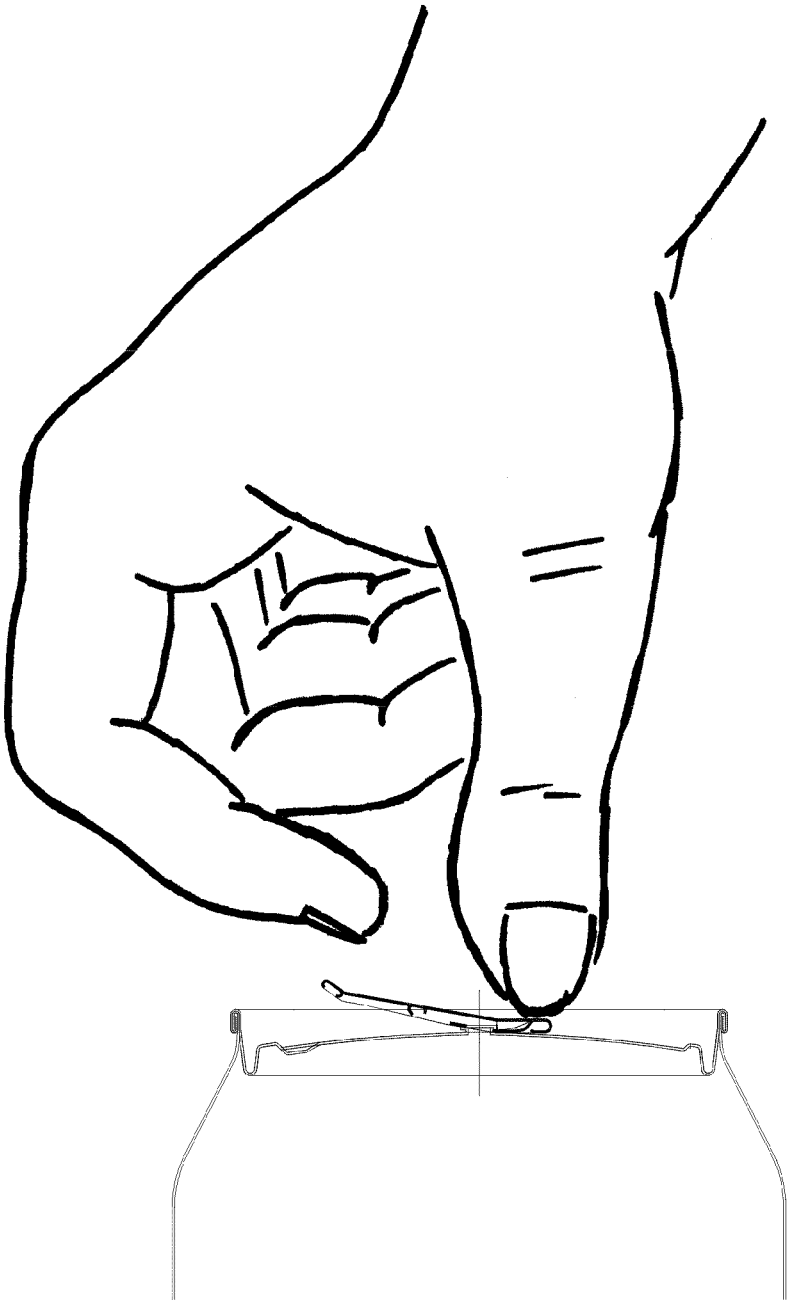
Figure 29:
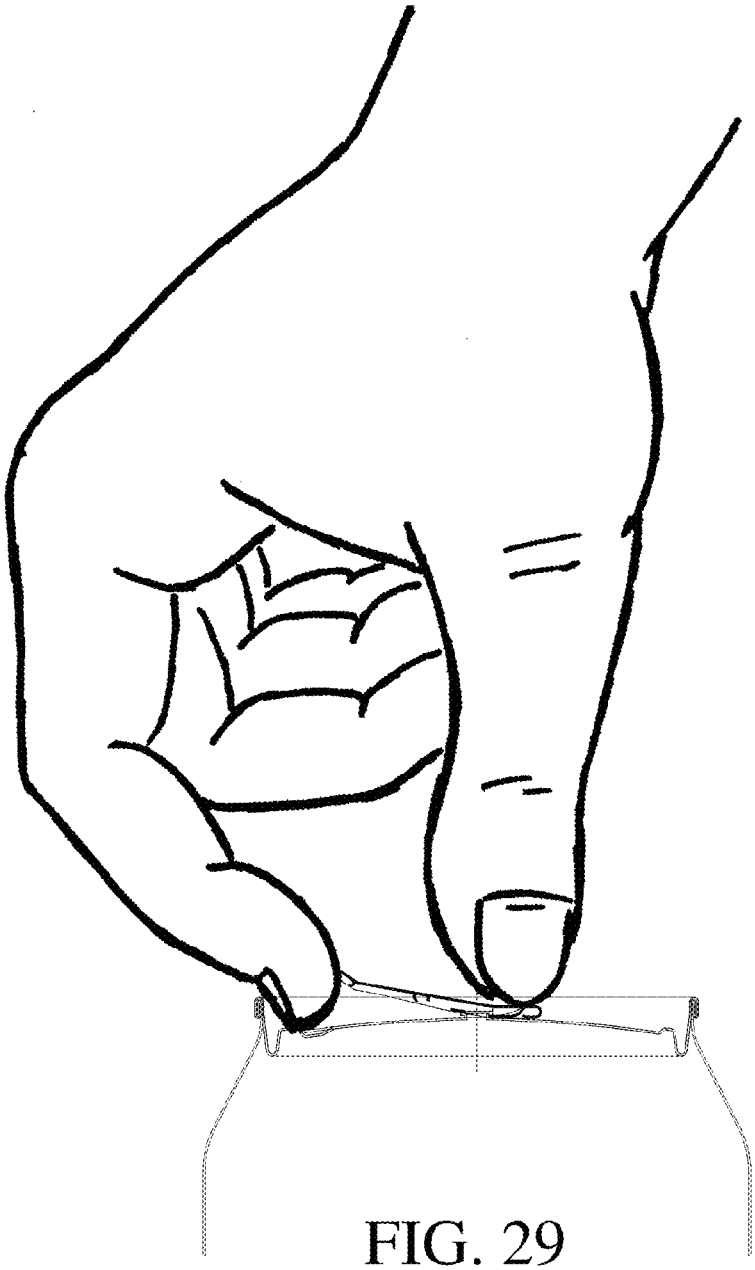
Figure 30:
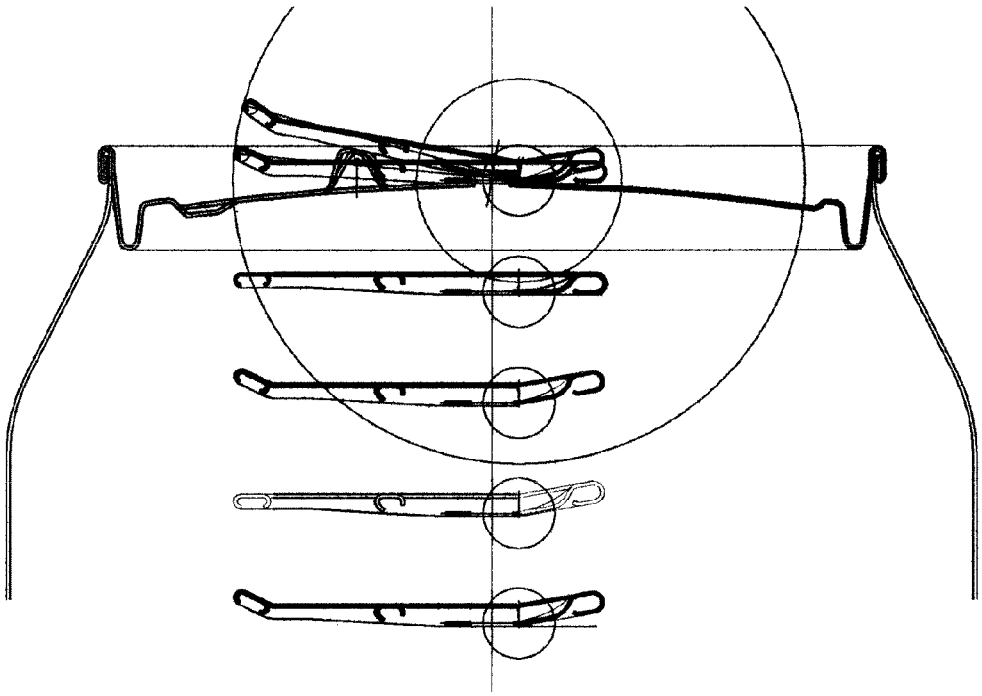

FIG. 27 through FIG. 29 show a similar arrangement, except that the tab tip of the pull-tab has been bent upwards to allow even more space underneath it and easier access to the user finger. The tab tip can also be "arched" upwards too, as shown by reference numeral 5 in FIG. 75.

"Low Starting and Delayed Resistance", or "F1-Only" Curve

Figure 89:
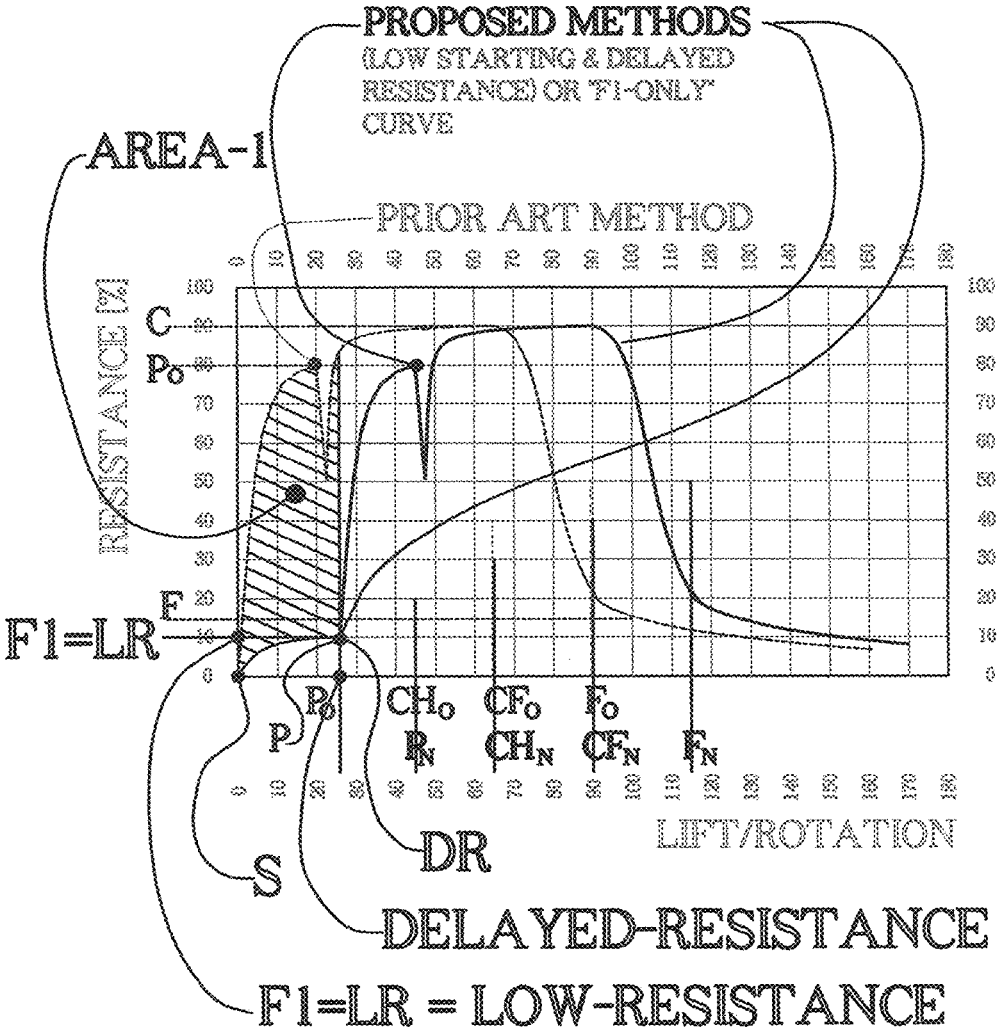

Now, I want to introduce the chart in FIG. 89 [20-1].

The chart shows the old "Force-Deflection" curve, which was shown in FIG. 83 [18-1], but only the so-called "3-Conventional Most Probable", i.e. the dark solid curve of FIG. 83. This curve is shown in this chart as the "dotted" curve, indicating the old, prior art, curve.

The chart of FIG. 89 shows also another curve, which is the dark, solid curve, and which is the "IMPROVED CONDITIONS CURVE" or the "PROPOSED METHODS" curve.

Now I will describe the new Proposed Methods curve. It can be seen that the proposed curve starts at the same point, point S, like the old one. However, the curve goes to point P on the X-axis, which is the LR level on the Y-axis, i.e. the Low Resistance point, because we are working against only the controlled, low tab flexing resistance, without encountering any of the higher resisting forces of breaking the seal etc. This low initial resistance will be referred to hereinafter as the "low initial resistance" or simply the "LOW-RESISTANCE".

We reach this point P on the X-axis, at around 20-30 degrees of lifting at the tab tip. This distance of 20-30 degrees will be referred to hereinafter as the "delay in the onset of the high resistance" or simply the "DELAYED-RESISTANCE"

This creates a nice desirable amount of opening at the tab tip, which allows the user to easily insert his finger tip under the tab tip, and to get a good hold on it and to lift it further to finally crack and break the seal. This gap was called the tab tip finger gap.

The rest of the new solid curve shows practically a copy of the old dotted curve, but shifted horizontally to the right by that delay distance, or rather by the rotation angle, of 20-30 degrees.

To recap, it can be seen that the resisting forces here follow the new Curve in FIG. 89. In other words, the tab is lifted through approximately 20-30 degrees, against only a small resisting force F1, because the nose is not engaging the lid or the seal throughout all this travel/movement, because of the way the nose portion in FIGS. 23 through 29 has been shaped and bent out the way. The only resisting force is the force required to "bend" or "flex" the donut/plate, which is a relatively small force (F1), and is referred to as the "LOW-RESISTANCE", as explained above. So, the force-deflection curve would be low and very favorable.

This way, we bypass the area in the curve marked "Area 1". This area represents the "work", i.e. force times travel, which has been eliminated by shaping the pull-tab as shown. In turn, this allows the consumer to lift the tab tip to the more desirable position, without exerting a high force, so you don't need to break your fingernails.

Another Embodiment

Delayed Resistance Resulting from a Depression in the Lid

Figure 90:
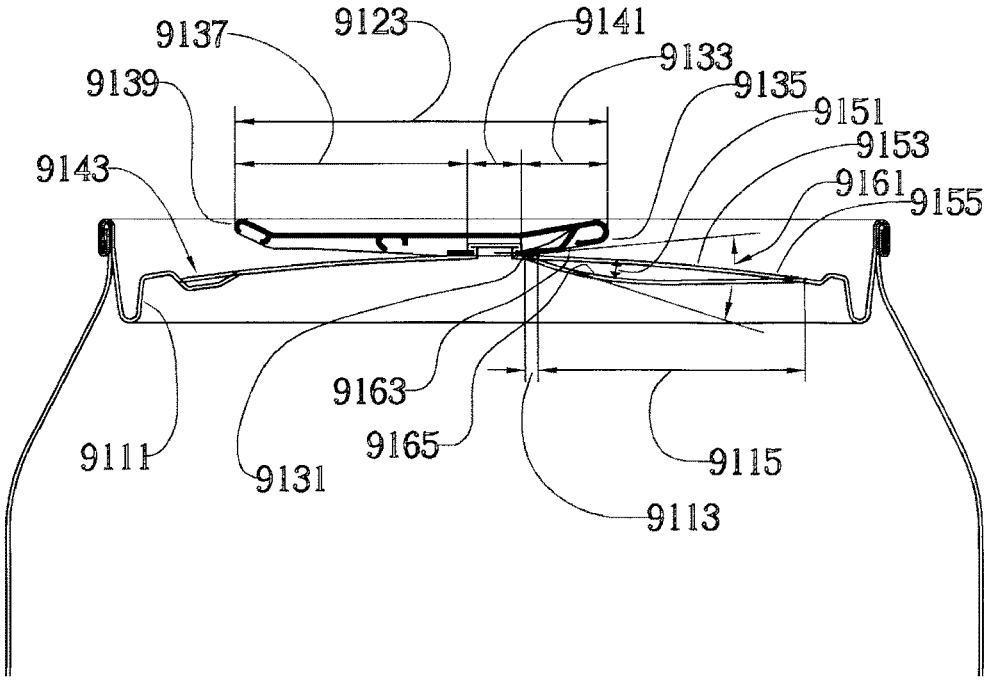
Figure 91:
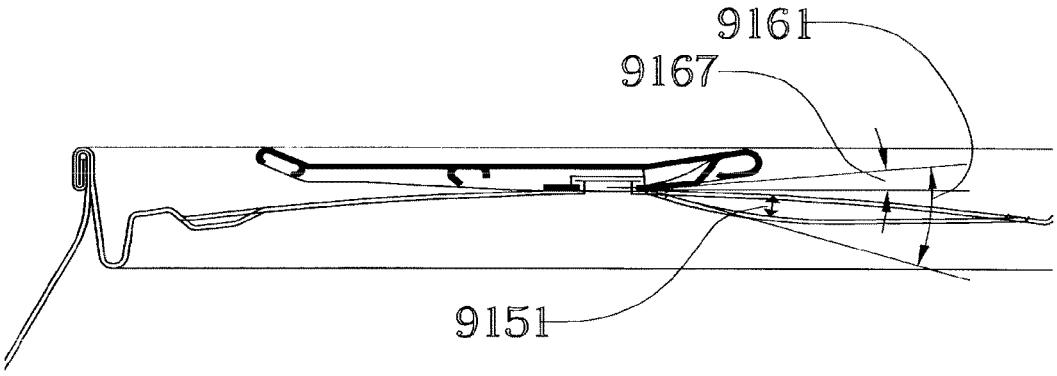
Figure 92:
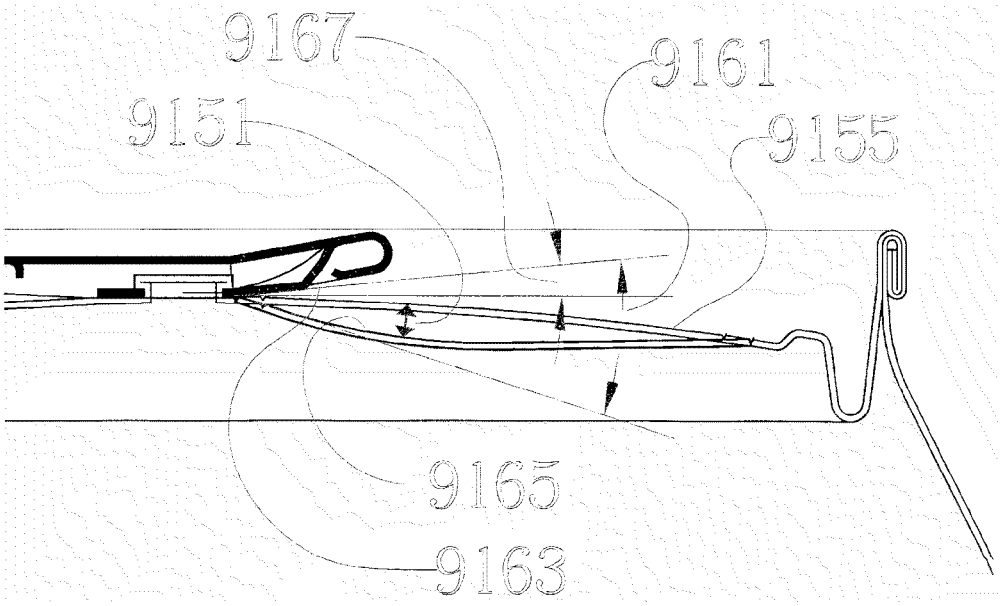

Summary:

I have also shown in FIGS. 90 through 96 another example of an embodiment according to the proposed method. FIG. 90 through 92 shows a pull-tab, that is shaped so that both the nose and the tab tip are raised. In addition, the seal area has been modified as well. The seal area has been depressed slightly, as shown. The end result is that, with the nose being raised, and the seal being depressed as shown in FIG. 92, we get a nice, sizable nose to seal gap. This results in that the tab tip can be raised quite high, before encountering the high resisting force, as seen in FIG. 93.

Details:

Note: The reference numerals in FIGS. 90 through 100 are identical for identical parts.

FIGS. 90 through 92 show a combination of a container lid 9111 and a pull tab opener 9123; said container lid comprising a frangible push-in closure 9115, which is at least partially severable from said container lid; said pull tab opener being pivotally secured to said container lid at a certain fixation point 9131 near said frangible push-in closure; said pull tab opener comprising a nose portion 9133 with a nose end 9135 and a tail portion 9137 with a tail end 9139, at least a portion of said nose portion overlying portions 9113 of the container lid 9111 and at least a portion of said frangible push-in closure 9115; said pull tab opener being pivotally secured to said container lid, at a portion on said pull tab opener which is between said nose portion and said tail portion, said portion being referred to as the pull tab pivot portion 9141, such that when the tail portion 9137 of the pull tab opener is lifted upwardly away from or above said container lid top surface 9143, then the pull tab opener is pivoted about said pull tab pivot portion 9141 and said nose portion 9113 of the pull tab opener is urged downwardly towards or against the underlying portions of said container lid 9113 and of said frangible push-in closure 9115.

All this is done in a way, such that at least the portions of the container lid 9113 and of the frangible push-in closure 9115, underlying the nose portion 9133 of the pull tab opener, are shaped so as to have a depression 9151 below the original surrounding general level 9153 of the container lid top surface 9155, said depression starting adjacent to said fixation point and extending towards and including a portion of the frangible push-in closure, creating a certain free space or a certain free clearance angle 9161 underneath the nose portion 9133 of the pull tab opener and above the underlying portions 9113 of the container lid and the frangible push-in closure 9115, said certain free clearance allowing the pull tab opener to pivot through a certain free clearance angle 9161 downwards, rotating or pivoting about the pull tab pivot portion 9141, before the bottom surface 9163 of the nose portion 9133 of the pull tab opener 9123 engages or touches the top surfaces 9165 of the underlying portions 9113 of the container lid and of the frangible push-in closure 9115, said certain free clearance angle being referred to as the free depression angle 9161.

Based on this construction, the process sequence of opening the container lid and breaking open said frangible push-in closure comprises at least two distinguishably individual and separate incremental process steps, which occur consecutively or sequentially, wherein the first incremental process step comprises the step of pivoting the pull tab opener 9123 through said free depression angle 9161, so as to move the nose portion 9133 of the pull tab opener downwards towards the frangible push-in closure 9115, traversing said certain free clearance and pivoting through said free depression angle 9161, until the bottom surface 9163 of the nose portion 9133 reaches and touches the top surface 9165 of the underlying depressed portions 9113 of the container lid and/or of the frangible push-in closure 9115, during which first step a first incremental force F1 is required to be applied or exerted on the pull tab opener, the magnitude of said first incremental force being equal to the force required to overcome only the elastic resistance of the pull tab pivot portion 9141 against being bent; and wherein the subsequent second incremental process step comprises the step of urging the nose portion 9133 of the pull tab opener 9123 to break open the frangible push-in closure 9115, during which second step a second incremental force F2 is required to be applied or exerted, in addition to the first incremental force F1, the magnitude of said second incremental force F2 being equal to the force required to break open the frangible push-in closure 9115, wherein said second incremental force F2 is larger than said first incremental force F1;

in other words, said depression 9151 in the selected areas of the container lid 9113 and of the frangible push-in closure 9115, underlying the nose portion 9133 of the pull tab opener 9123, which creates said certain free space or said certain free clearance 9151 between the bottom surface 9163 of the nose portion 9133 of the pull tab opener 9123 and the top surfaces 9165 of the underlying areas, resulting in said free depression angle 9161, creates and introduces a delay in the onset of the larger second incremental force F2 which is required to break open the frangible push-in closure 9115, thus making it easy to go through the first incremental process step, by applying only the smaller first incremental force F1 to the pull tab opener which is required to overcome only the elastic resistance of the pull tab pivot portion 9141 against being bent, before the need to apply the larger second incremental force F2 which is required to break open the frangible push-in closure 9115.

A variation of the above embodiment construction and design is to make the depression 9151 shaped so that it is in a semi-spherical shape, as if a part of a sphere has been pushed in and has deformed the respective portions of the container lid 9113 and of the frangible push-in closure 9115, as illustrated in FIGS. 90 through 92.

Another variation is to shape said depression 9151 as in FIG. 93-A, so that its cross-sectional side view would look almost like a straight line starting adjacent said fixation point 9131 on the container lid 9111, said straight line sloping downwards at a certain angle 9171, and extending for a distance 9173 approximately a slightly longer distance than the length of the nose portion 9133 of the pull tab opener 9123 and then flaring upwards to meet the original surface 9153/9155 of the rest of the container lid 9111, with the intersection lines between the surfaces of the depression and of the container lid being filleted or rounded off.

Yet another approach, shown in FIG. 93-B, is to make the straight line shorter, so that the depression profile conforms to and matches more accurately the bottom shape of the nose portion. Here the first straight line portion 9177 matches the bottom surface of the nose portion up to the "pinch point" 9181 of the nose portion 9133, with a slope angle 9175, then the depression profile starts to taper upwards for a distance 9179, until the farthest contact point of the nose portion, and then finally it starts to flare upwards to meet the rest of the lid surfaces 9153/9155.

The nose portion of this pull tab opener is similar to the one shown as #7 in FIG. 31-A. Also any of the other shapes shown in FIG. 31-A as well as in FIG. 30 can be used with the embodiments described in this section.

Figure 94:
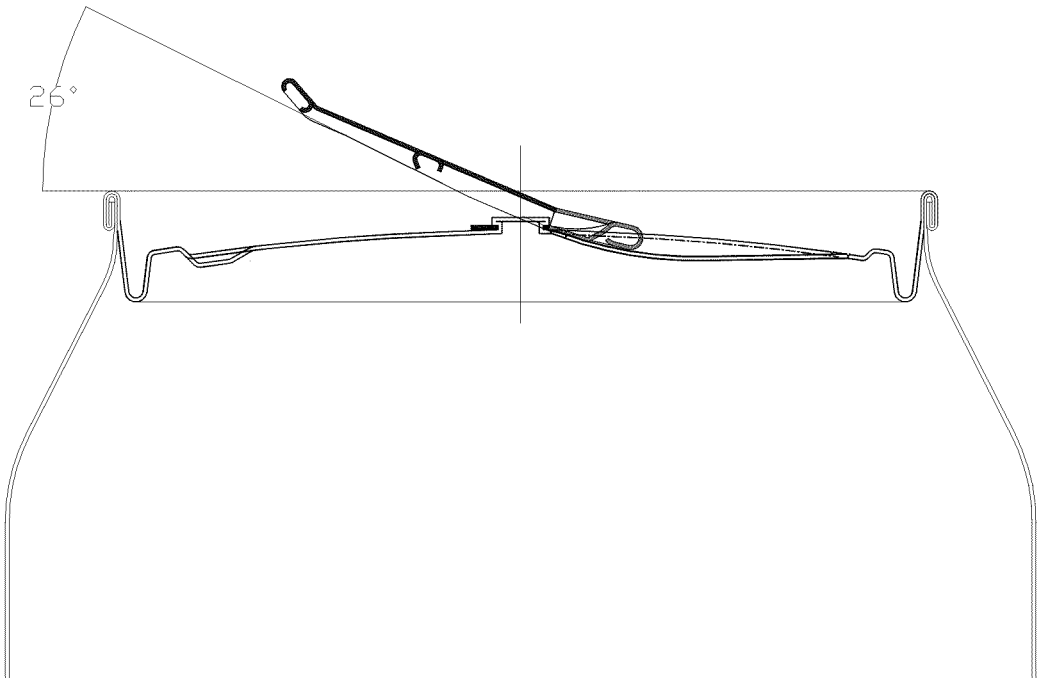
Figure 95:
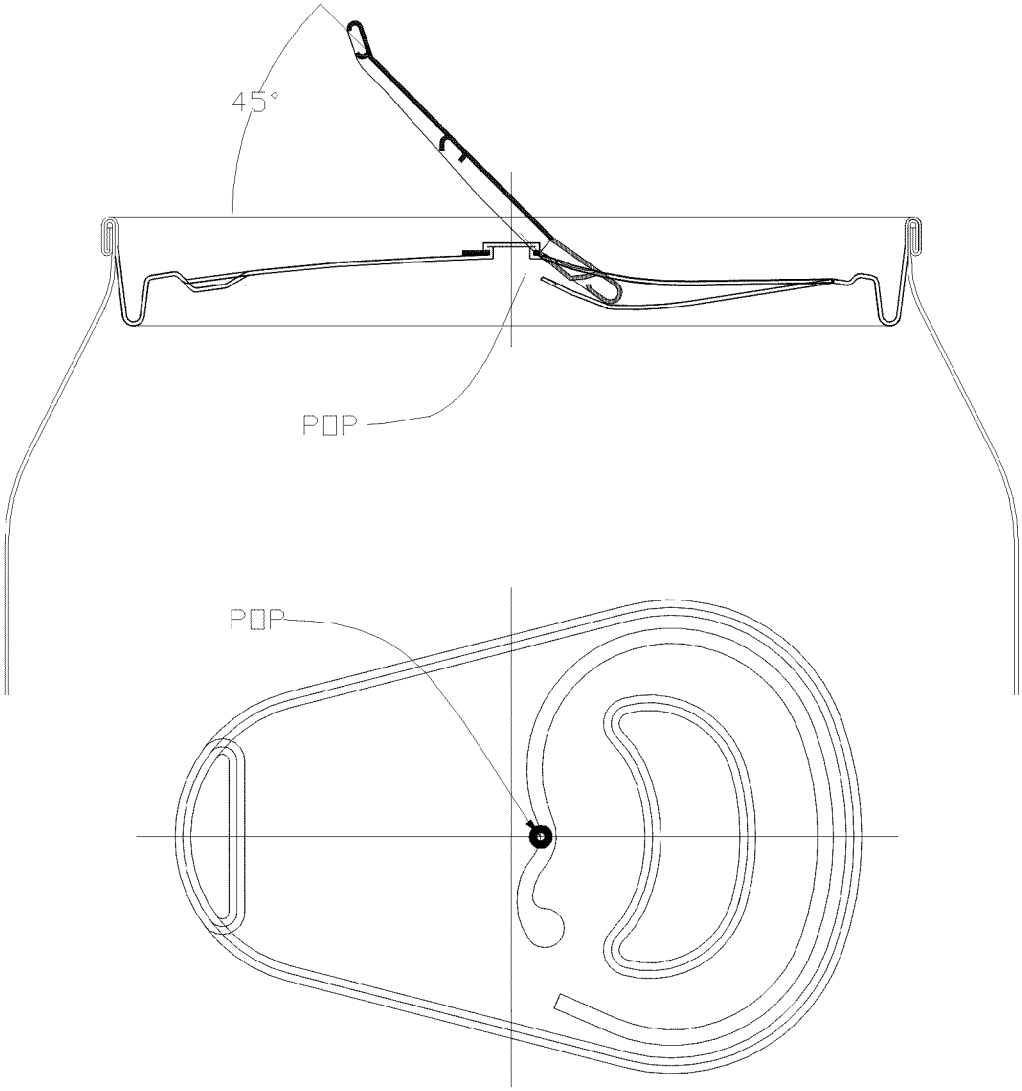
Figure 96:
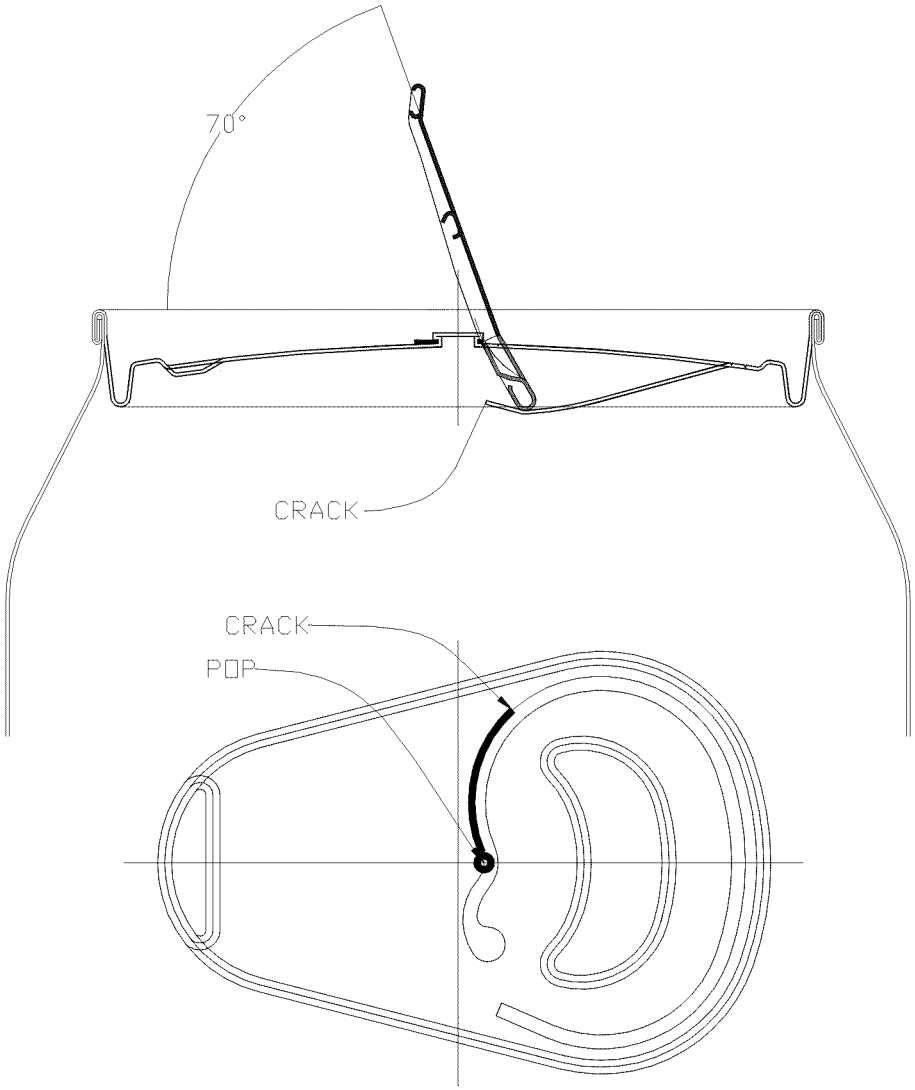

FIGS. 94 through 96 show subsequent steps of the process of opening a can. They are comparable to those shown in FIGS. 84 and 85, where the pull tab opener reaches the seal and pops it and cracks it, etc.

The rest of the opening sequence follows a similar routine. The big difference is that now with the present invention, the large force F2 is delayed, so that the user will need to overcome ONLY the smaller force F1 to start the can opening process.

FIGS. 97 through 100 show a number of alternative options, as to the shape of the pull tab opener and its end portions, and how these options, together with the size of the "depression", can be combined to get the trade-offs or compromises between them, to end up with the desired end goal, of making the can opening process more "user friendly". These options are applicable to the embodiments shown in FIGS. 90 through 96, which have the "depression" underneath the nose portion of the opener. But they are also applicable to any "standard" shape of lids, as well as in any of the other embodiments shown and seen in the different figures of the present specification.

Figure 100:
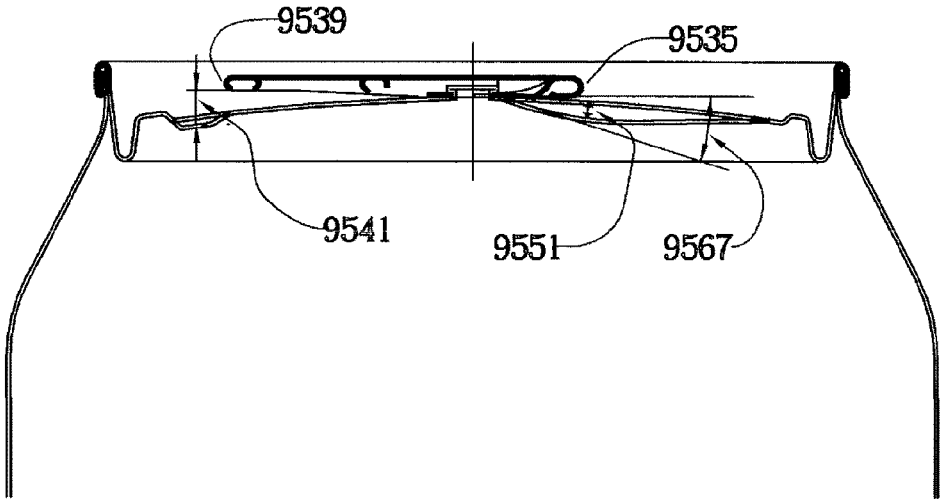
Figure 103:
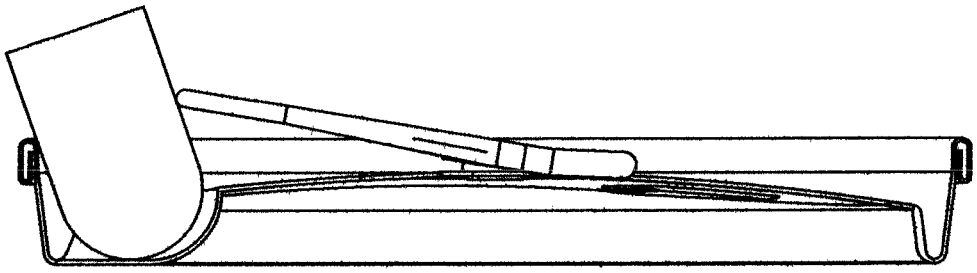
Figure 104:
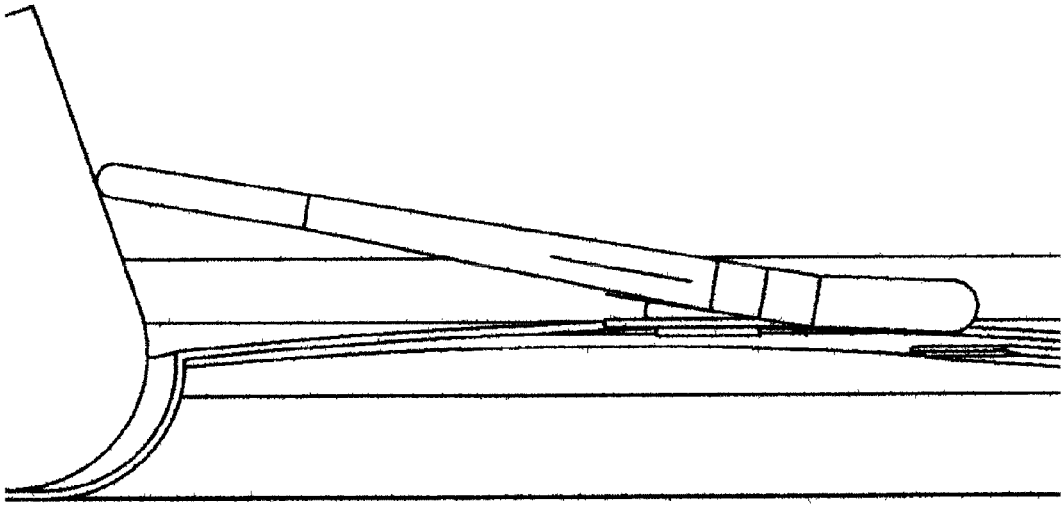
Figure 105:
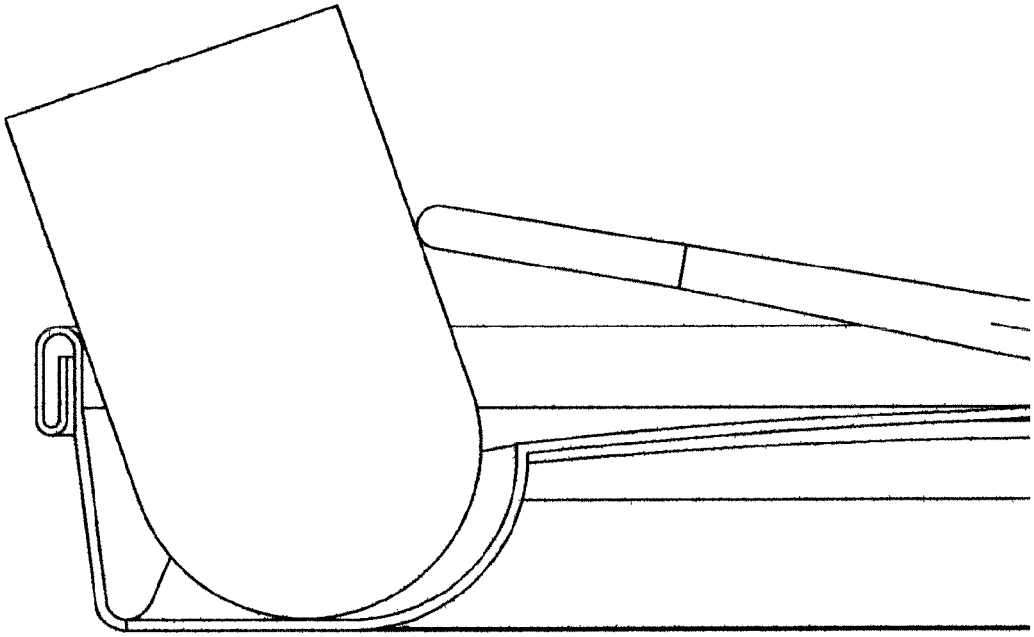
Figure 106:
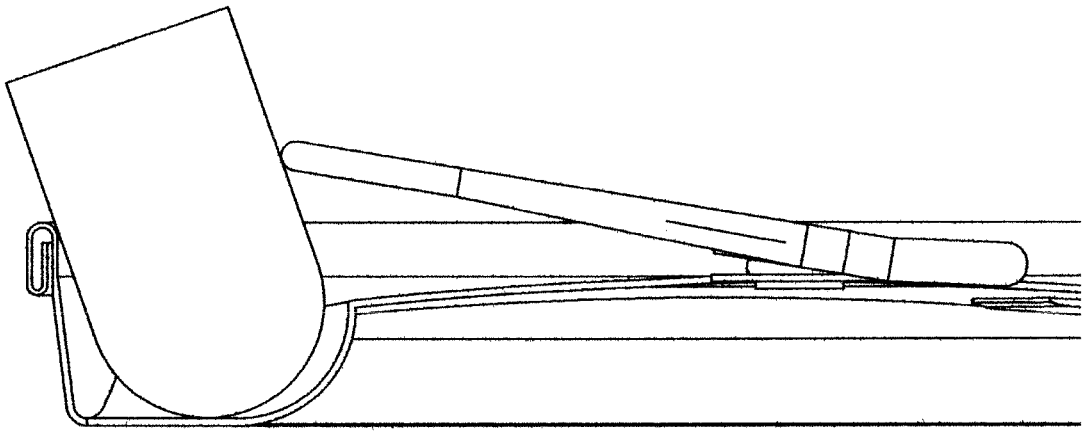
Figure 107:
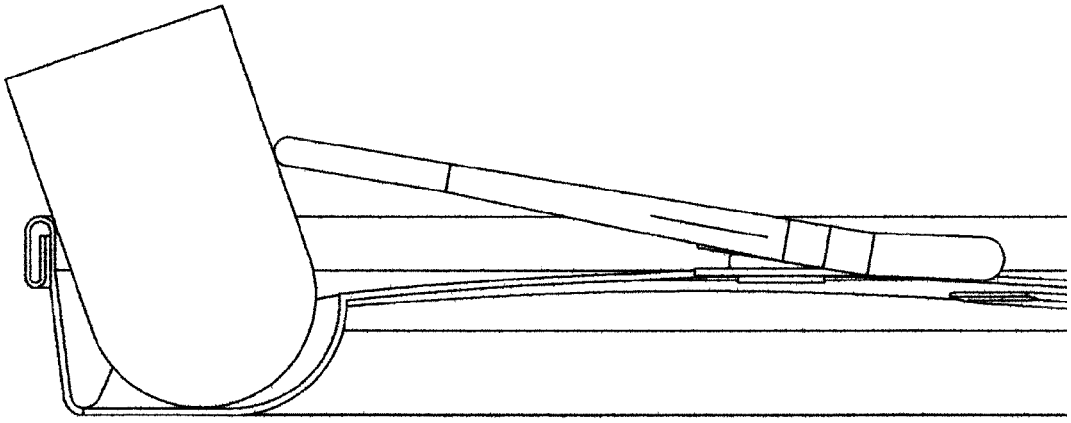
Figure 108:
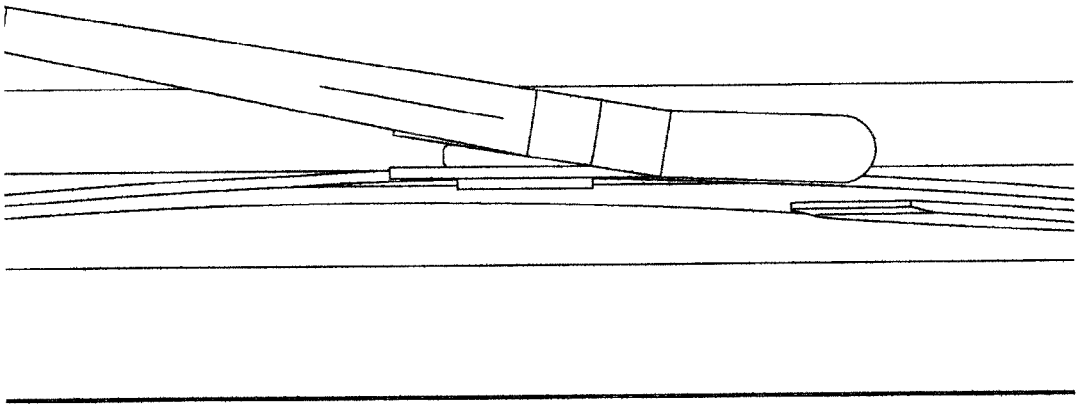
Figure 109:
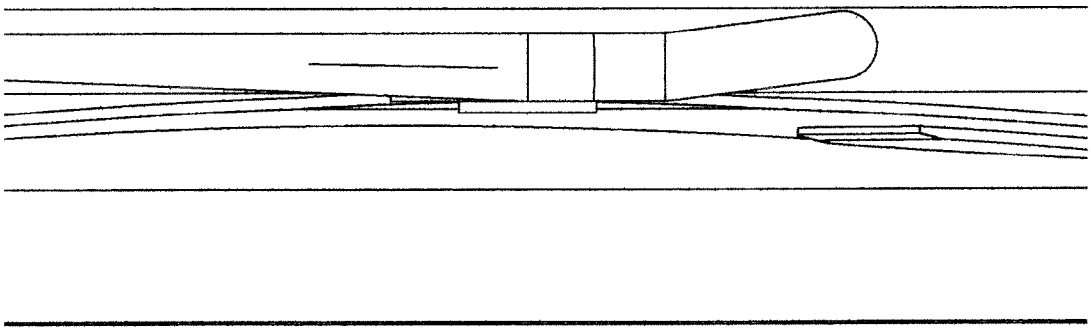
Figure 113:
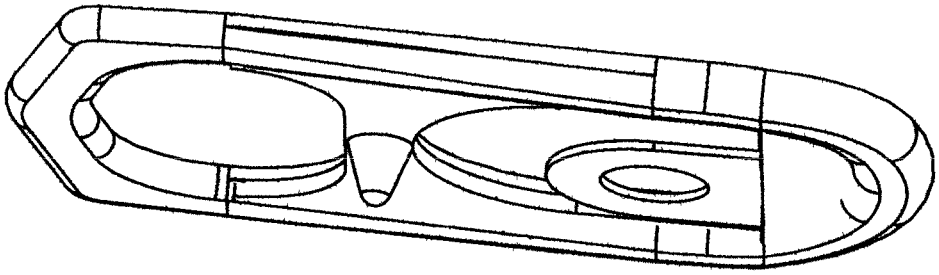
Figure 114:
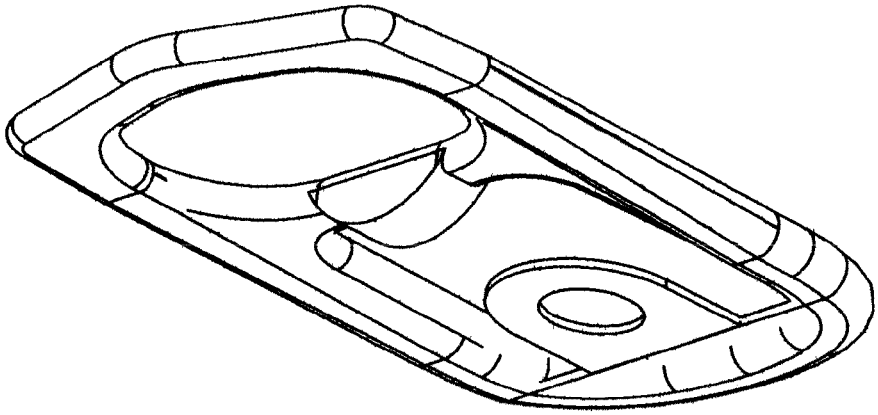
Figure 115:
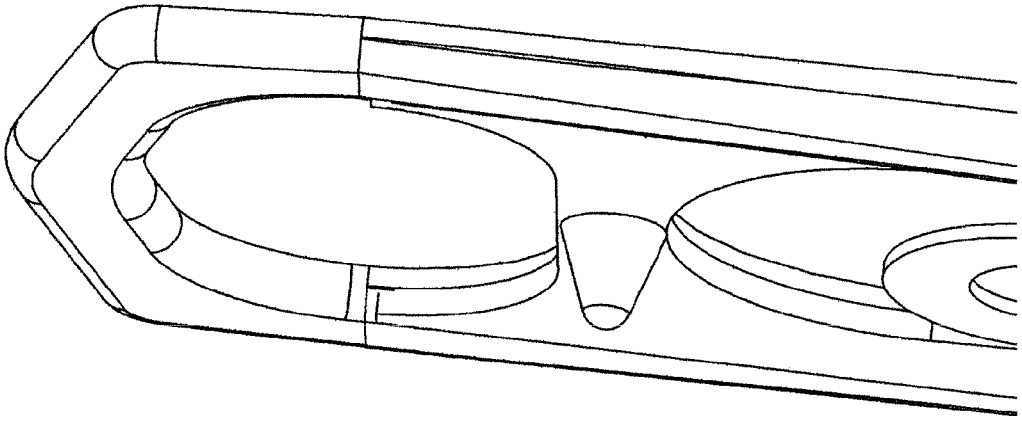
Figure 116:
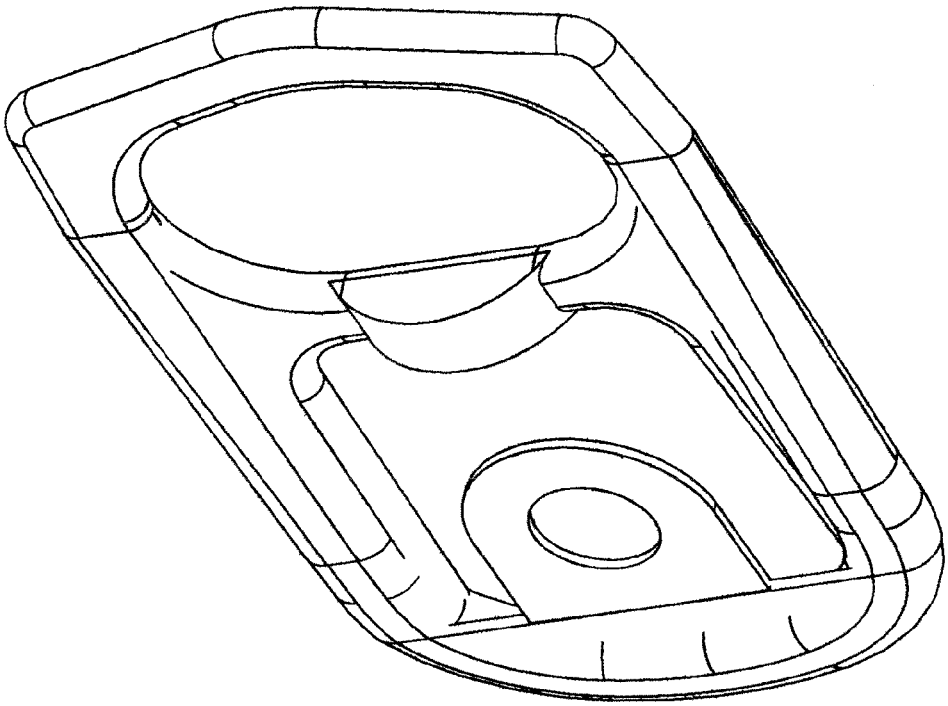
Figure 117:
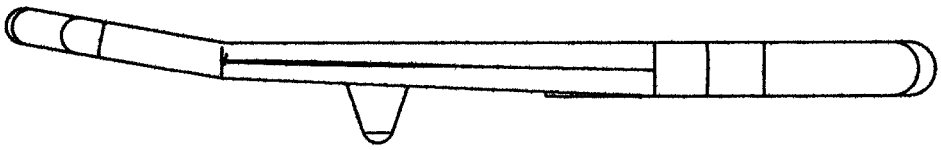

FIG. 100 shows a pull tab opener, which is similar to most standard conventional prior art openers. Both the nose portion and the lifter tip are "horizontal" or in line with the main body of the opener. In this case, the "depression" 9551 is the only feature that will result in the "delayed onset" of the high force F2, providing an angle travel 9567 of "low resistance rotation" of the opener, during which rotation only the small force F1 is resisting the rotation. The gap 9541 is usually very small, and does not contribute much towards improving the effect of the "low resistance rotation 9567.

Figure 99:
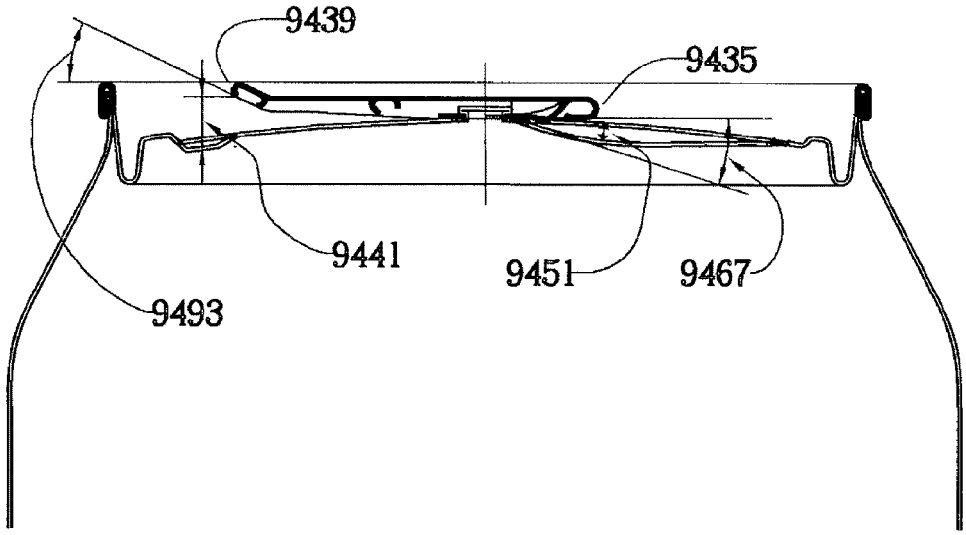

FIG. 99 shows a similar embodiment as in FIG. 100, except that ONLY the lifter tip of the opener has been shaped to have a large gap 9441 under it, between it and the underlying finger well, larger than the gap 9541 in FIG. 100.

This larger gap 9441 can accomplish one or both of the two following things. One: For a same size free rotation angle 9467, similar in size as the angle 9567 in FIG. 100, we would get a larger gap under the lifter tip, hence more room for the user to insert his finger tip under the lifter and to open the can. Two: If we want to obtain a gap, similar in size to the gap that would be obtained in the embodiment in FIG. 100, then the "depression" 9451 in FIG. 99 can be smaller than the depression 9551 in FIG. 100.

It then becomes a matter of trade-off between these two features of any embodiment, to obtain the same, similar end result. The can manufacturer or designer would have more leeway and freedom to choose the size of these two features, to obtain a maximum benefit for the end user, taking into consideration any other issues related to the manufacturing processes or the like.

Figure 98:
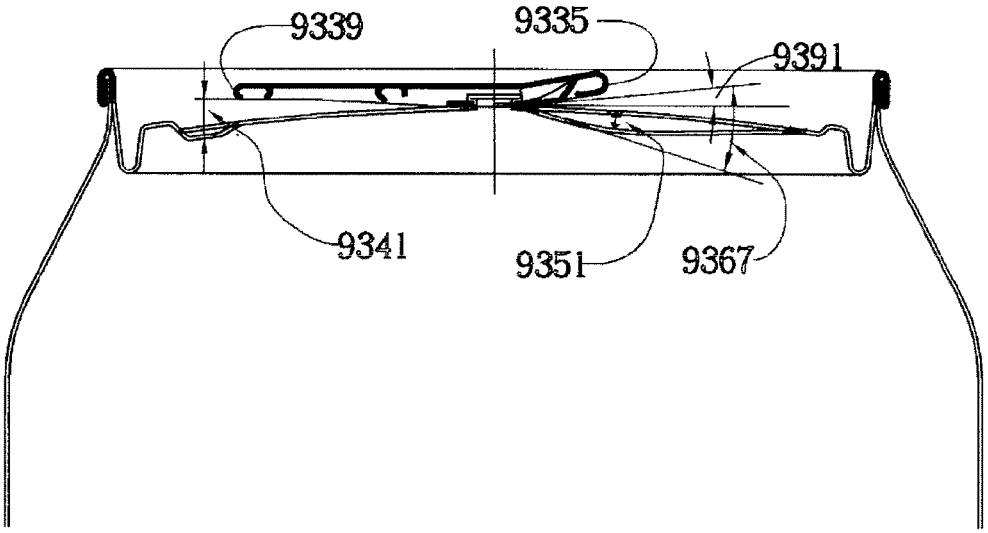

FIG. 98 shows the opener with ONLY the nose portion elevated by an angle 9391 above the horizontal/main body of the opener. This provides a larger total rotation angle of the opener "under low resistance", larger than in the case of FIG. 100 or FIG. 99. The low resistance rotation of the opener in this case is the larger total angle 9367, which is larger than the angle 9567 in FIG. 100 or the angle 9467 in FIG. 99.

Figure 97:
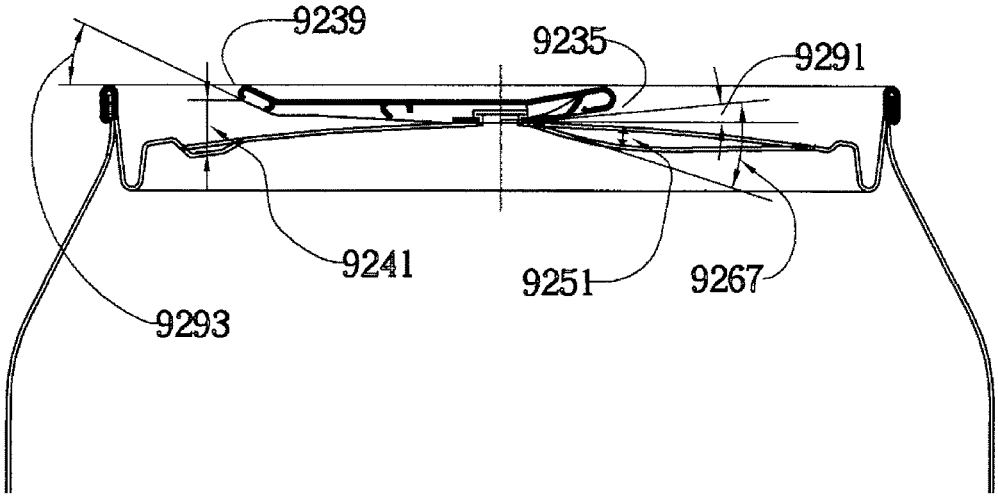

FIG. 97 shows the opener with BOTH nose portion 9233, as well as the lifter tip 9239, shaped in the most favorable shape. The angle 9291 of the nose portion above the horizontal, i.e. the main body level of the opener, will increase the size of the total rotation angle under low resistance to end up being the large angle 9267, which is larger than the angle 9567 in FIG. 100 or the angle 9467 in FIG. 99. In addition, the lifter tip 9239 is bent upwards at an angle 9293 above the horizontal as well. This configuration increases the gap 9241 between the lifter tip and the finger well underneath it. This gap 9241 is larger than the gap 9541 in FIG. 100 and the gap 9341 in FIG. 98.

This combination/embodiment in FIG. 97 is similar to the one shown in FIGS. 90 through 96. It gives the most flexibility to the designer and manufacturer of the can, the lid and the tab, to choose the most favorable combination and selection of the sizes of these features to accomplish the end goal of making the pull tab more "user friendly".

FIGS. 81 and 82 show another feature that can help in making the pull tab opener more user friendly, namely the considerably deeper finger wells. The finger well in FIG. 81 looks like a part of a spherical depression into the can lid. The finger well in FIG. 82 looks like a bullet nose partially pushed in the can lid. It is preferably more like an elongated cylindrical depression partially embedded in the can lid, with a tapered or blunt/rounded end pointing towards the center of the can lid and the wider diameter towards the edge of the can lid.

Any of the finger wells shown in FIG. 81 or 82 can be combined with the features shown in FIGS. 97 through 100, to get yet a bigger advantage in facilitating the can opening process.

Thus I have demonstrated that by shaping the pull tab, and/or the lid and the seal, in a certain way, we provide a predefined clearance between the nose and the seal, so that the tab lifter and the tab lifter tip will be able to move upward only against the low tab flexing resistance F1, before encountering the considerably higher seal breaking forces. This will create a favorable "tab tip finger gap", allowing the user to easily apply his fingertip to the tab tip to move the lifter to open the seal. All this in spite of the fact that all the forces required to break the seal F2 are considerably larger than the tab flexing resistance F1, requiring the user to apply a considerably larger force at the tab tip during the seal breaking process than the force required to oppose the tab flexing resistance.

So, again, by shaping the pull-tab, and/or the lid and/or the seal, as per our proposed method, we have overcome and solved the problem of breaking the fingernails when attempting to open such containers. In other words, we have made the pull tab/lid combination more user friendly.

More Embodiments/Variations

FIGS. 101 through 109 show an example of arrangements, utilizing the finger wells similar to the ones shown in FIGS. 81 and 82. The round nose cylinder shown in these figures represents the user finger tip. It is shown inserted in the finger well, underneath the lifter tip of the pull tab opener.

Such finger wells will also give more flexibility to the designer or manufacturer to optimize the selection of each one of the available features, to make the pull tab opener more user friendly.

Also the finger wells shown in FIGS. 11 through 17 and FIG. 20 and FIG. 21 can all be used with any of the embodiments shown in this section.

FIG. 101, show that when the lifter is in the down position, an object simulating the fingertip does not have enough room to get in. But, by raising the tab tip according to the proposed methods, the object can be inserted properly.

The figures also show the advantage of the deep recess suggested elsewhere here in the specification.

Embodiment Group 4

Reduced Resistance to Starting the Pull Using the "Rotate-Pull" Method

Figure 32:
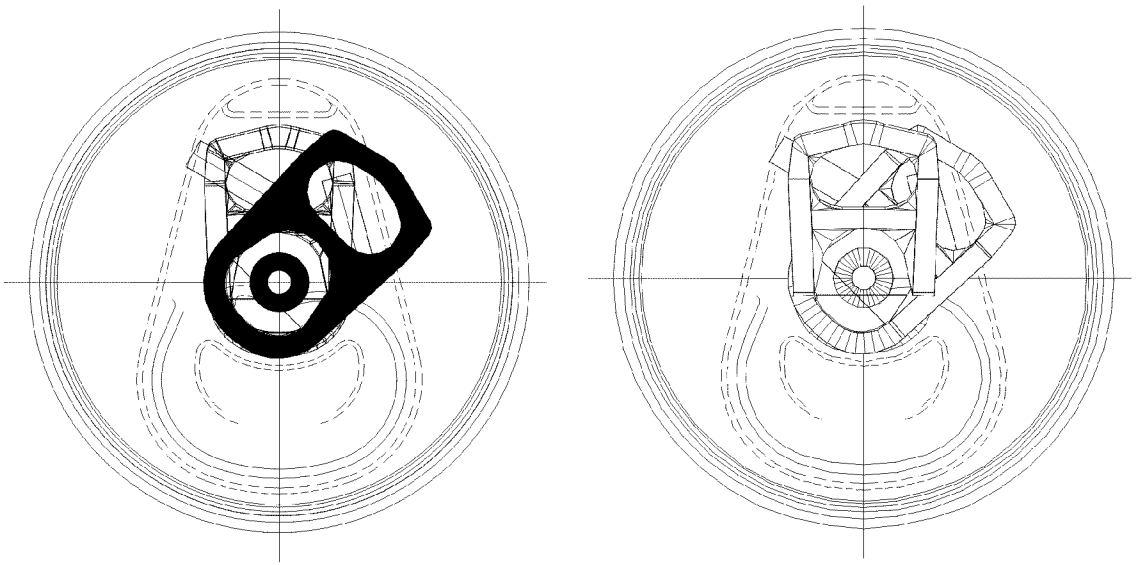
FIG. 32 shows the top views of the can lid with the pull tab in two superimposed positions, one at one end of the horizontal rotation and the other at the other end of the rotation. The rotation can be provided to be either clockwise or counter-clockwise or in both directions.
Figure 33:
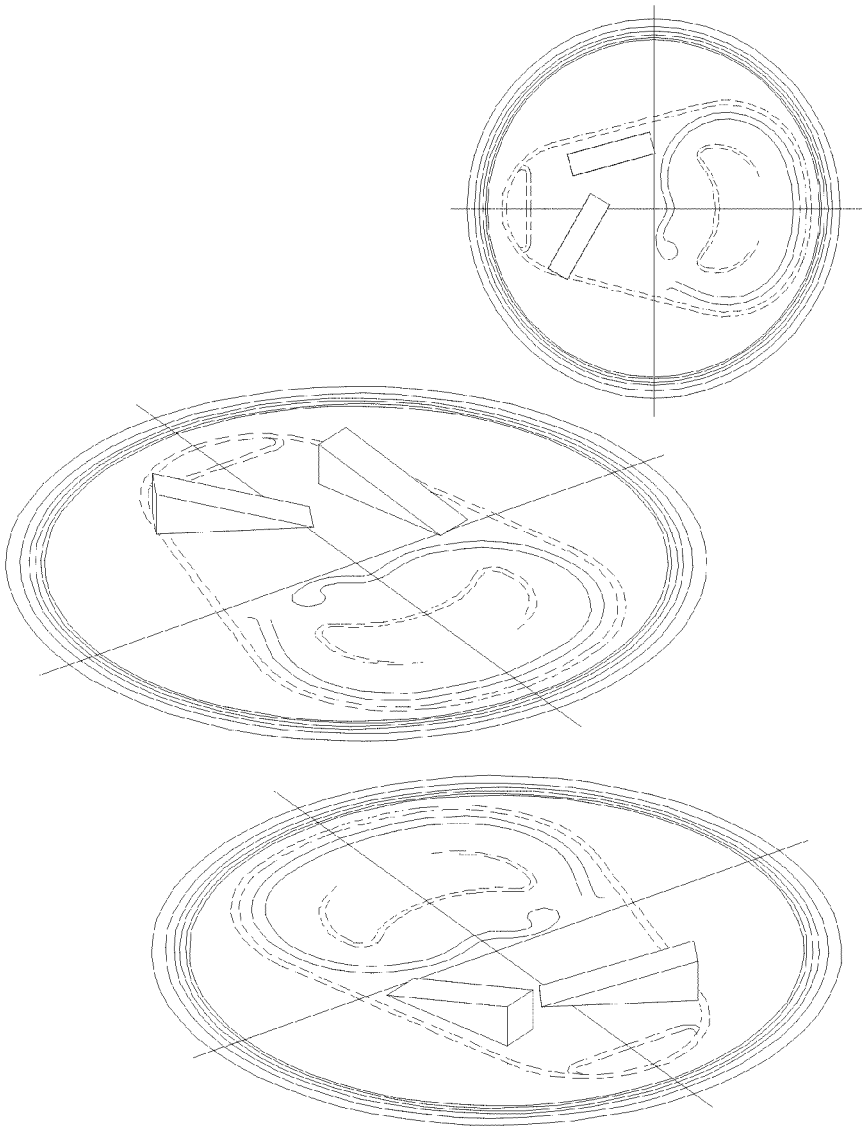
FIG. 33 shows the lid of a typical can, with two cams for the purpose of elevating the lifter end of the pull tab during the horizontal rotation described above.
Figure 34:
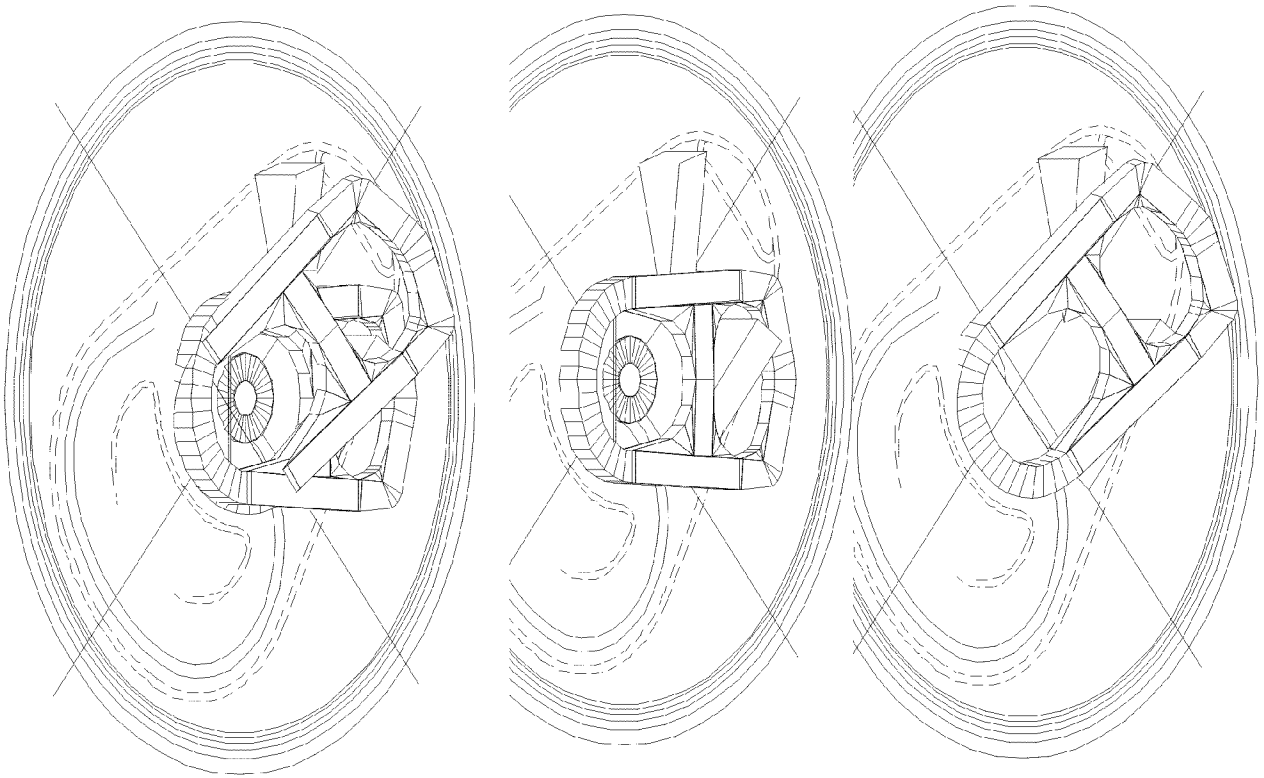
FIGS. 34 through 45 show a lid like the one shown in FIG. 33, together with the pull tab, from various vantage points, to make sure that the concept is understood. The pull tab is flat and similar to the conventional prior art kind of pull tabs. Each figure shows three views from the same vantage point. One view shows the pull tab in its "rest" position, practically parallel to the lid top surface and not raised by the cams. Another view shows the pull tab after it has been rotated horizontally and has "climbed" up the ramp of the cams and is sitting at its highest elevated position. And the final view shows the two previous views superimposed one over the other.
Figure 35:
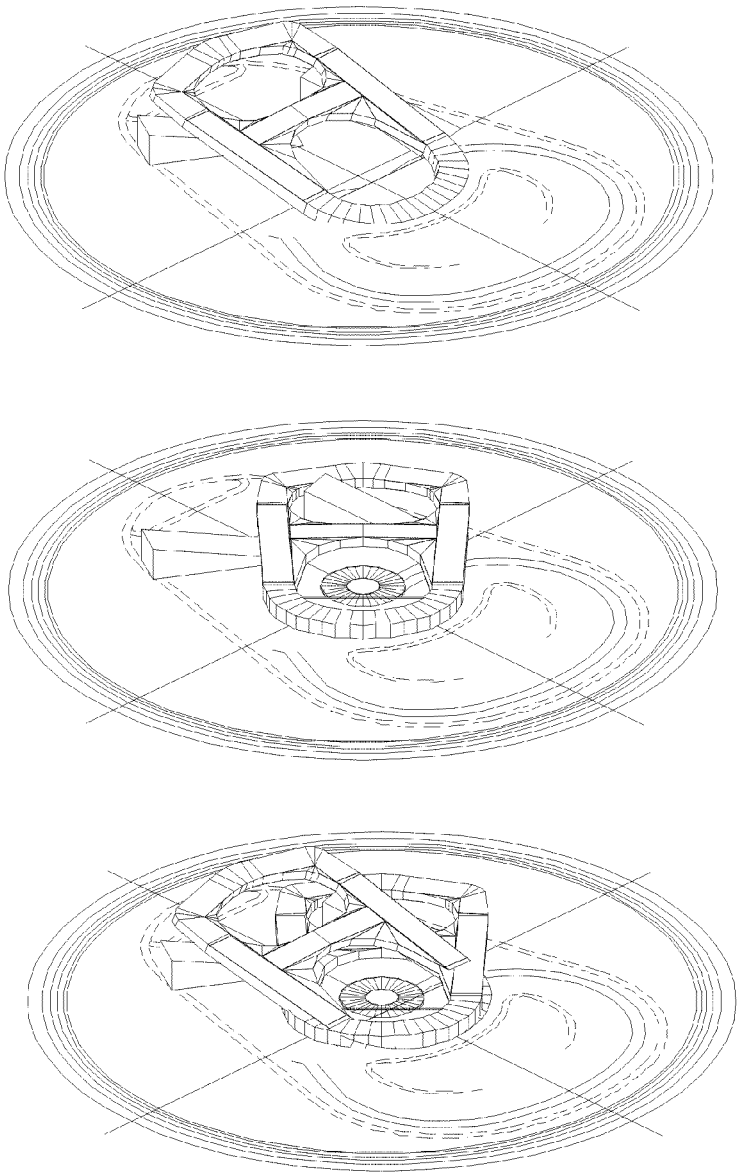
Figure 36:
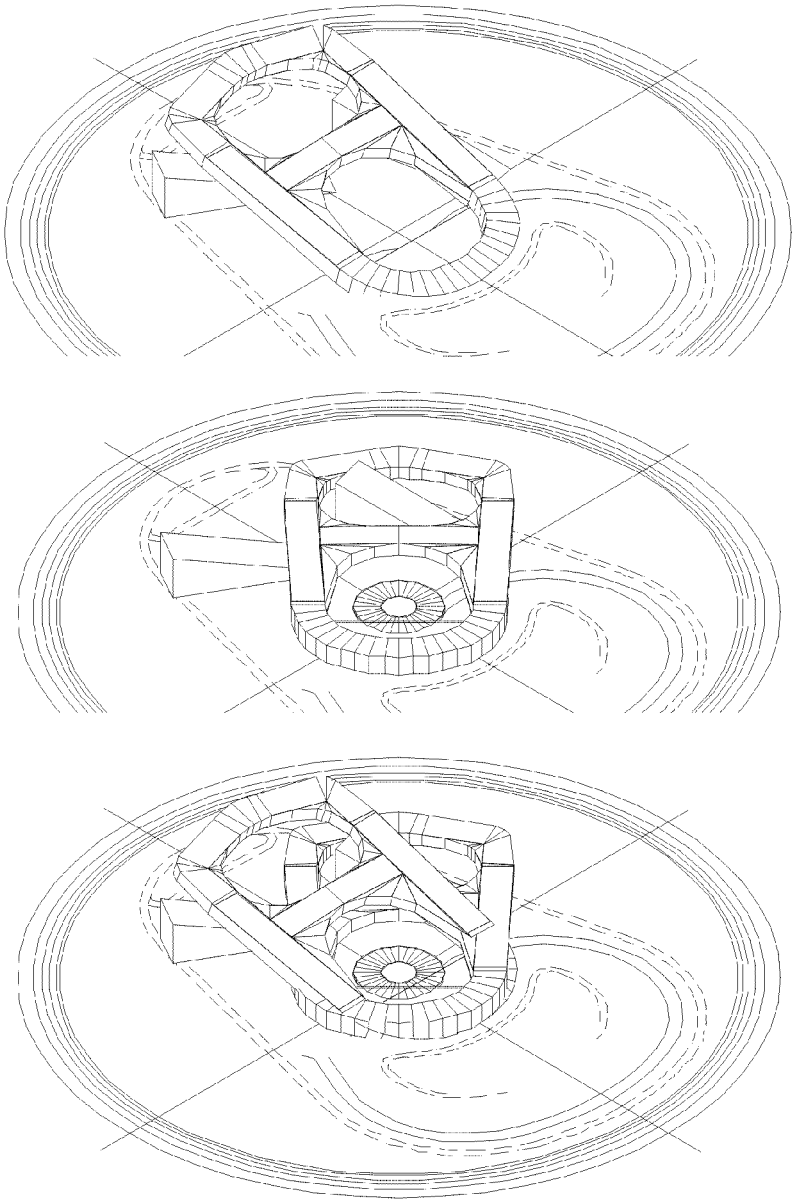
Figure 37:
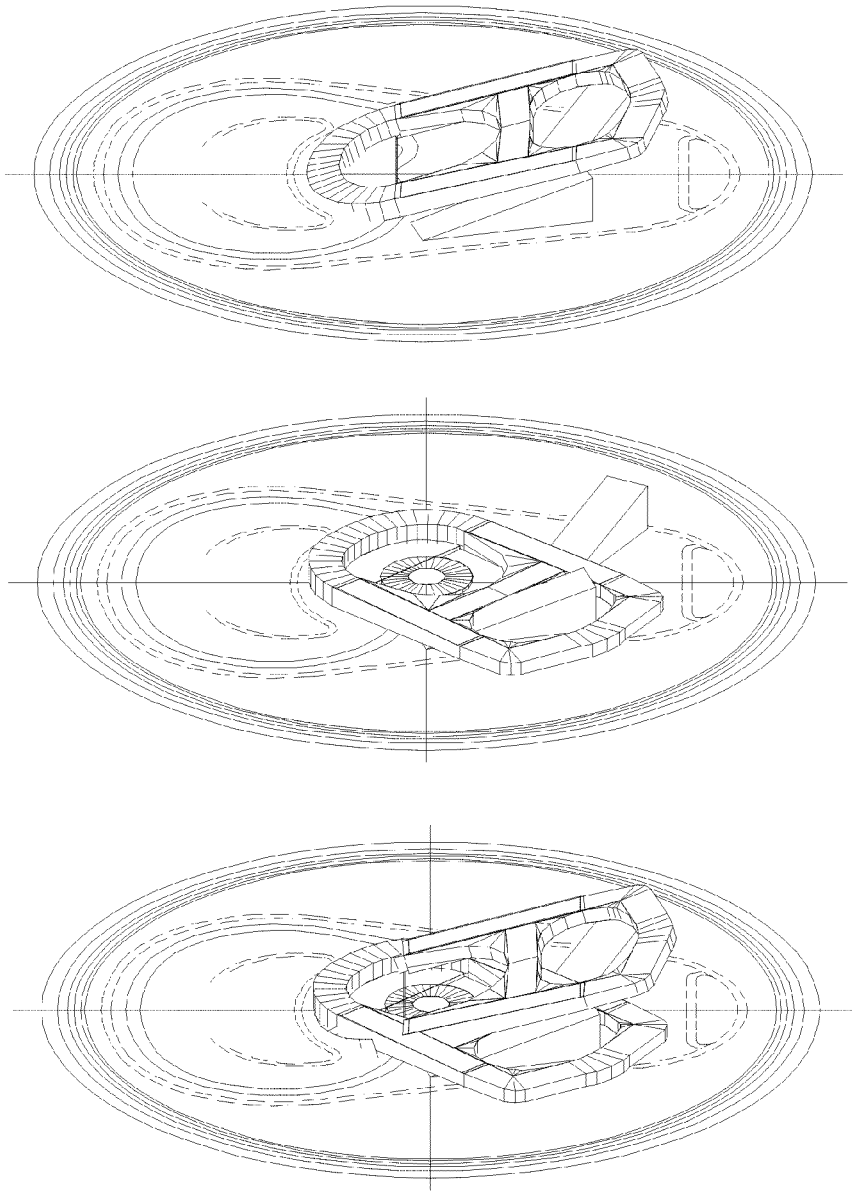
Figure 38:
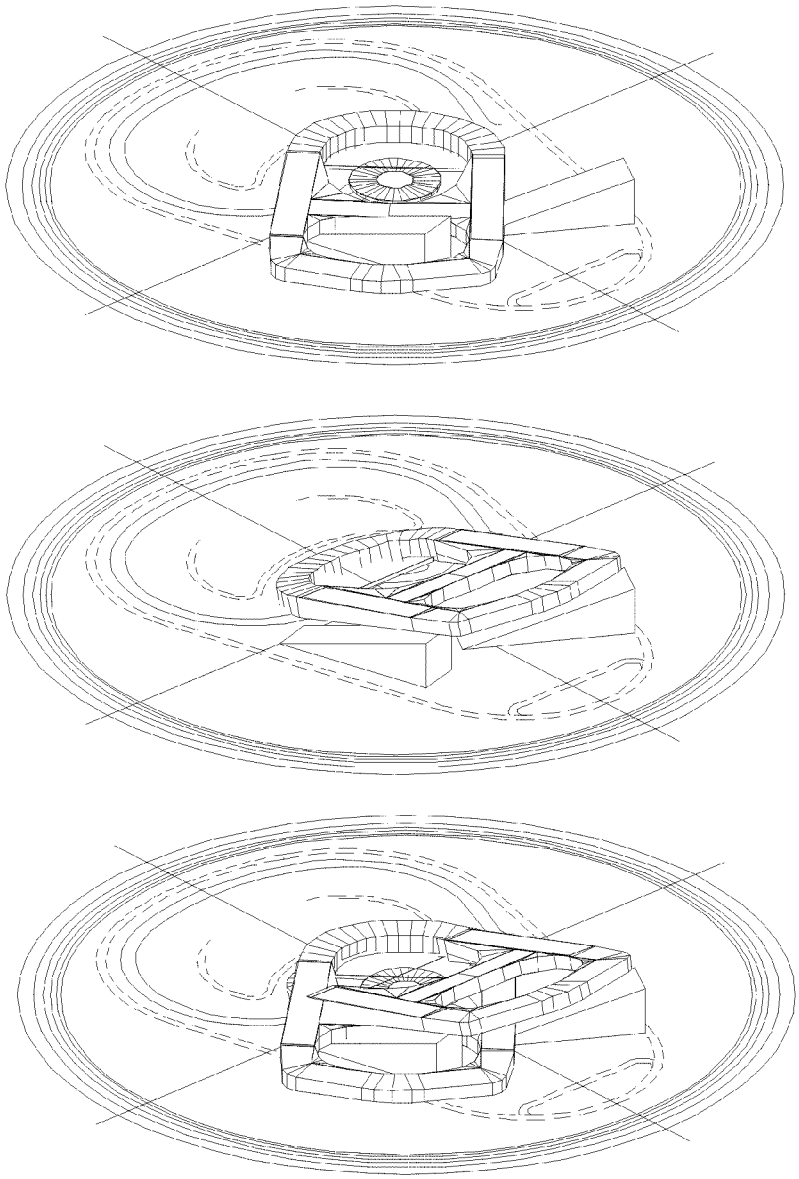
Figure 39:
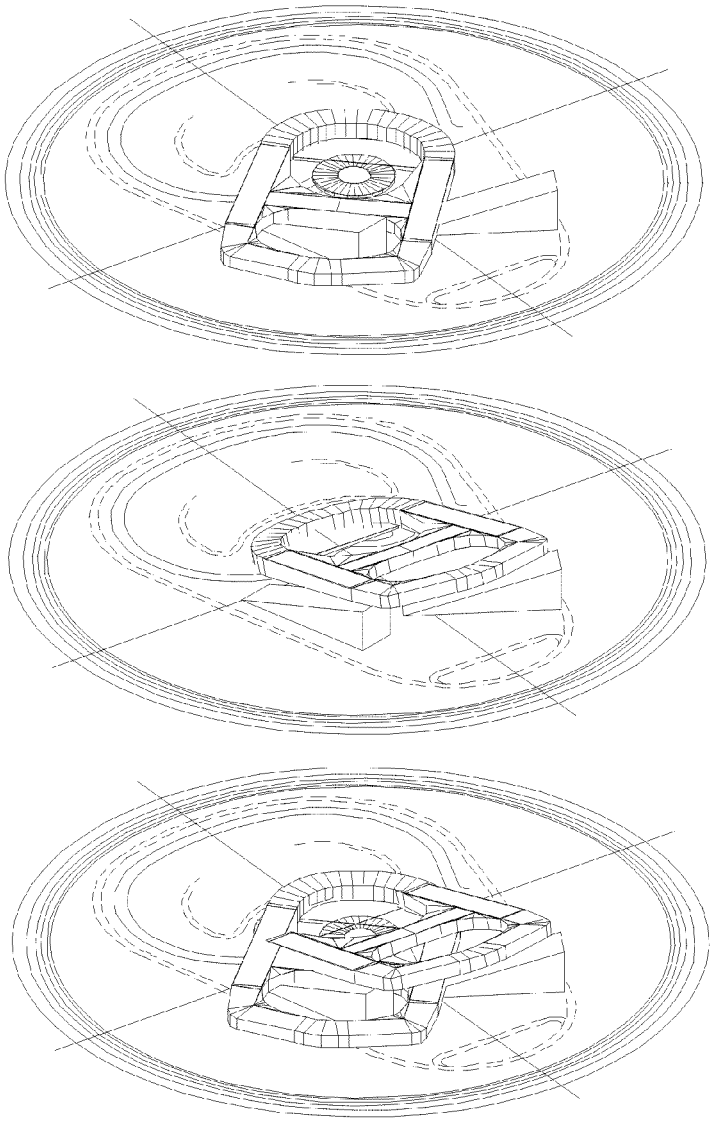
Figure 40:
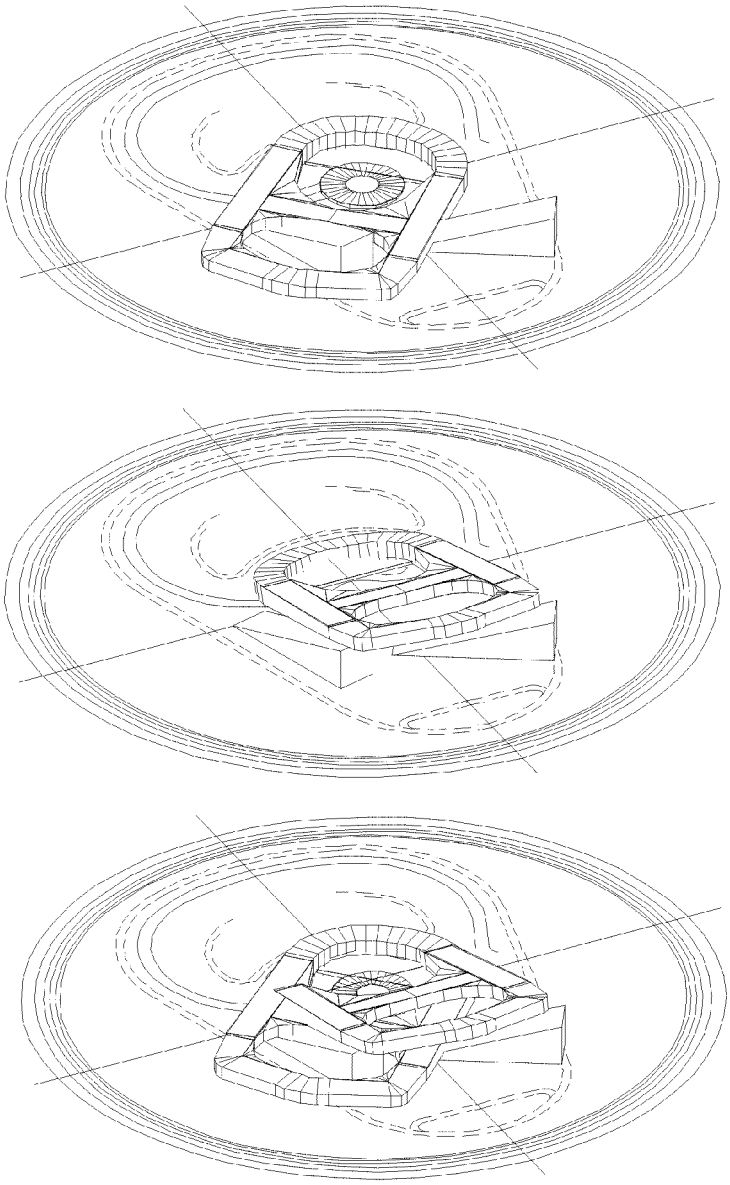
Figure 41:
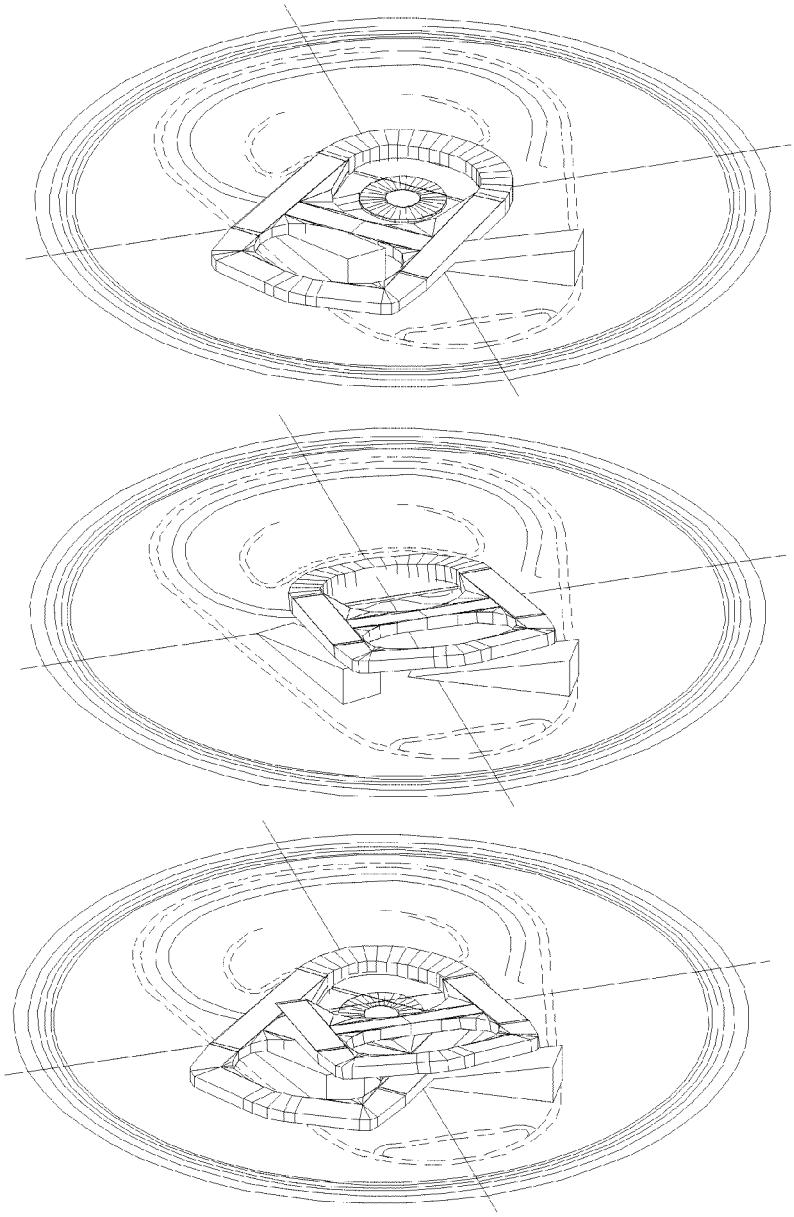
Figure 42:
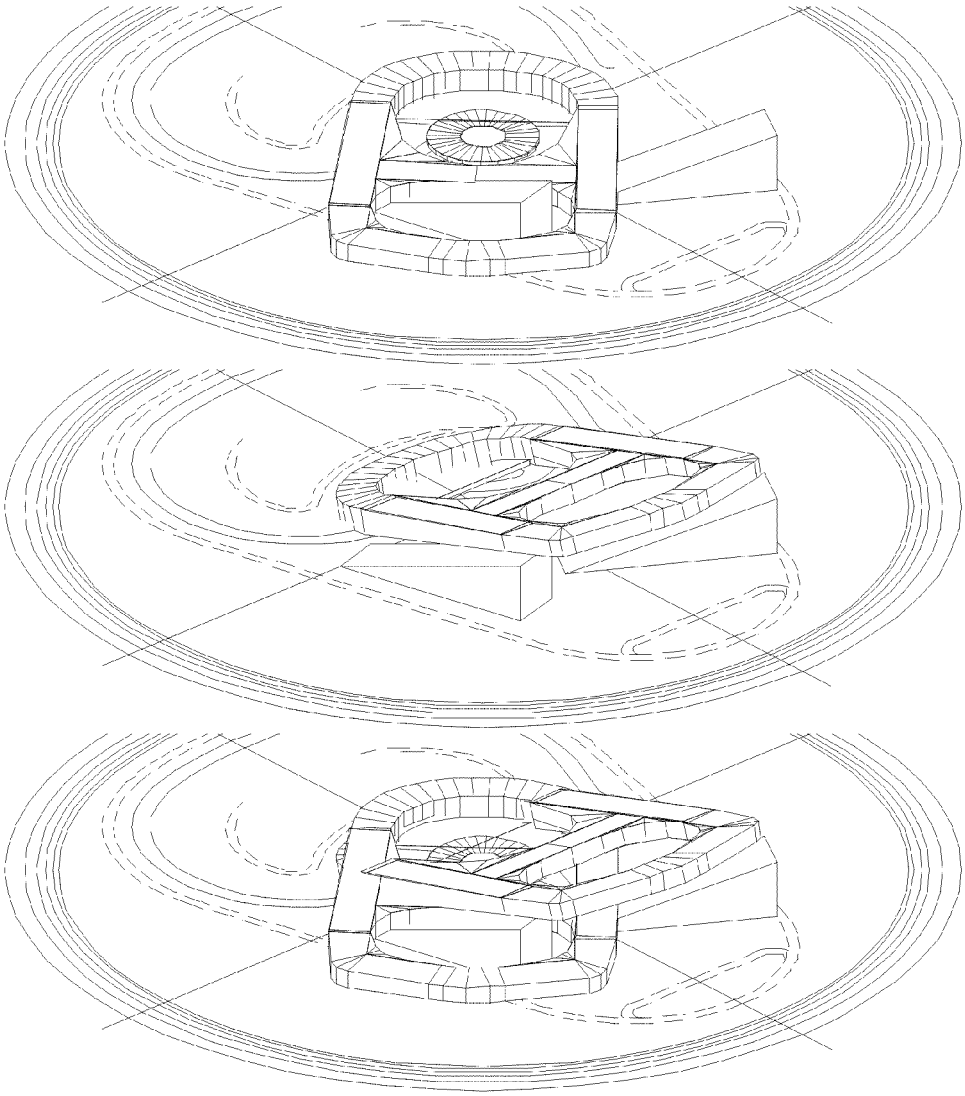
Figure 43:
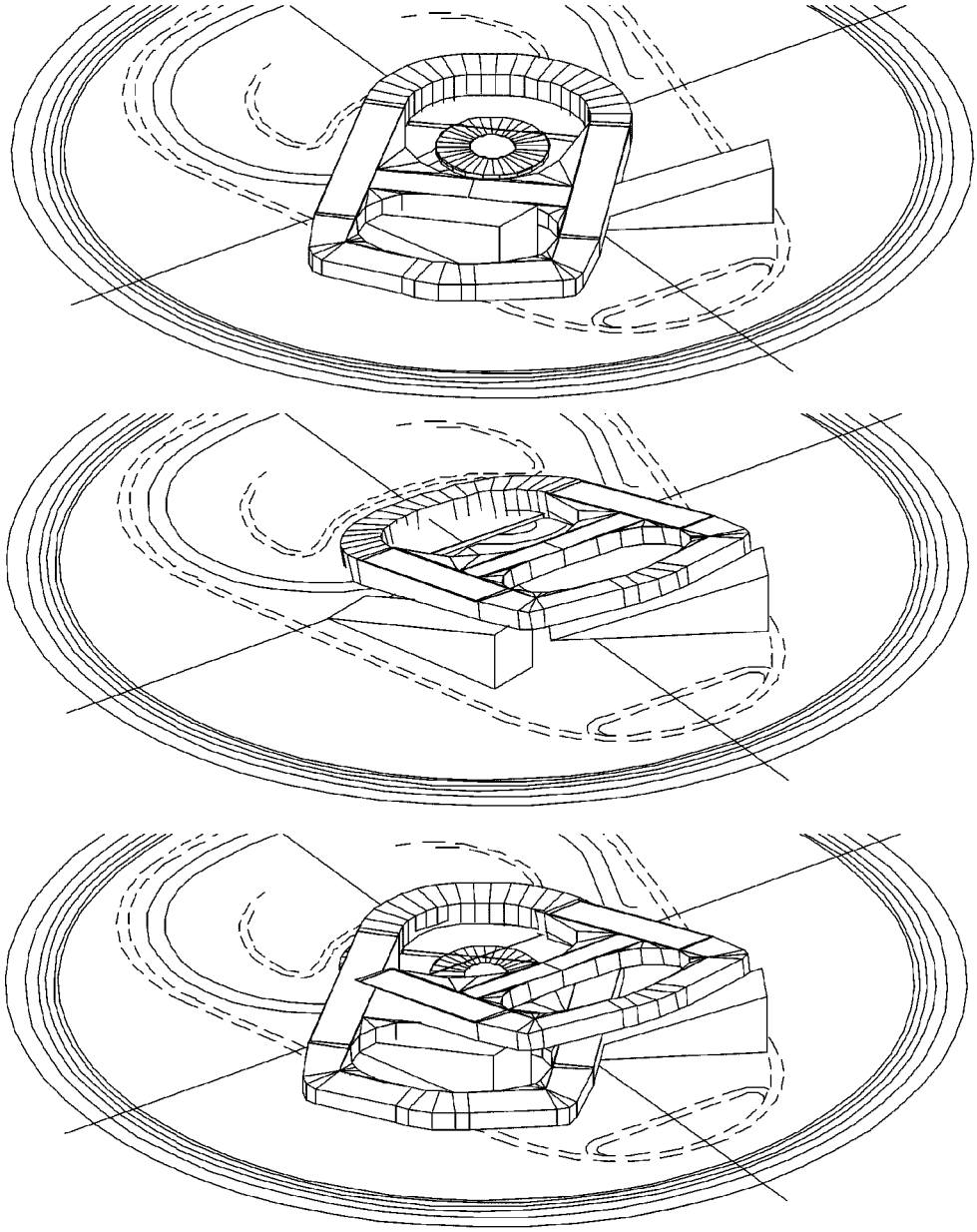
Figure 44:
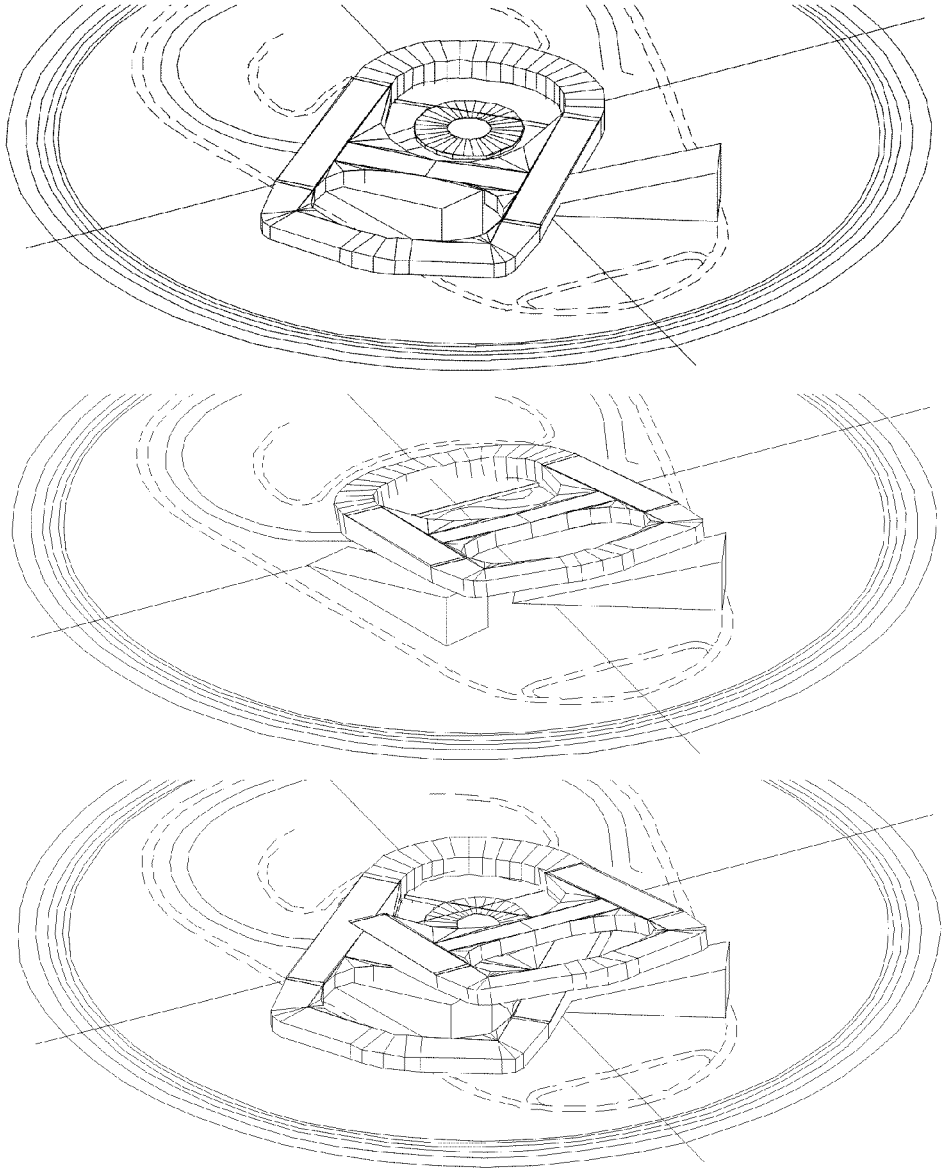
Figure 45:
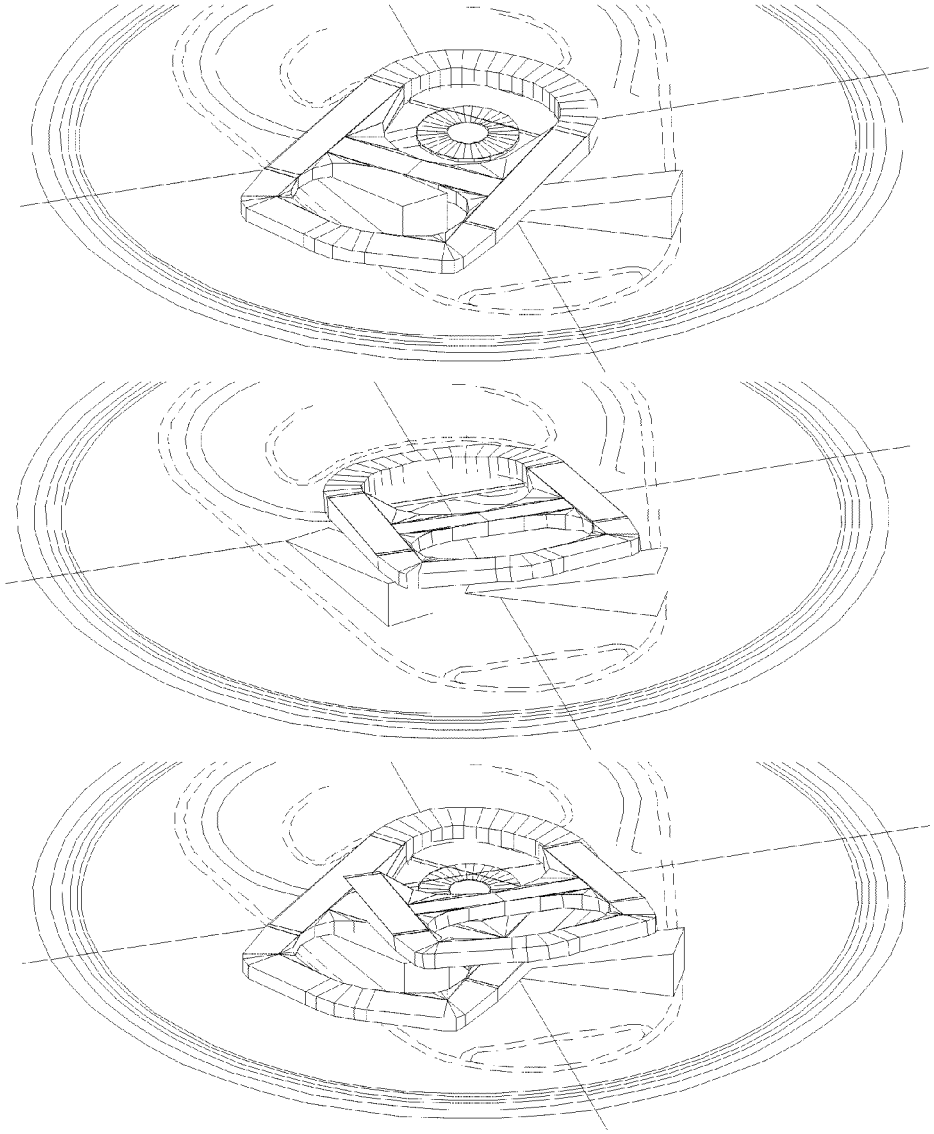

The figures in this group will be numbered FIG. 32, FIG. 33 etc., similar to the grouping numbering system mentioned earlier. These are the numberings of the PPA, Ref 1. They start at sheet #PT-D-32. They will show the method of accomplish these embodiments.

In addition, I have included some new drawings, showing the concept of using a trough or well. They are FIGS. 110 through 117.

FIG. 110-A shows a pull tab having a tab dimple, which would act as a "cam follower", and which will ride on the cam surface of the lid well or trough shown in the cross-section view in FIG. 110-B. The figures also show the flanges, which could be optional, and which could also be on some slanted angle, and could be all around the edges of the lifter.

FIG. 111 shows another cross-section view, across the length of the pull-tab. It shows the lid well or trough depressed below the general surface of lid. It also shows the tab dimple, sitting in the trough, and it also shows the raised flanges all along the edges of the lifter.

FIG. 112 shows that we could still operate satisfactorily with ONE scored seal, IF the rotation of the pull-tab is fairly limited to some relatively small ROTATION RANGE. In such a case, we could leave the pull-tab in its normal position A, as it is now with Prior Art containers. The user would rotate the pull tab either CW to B or CCW to C, which will raise the tab tip, but will still keep the nose over the scored seal. When the user would pull the tab tip further, the seal will break as usual. With this arrangement, the container would look practically unchanged, compared to the prior art containers, and the users will hardly notice the difference. The only difference is to educate the users that they have now the OPTION OF ROTATING THE PULL-TAB TO GAIN CERTAIN ADVANTAGE, namely LIFTING THE TAB TIP EASILY. This could be a GREAT MARKETING ADVANTAGE.

Of course the option of having two scored seals still exists, as explained further down below.

FIGS. 113 through 117 are "picture drawings" made on a 3-D CAD program. They show the pull-tab from different angles, especially looking at it from the bottom. They show the "dimple" which will act as a cam follower, riding on the trough surface and when it rides on the ramp, it will raise the tab tip, as stated earlier. The dimple can have various shapes, and can be part of the "bridge" or part of the "spines" or depending on the shape of the tab, it can be placed at any appropriate location.

The trough can be straight, rectangular or on an arc, with the rivet as the center of the arc.

FIG. 32 shows the top view of the can according to this approach. The tab would be placed at a starting position of approximately 45 degrees say, and then it would be rotated to reach a position similar to the present conventional position. During this rotation, the tab will pass over a "ramp", which would act as a "cam", which would "lift" it, so that the tip of the pt would rise from its conventional "flat" position to the new "elevated" position. At this elevated position, there will be a large space between the tip of the pt and the lid surface, so that the user will have an easier time inserting the fingertip under the tab to lift it.

The figures show the tab in "both" positions, superimposed one on top of the other, just to show the concept more clearly. In reality, there is only ONE tab, and it is simply shown at the beginning of the rotation and at the end of the rotation as well. Most of the following figures in this group will show the tab one time at the beginning of the rotation and another time at the end of the rotation, and one more time at both positions superimposed one on top of the other.

FIG. 33 shows the can lid, with the wedges. The tab itself has been removed simply to show the wedges more clearly. We can use two wedges as shown, or we can use only one wedge as will be shown later.

FIG. 34 through FIG. 45 show this arrangement/embodiment from different viewpoints. They show the tab is its present conventional shape, i.e. flat, with the tip not bent up and with the nose not bent up either. In this case, when we rotate the tab and it reaches its end position, the tip will be raised to the desirable height, but the nose will be lowered at the same time, into the lid/seal. So, by the time the tab reaches its end position, the nose would have reached a situation, where it may have cracked the seal already. If that is desirable, then so be it. If not, we would bend the nose upwards, as in FIG. 23 through FIG. 29. In this case, the seal would not be affected during the rotation of the tab. We would crack the seal and bend it inside the can, only when we grab the tab and pull on it, i.e. after the tab has been rotated and is sitting in its final rotational position.

Figure 46:
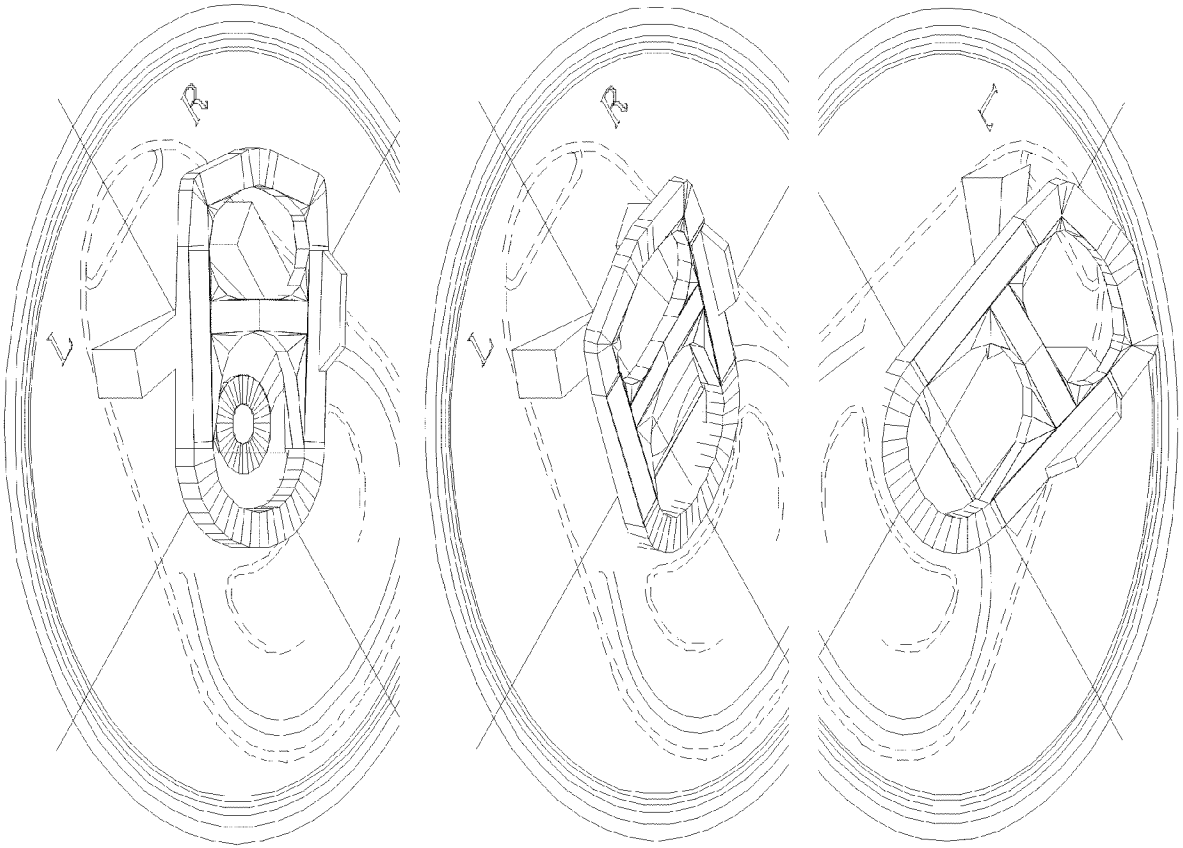
FIGS. 46 through 50 show a similar lid w cams and pull tab, except that the pull tab has an elevated edge along the long portion of the lifter portion, which I will refer to as the "flange". The flange in these figures is on the right side of the pull tab, looking at it from the top. The flange in FIGS. 46 through 48 is short, compared to the flange in FIGS. 49 and 50, which is longer.
Figure 47:
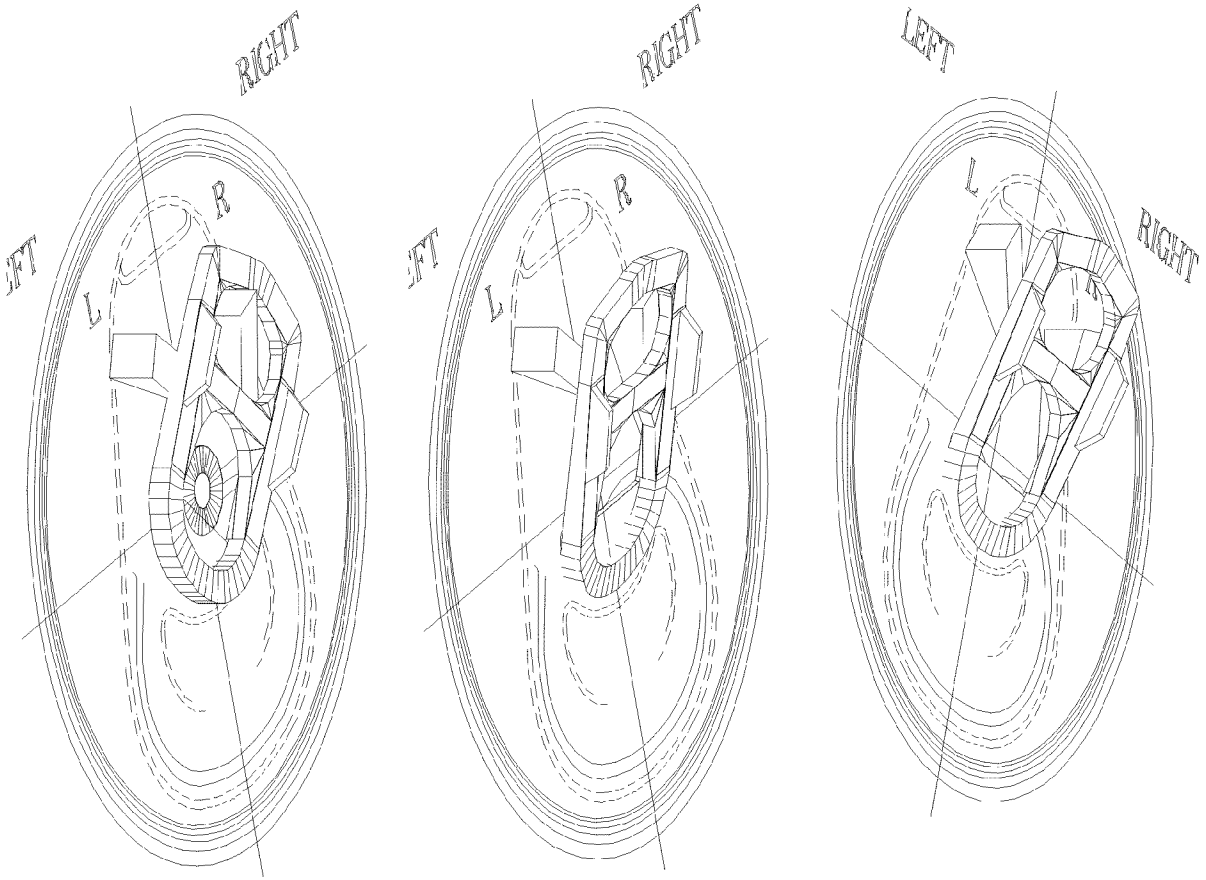
Figure 48:
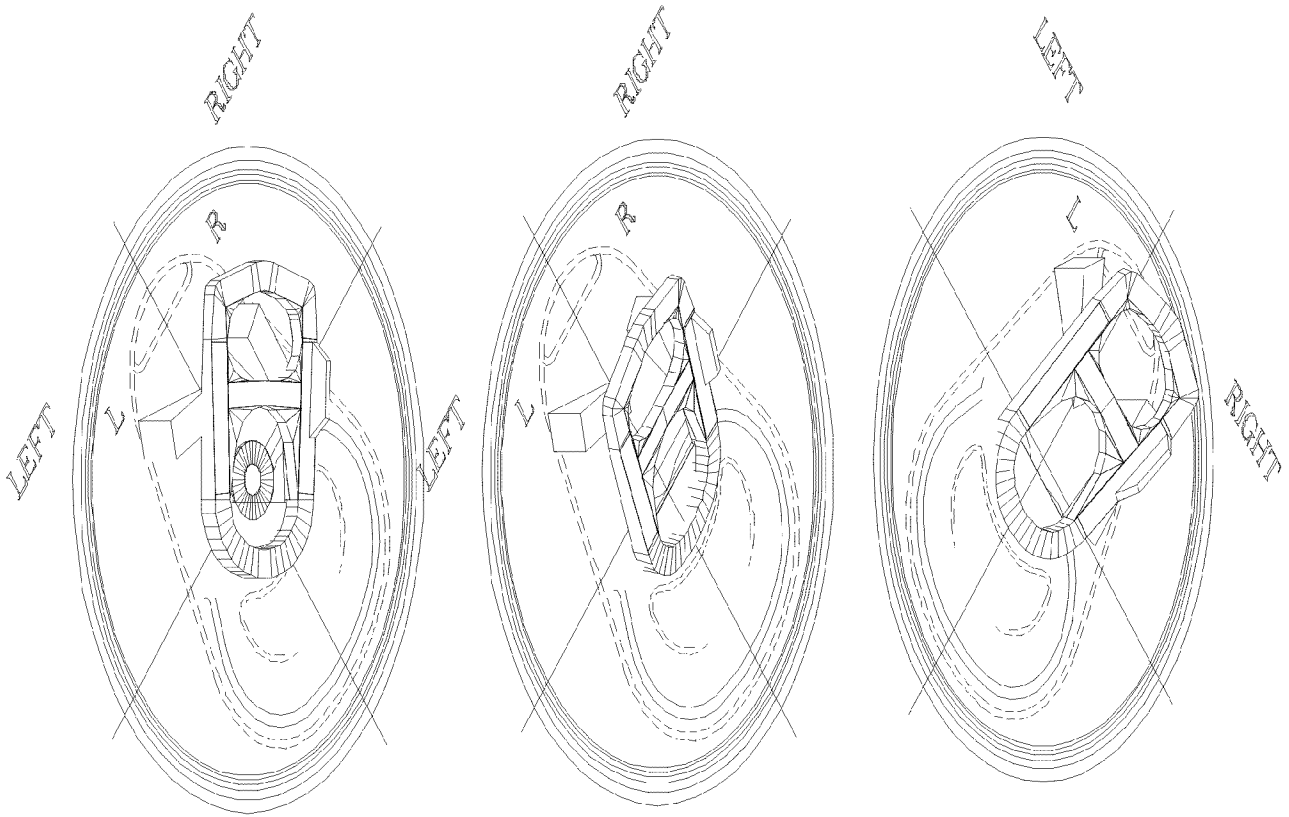

FIG. 46 through FIG. 48 show the same thing, except that the tab has a "short flange" at the right side of its top surface. This is to facilitate pushing the tab sideways to rotate it.

Figure 49:
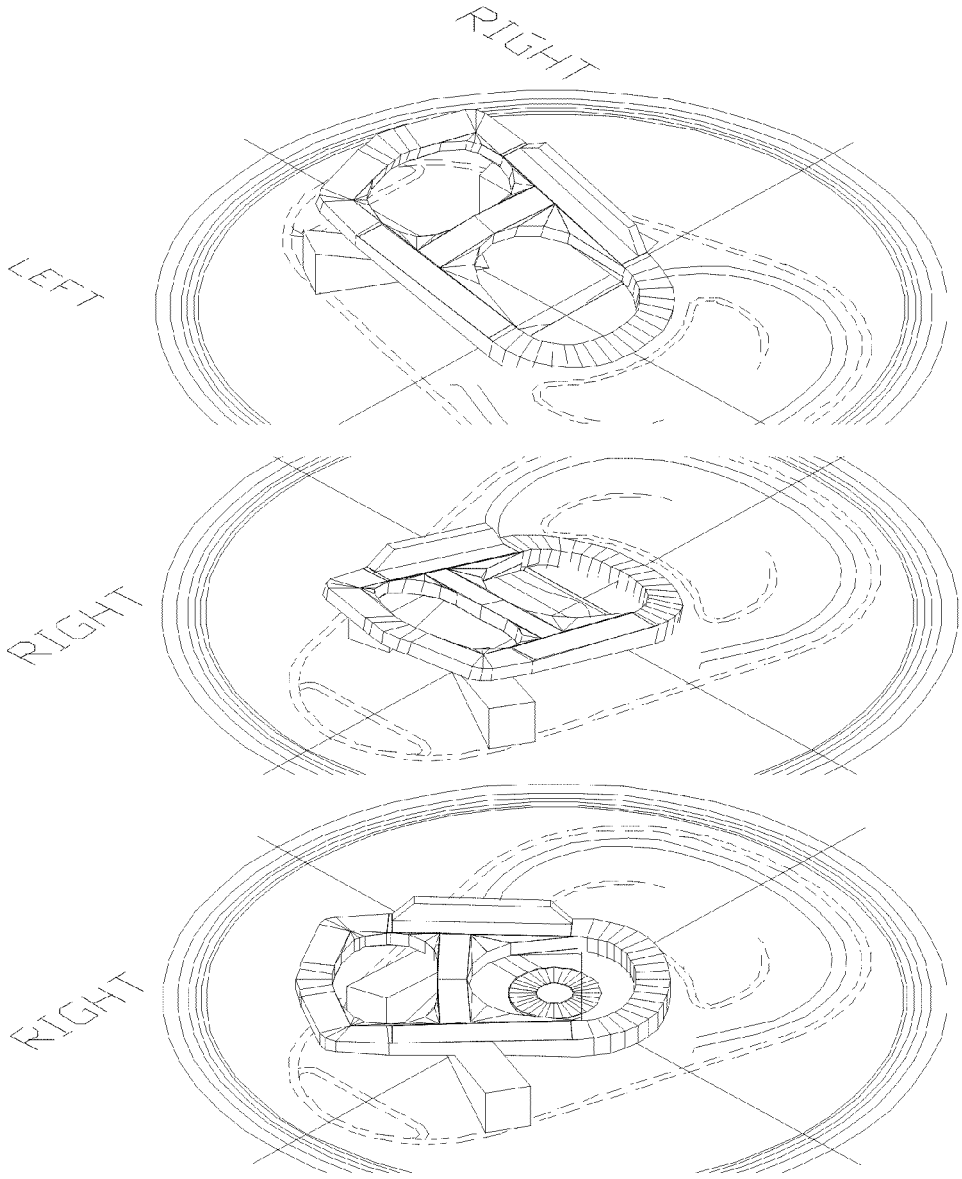
Figure 50:
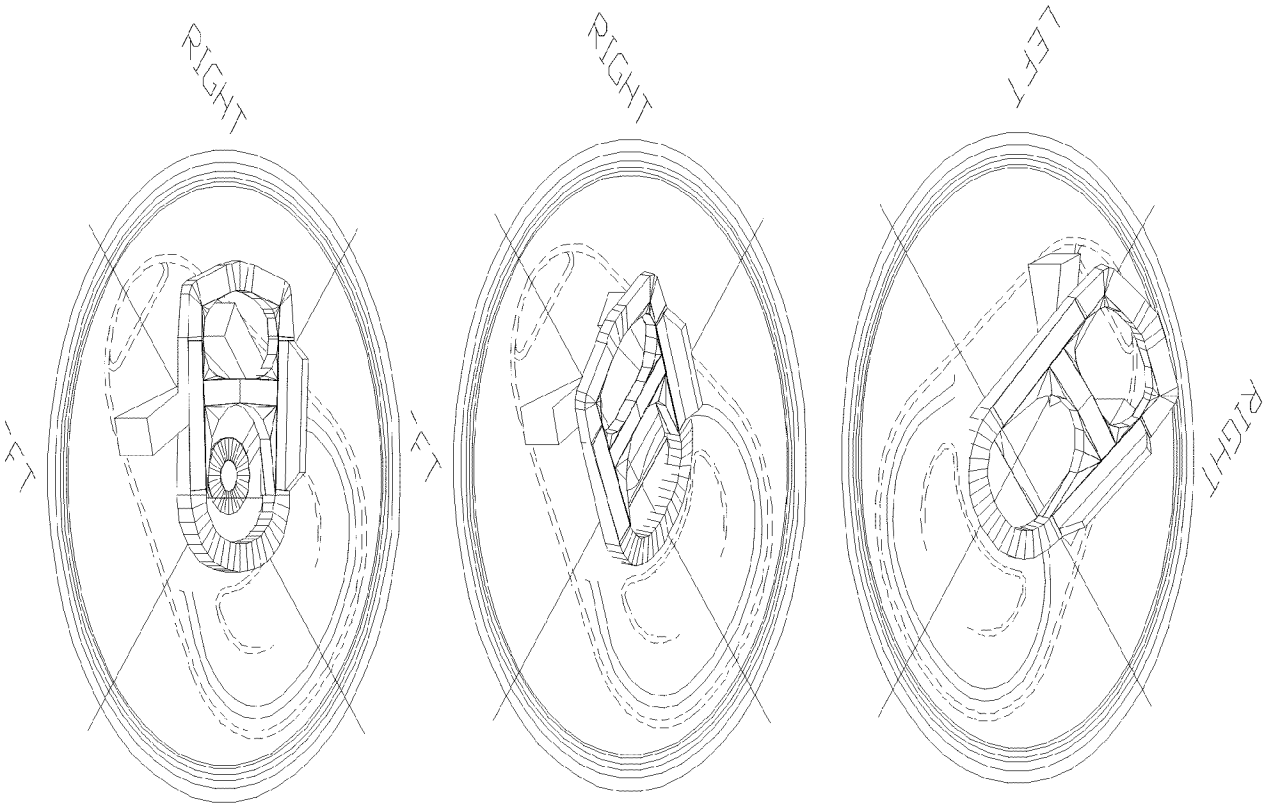
Figure 51:
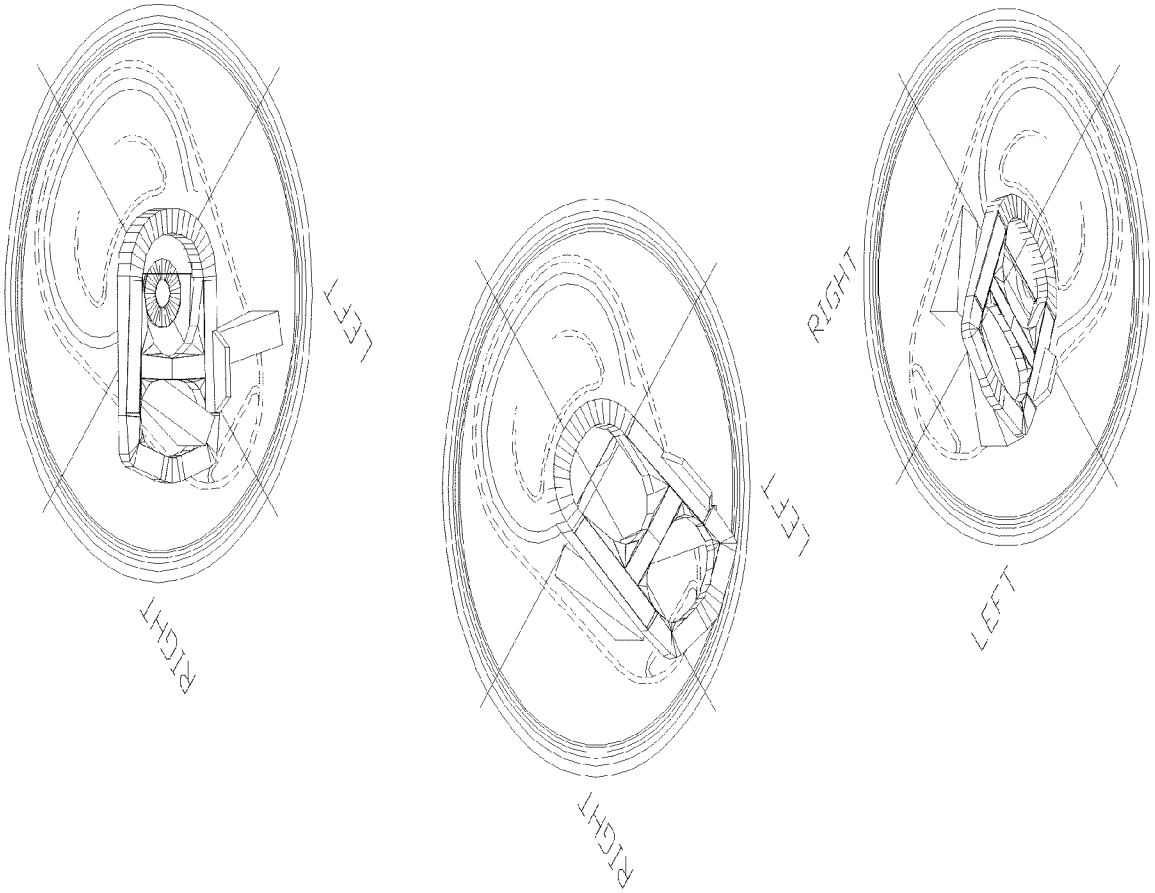
FIGS. 51 through 54 show a similar setup, except that the flange in this case is on the left side of the pull tab. The flange in FIGS. 51 and 52 is short and the one in FIGS. 53 and 54 is long.
Figure 52:
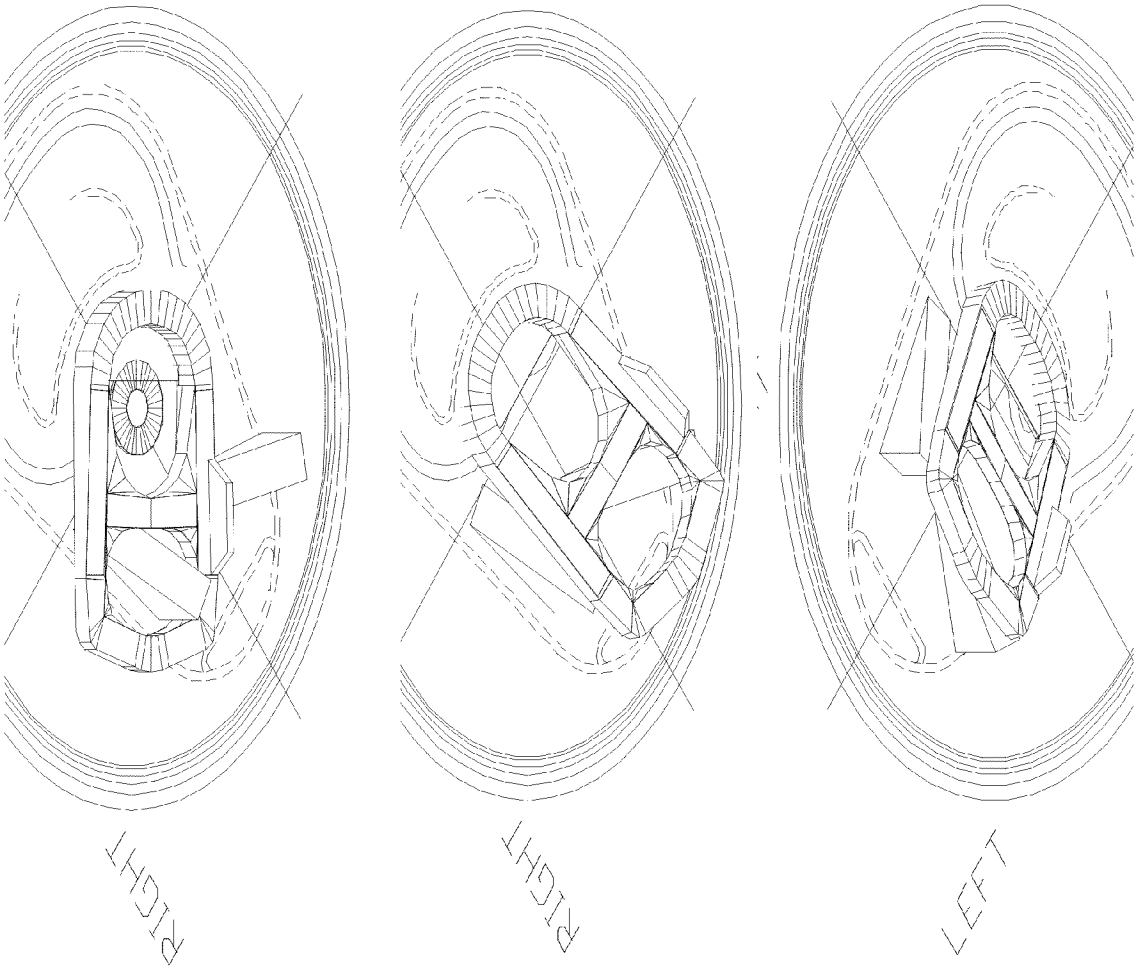
Figure 53:
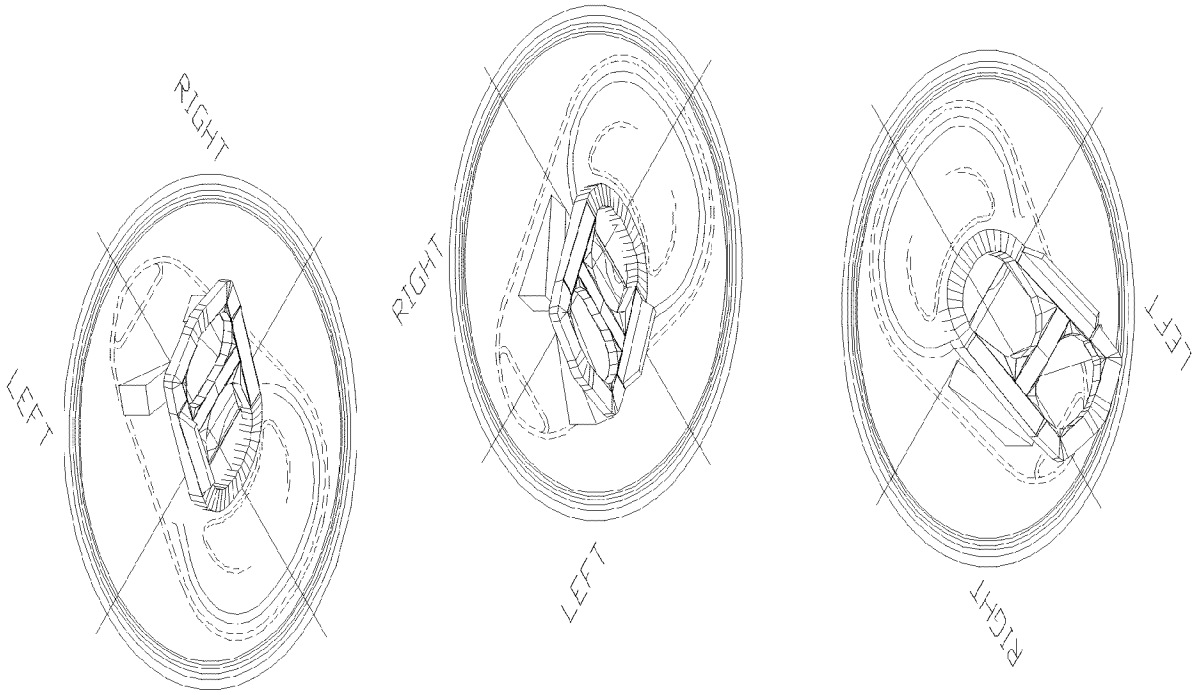
Figure 54:
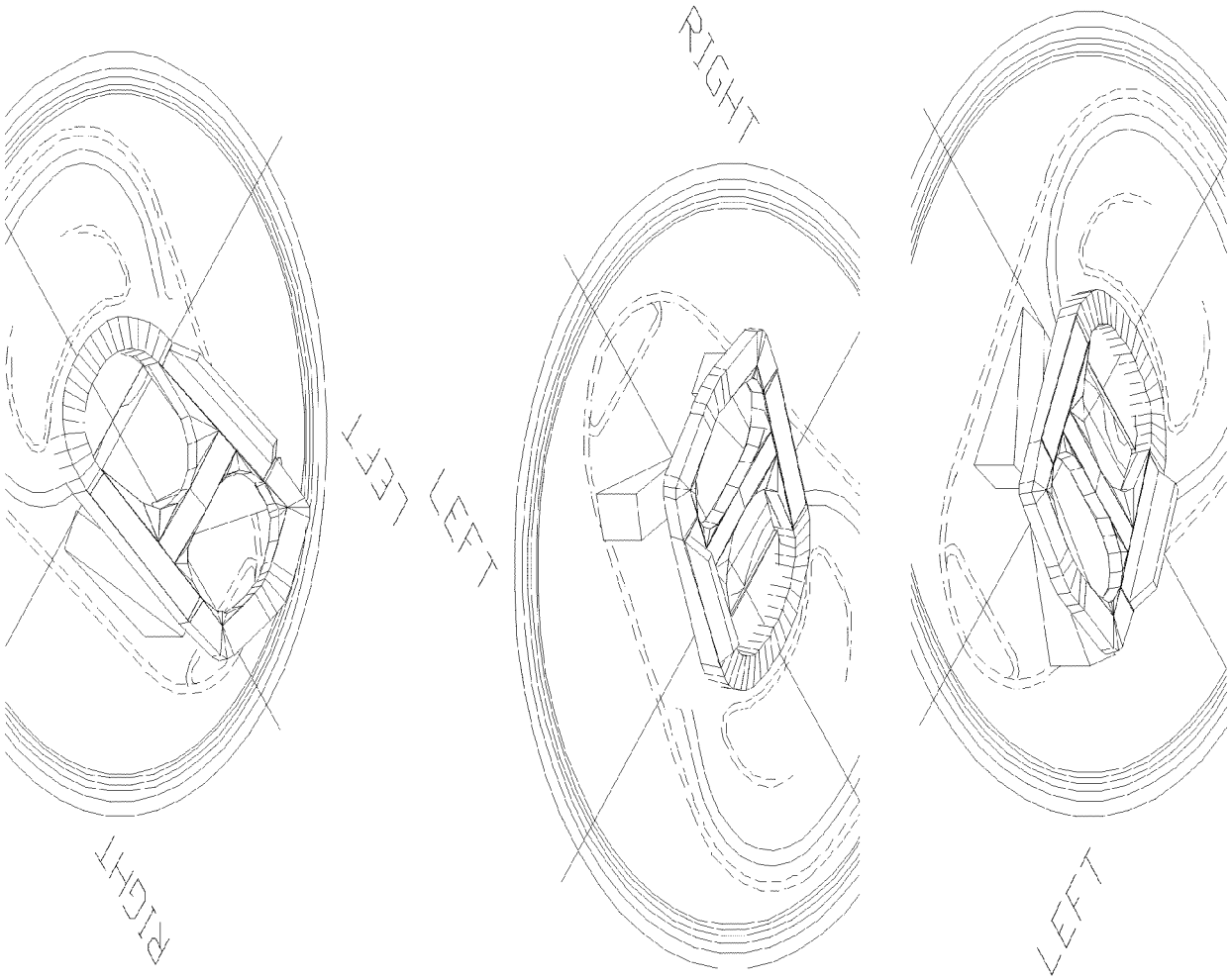

FIG. 49 and FIG. 50 show a similar right flange, but a longer one.

FIG. 51 through FIG. 54 show a similar arrangement, but the flanges are on the left-hand side. Again, short and long flanges.

Figure 55:
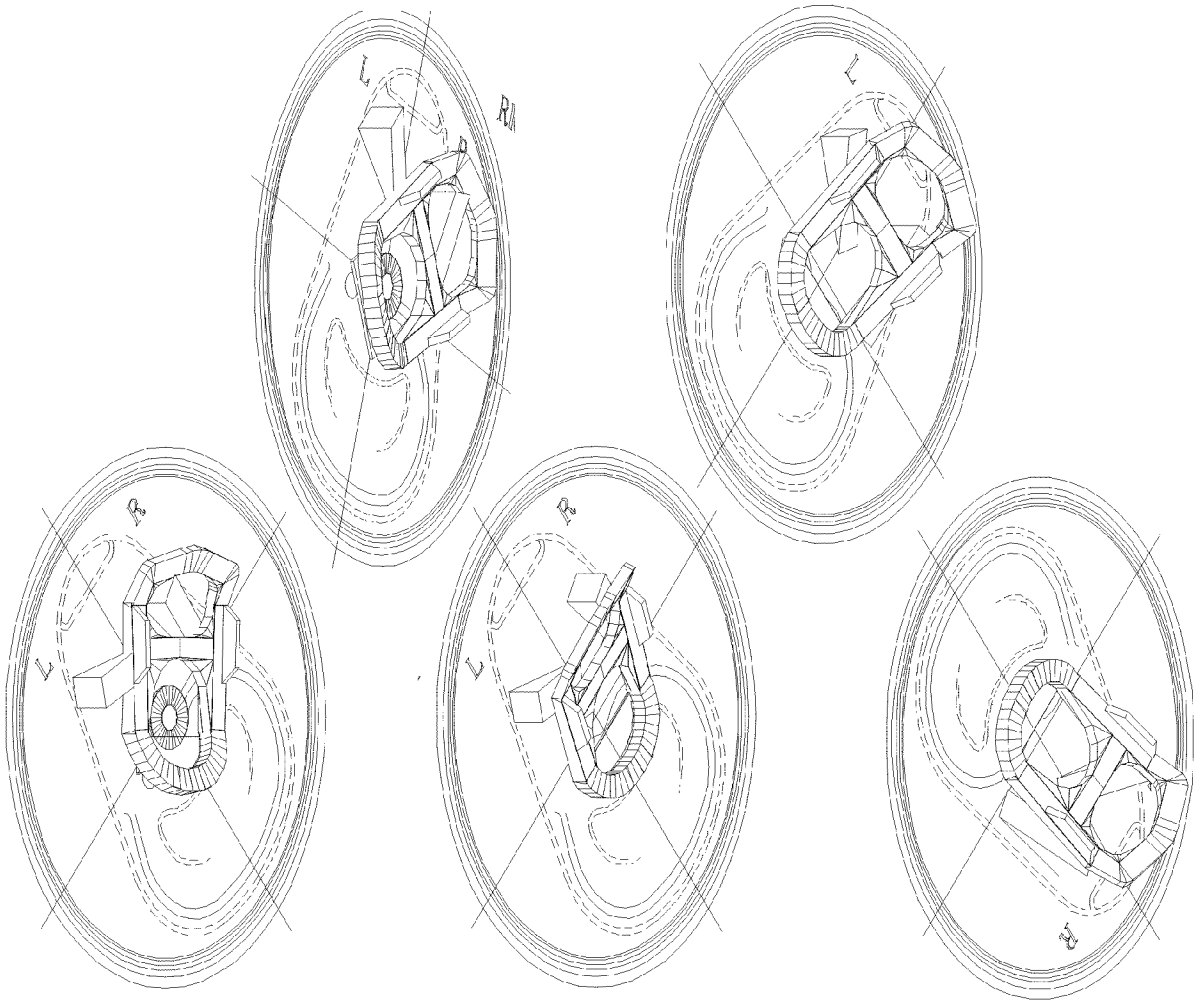
FIGS. 55 through 57 show again an almost similar setup, except for two differences this time. First, there are two flanges on the tab this time. Second, the lifter tip of the lifter portion of the pull tab is bent upwards, to provide a larger gap under it for the finger tip to be inserted under the tab.
Figure 56:
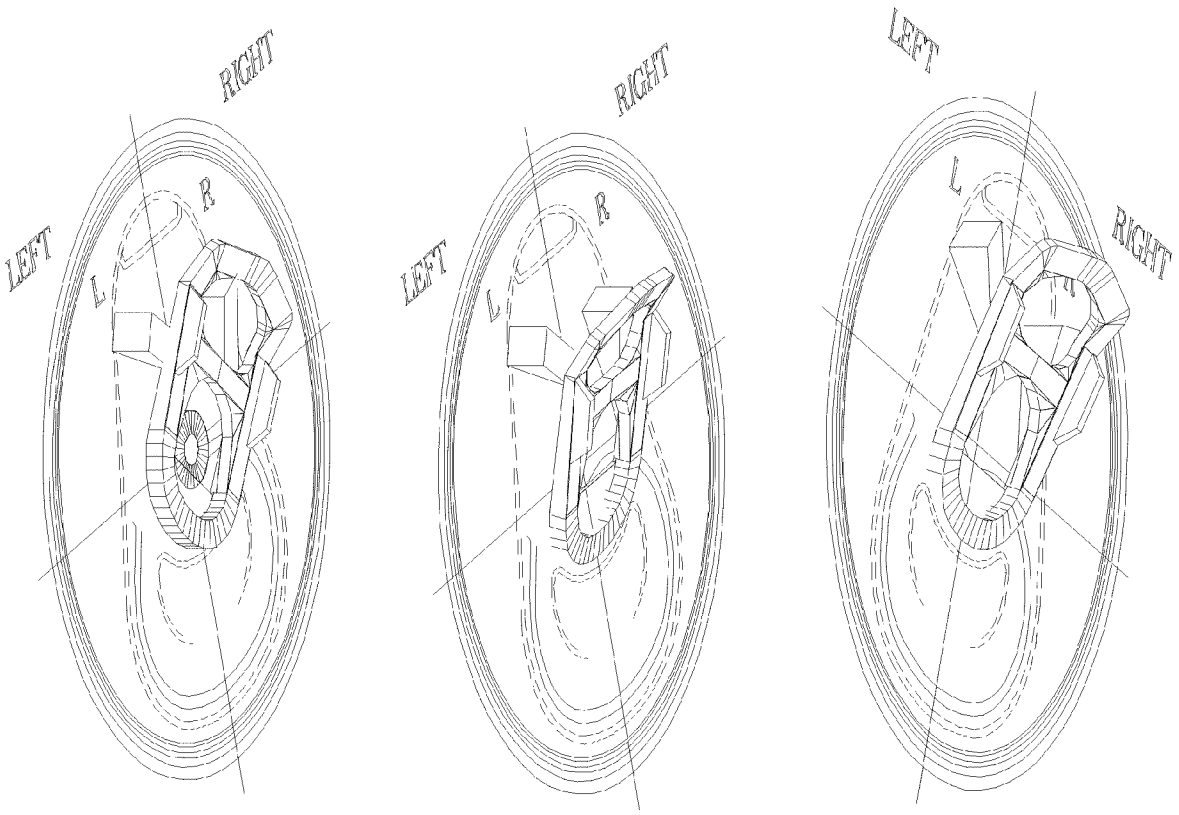
Figure 57:
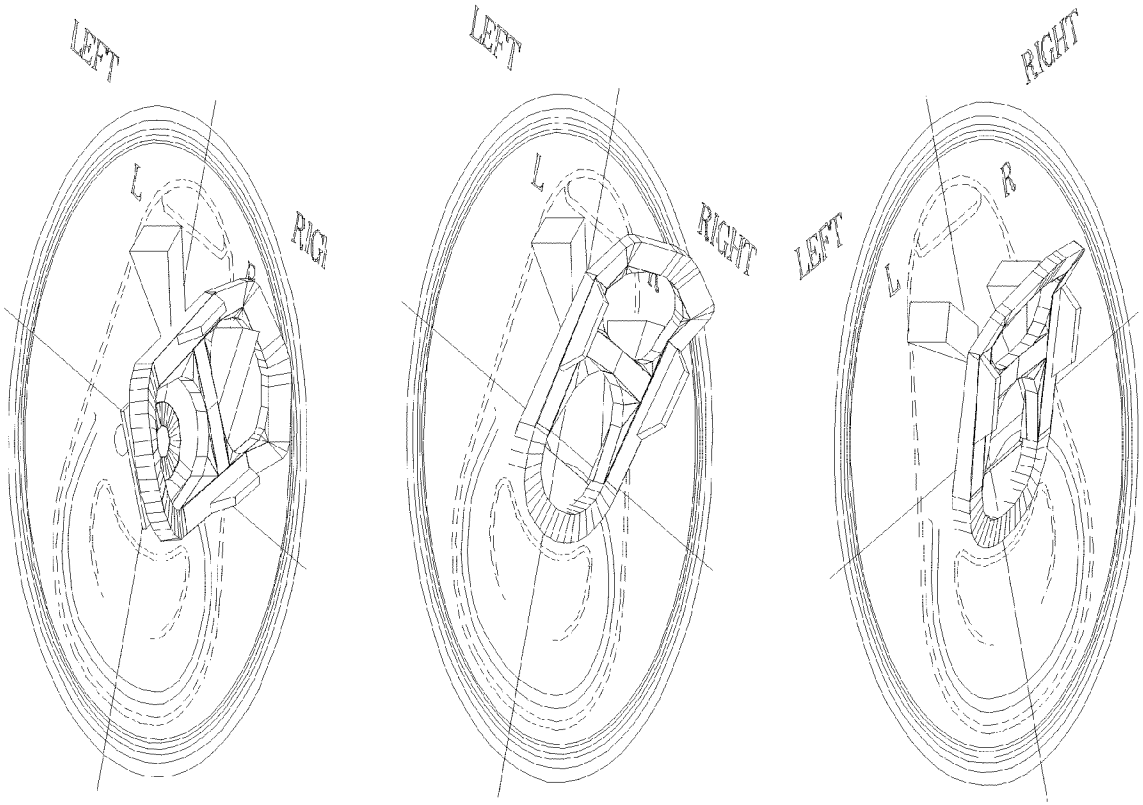

FIG. 55 through FIG. 57 show flanges on both sides. Here the flanges are short, but they can be long as well.

By the way, the flanges can also be on the lower side of the tab, following the contour of the "domed" surface of the lid. Or they can just be on the lower side of the tab, without any part of the flange above the top surface of the tab, or they can be partially above and partially below the tab.

Please notice also two additional features in FIG. 55 through FIG. 57. First, the tip of the pt is bent upwards, to allow more space under the tab for the finger. Second, the nose also has been bent upwards, so that the seal would not be opened "during" the rotation motion of the tab.

FIG. 58 through FIG. 60 show the same thing, except that the wedges here have "sloping" side walls, as compared to those shown in the previous figures, where the side walls were shown "vertical". The advantage of the sloping sidewalks is that it would be easier to manufacture, and would create less internal stresses in the lid material.

FIG. 61 through FIG. 68 show the wedge in an even more streamlined shape, making it even easier to manufacture. FIG. 61 and FIG. 61 show one wedge on the lid, while the tab is at its starting position. The wedge would lift one side of the tab, while the second side of the tab would follow partially being elevated as well. FIG. 63 shows two such wedges, each one acting on one side of the tab. The high end of the second wedge would fit in the opening of the "ring" of the tab. FIG. 64 show details as to where to locate the wedges on the lid with respect to the tab. FIG. 66 through FIG. 68 show side views of the tab sitting on the lid, with the wedges in between. The wedge is shown in two different cross-sections superimposed one on top of the other. The first one has a rounded top, similar to the wedge shown in FIG. 61 through FIG. 63. The second cross section shows the top of the wedge looking like a trapezoid, with filleted corners. The advantage of such a shape is that it would present a surface that is more parallel to the surface of the tab, when the tab reaches its top elevated position. The wedge could have a rounded top at its lower end and a trapezoid, as shown, at its higher end. Or better yet, the top surface of the trapezoid would have a shallow angle at the lower end of the wedge and a steeper angle at the higher end, the angles being such that they would match the respective angle of the tab surface at its respective low and high positions.

Right-Hand Rotation, Left-Hand Rotation & Double-Sided Rotation

All the above rotational drawings show the tab being rotated counter-clock-wise. Some users may prefer to have it rotate in the opposite direction, i.e. clock-wise. The manufacturers may opt to have both versions on the market. However, this may not be economical. The alternative would be to make the tab able to rotate either way.

Figure 69:
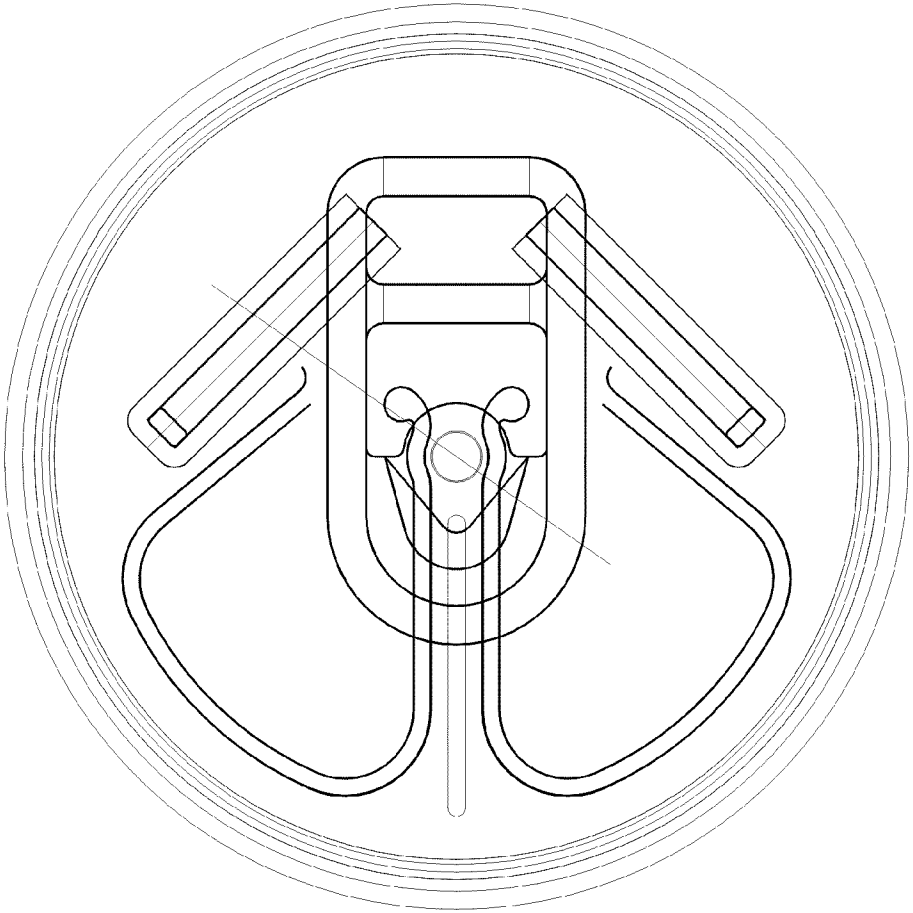
Figure 70:
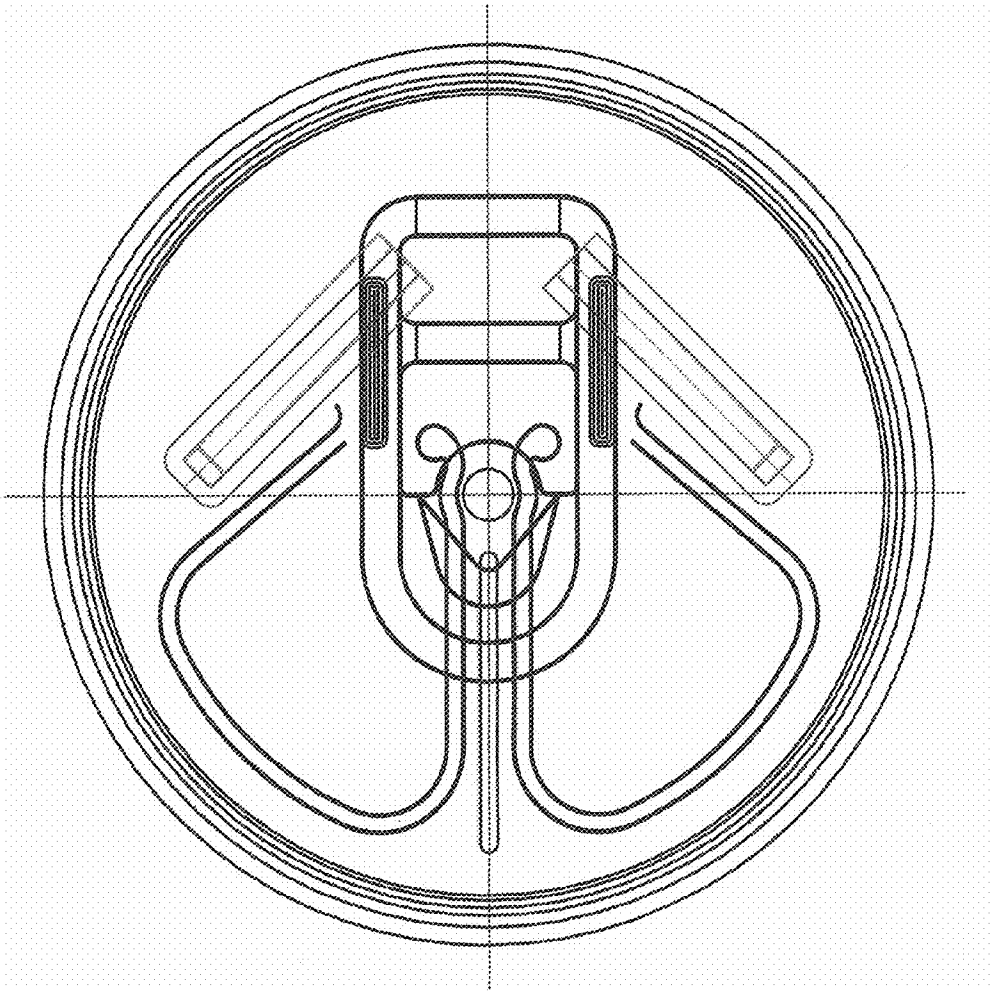
Figure 71:
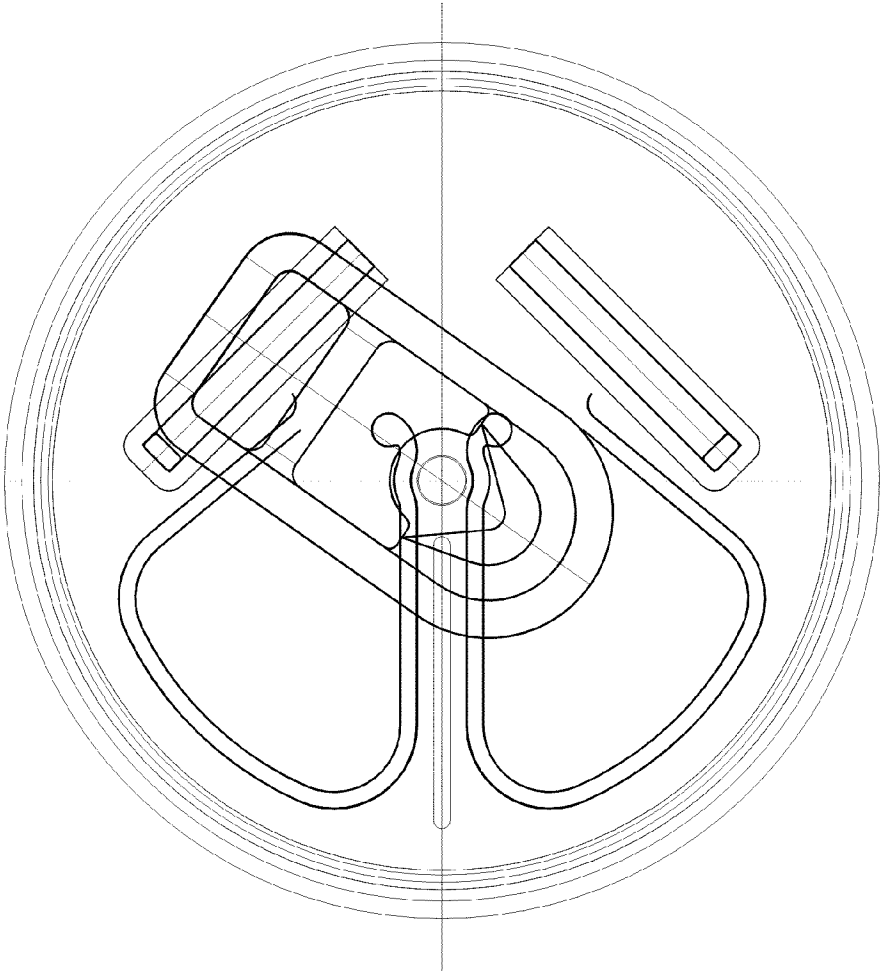
Figure 72:
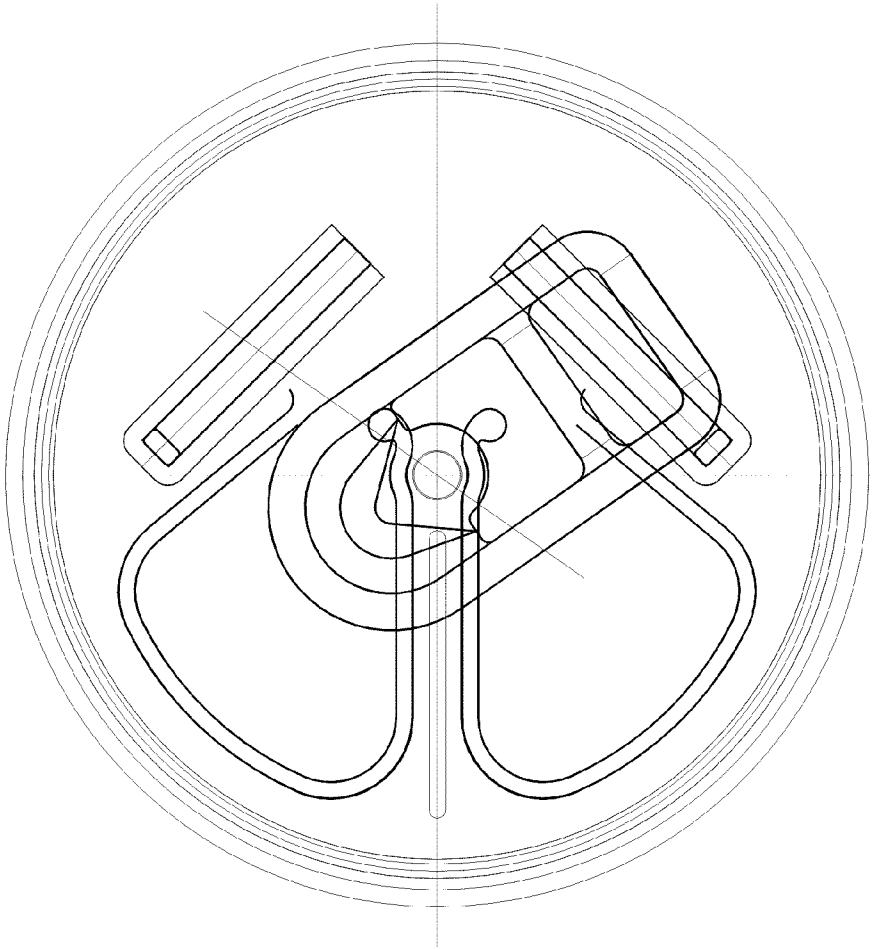
Figure 73:
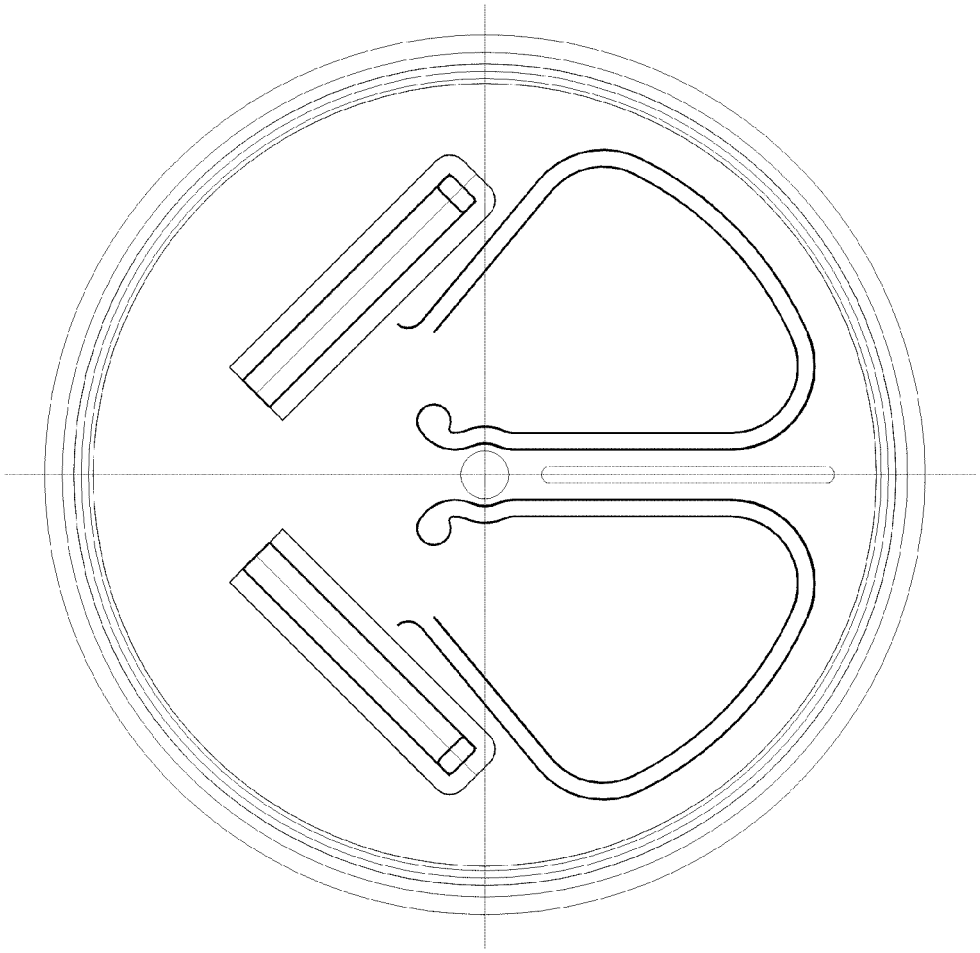
Figure 74:
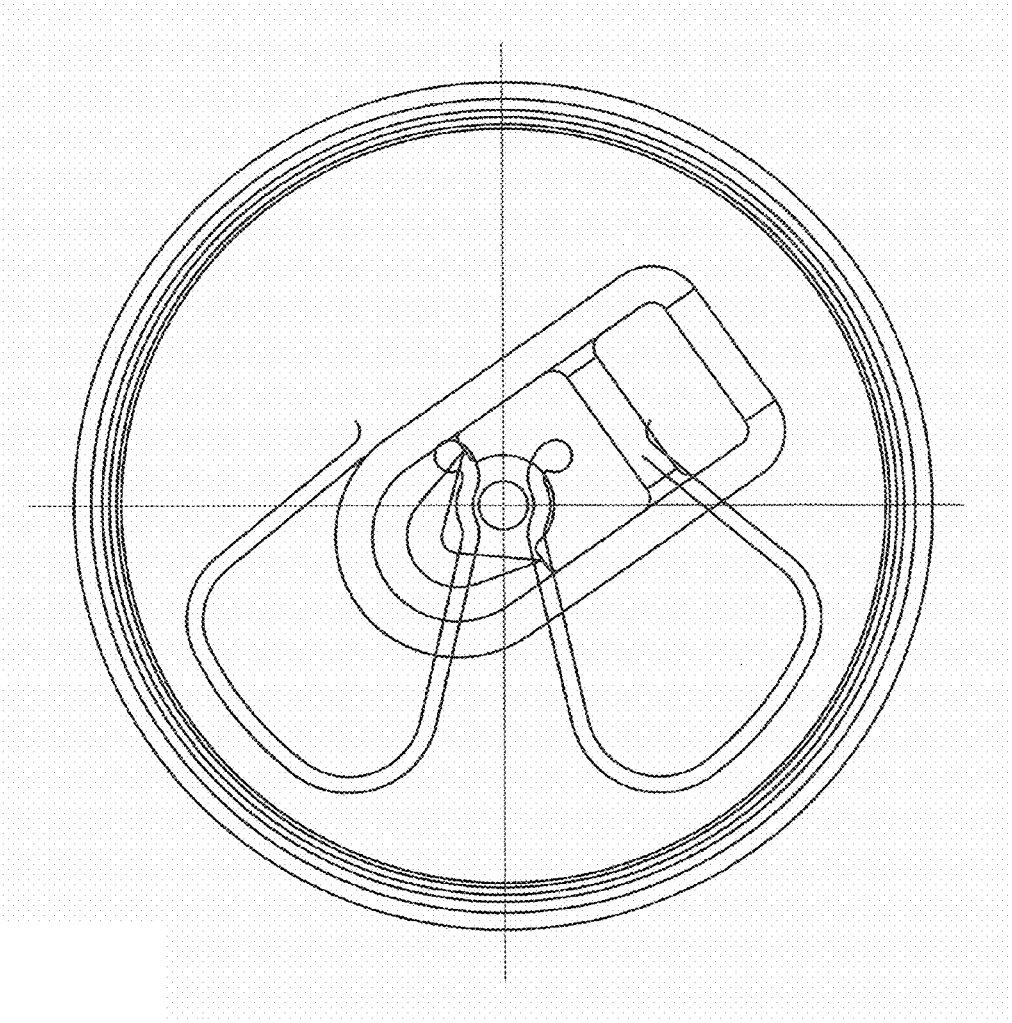

FIG. 69 through FIG. 79 show such embodiments. FIG. 69 shows a can lid with two seals. The tab is located centrally wrt them. Also two wedges are show, but in an opposite direction to each other. FIG. 70 shows the same arrangement but with flanges on the tab. FIG. 71 shows the same arrangement, but with the tab rotated ccw. The left wedge has lifted the tab tip as described earlier. The nose moved to the right seal and can open it. FIG. 72 shows the same arrangement again, but this time, the tab had been rotated clock-wise. The right wedge has lifted the tab tip, while the nose is positioned this time to open the left seal. FIG. 73 shows the can lid without the tab. FIG. 74 shows the can lid, with the tab, but without the wedges.

Figure 75:
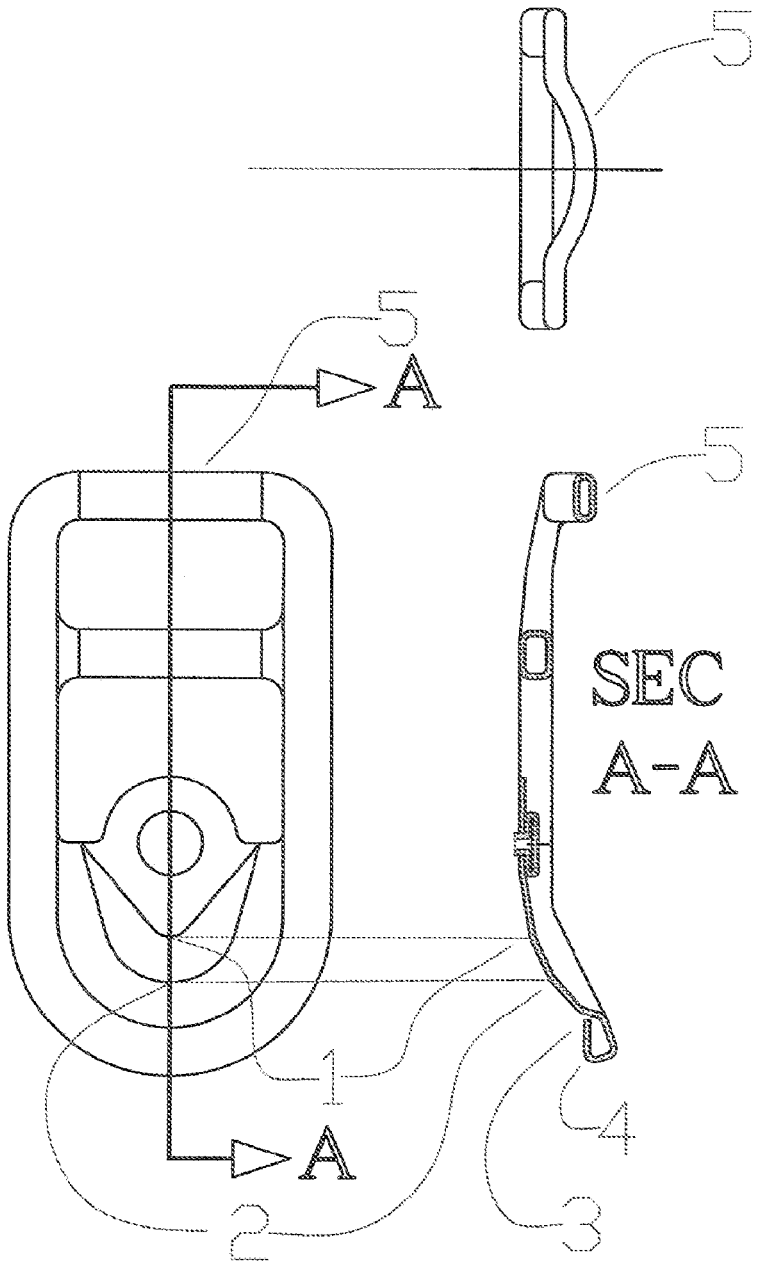

FIG. 75 shows some more details of the tab itself. First, the points 1 and 2 are concentration points. The plate would be formed (coined or etc) so as to work "progressively", i.e. to first crack the seal say with point 1 to release the pressure, then it would starts the further breaking of the seal at the surrounding score line using point 2. Point 3 would be a relief in the nose area of the tab to bypass the score line edges of the seal, as necessary, and finally point 4 would complete the pushing of the seal inside the can. At the other end, point 5 shows how the tip of the tab would be first bent upwards, and at the same time it would be "arched" as shown to provide even more space for the lifting finger.

Figure 76:
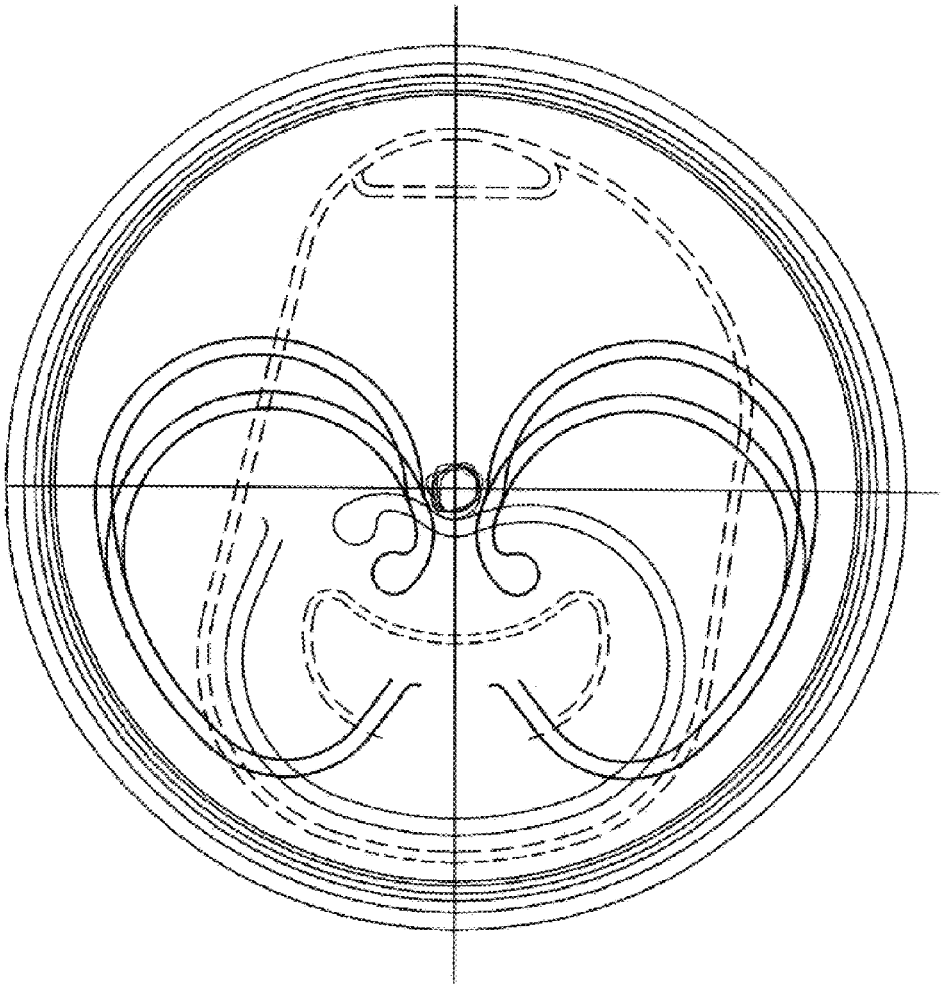
Figure 77:
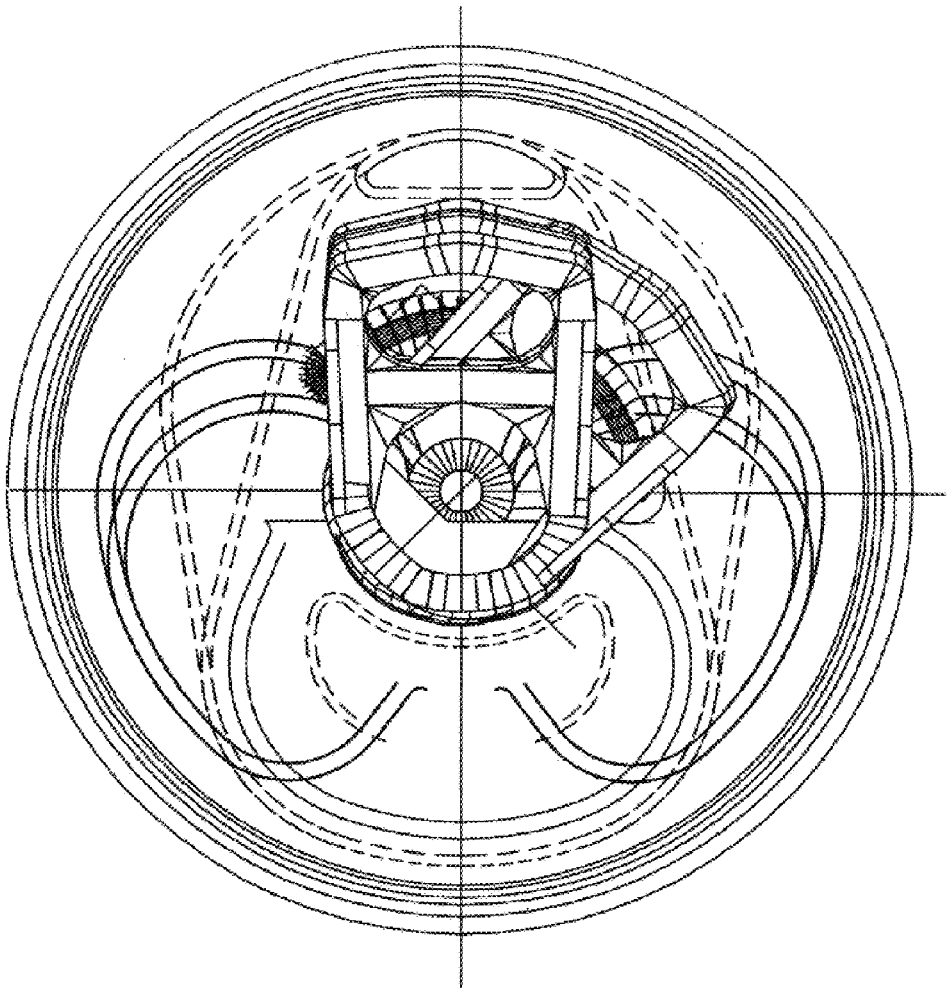

FIG. 76 shows two additional features. First, it shows two other shapes of the double seals. Second, it shows the contour, in dashed lines, of the recess in the lid, to provide recess space for the "single" direction tab, which was shown in FIG. 32 FIG. 65. FIG. 77 shows in addition, the recess space for the "double" direction tabs shown in FIG. 69 through FIG. 75.

Figure 78:
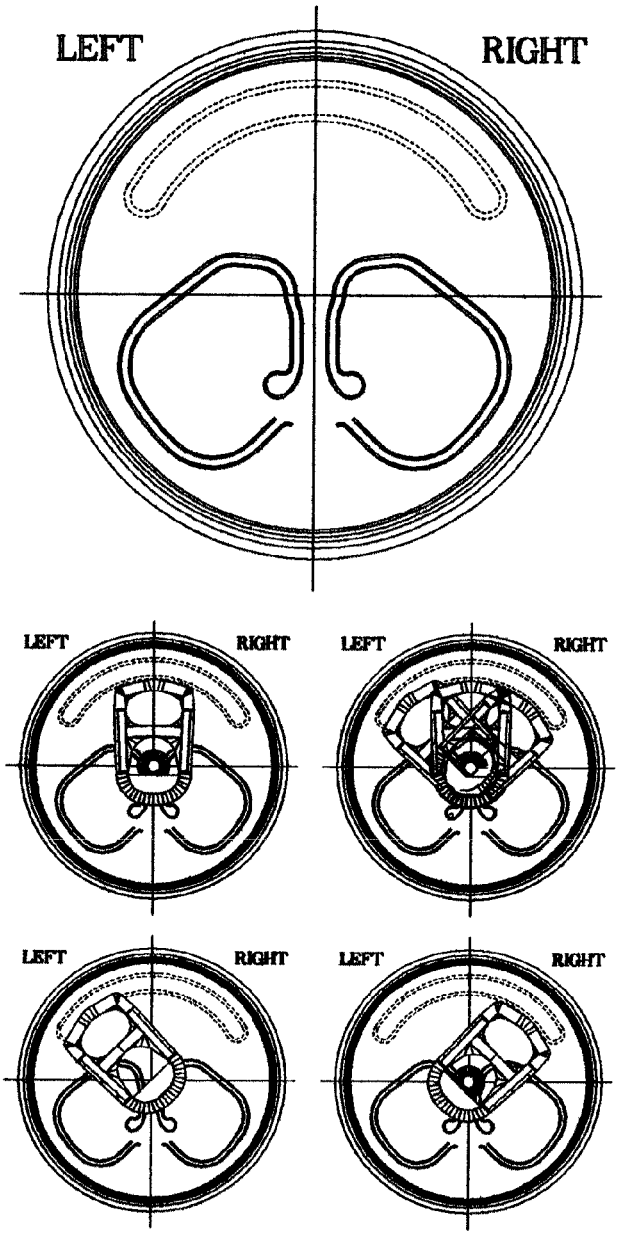

FIG. 78 shows more details of the curved bottom surface of the nose, for progressive action. It also shows some features of the seals, with reinforcing beads.

Figure 79:
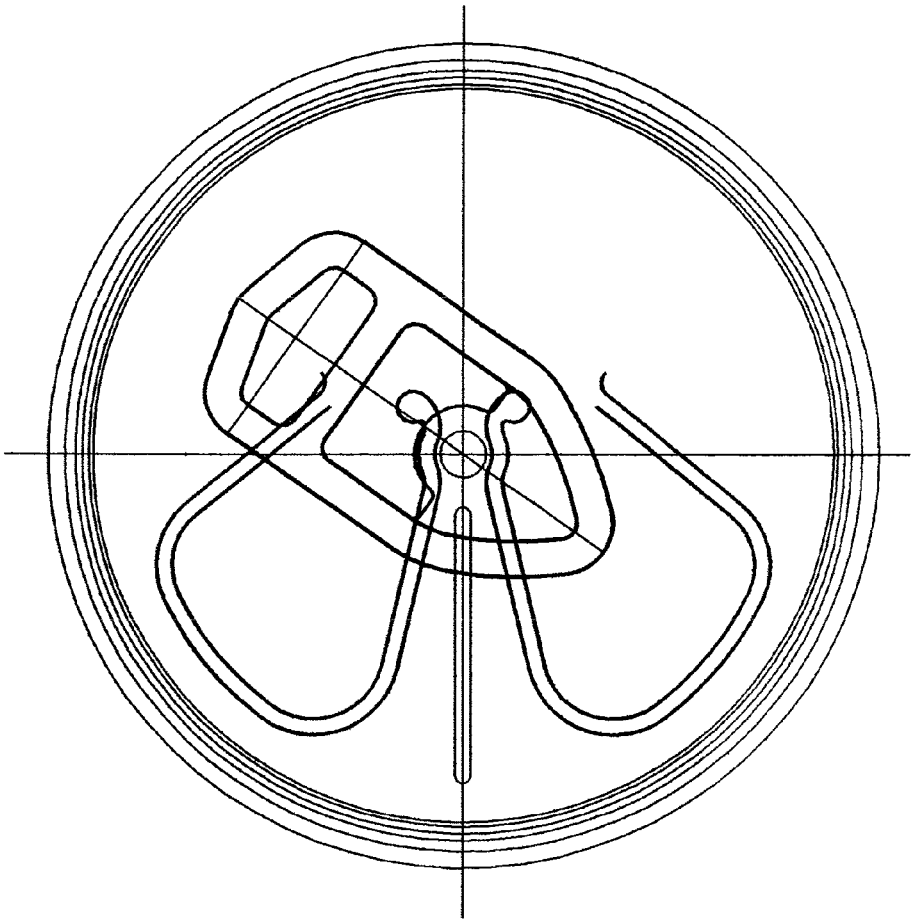

FIG. 79 shows a "pointed tip nose". And some details of the seals as well as a central bead between the two seals.

Figure 1:
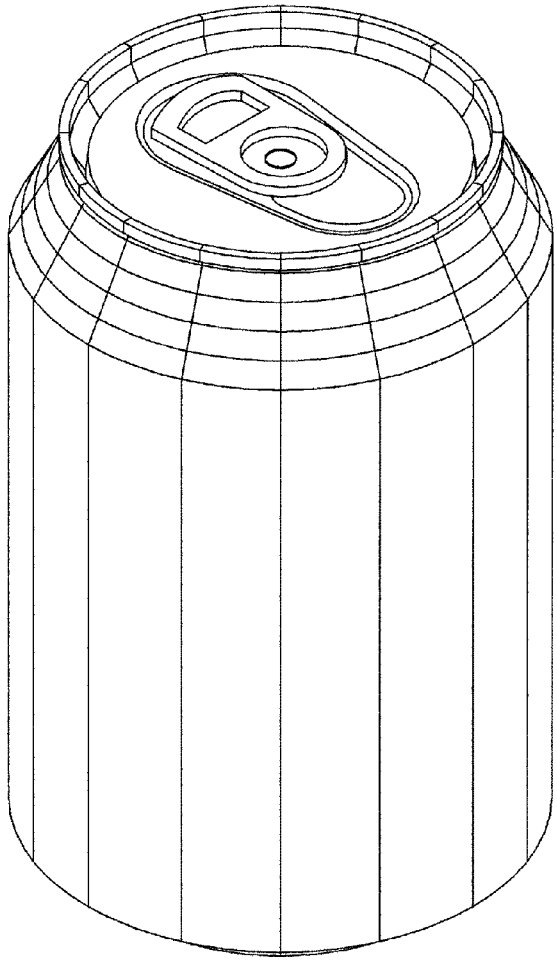
(PRIOR ART) FIG. 1
FIGS. 1 through 5 show the prior art can, with its pull tab, in cross-sectional views and in orthogonal and isometric views.
Figure 2:
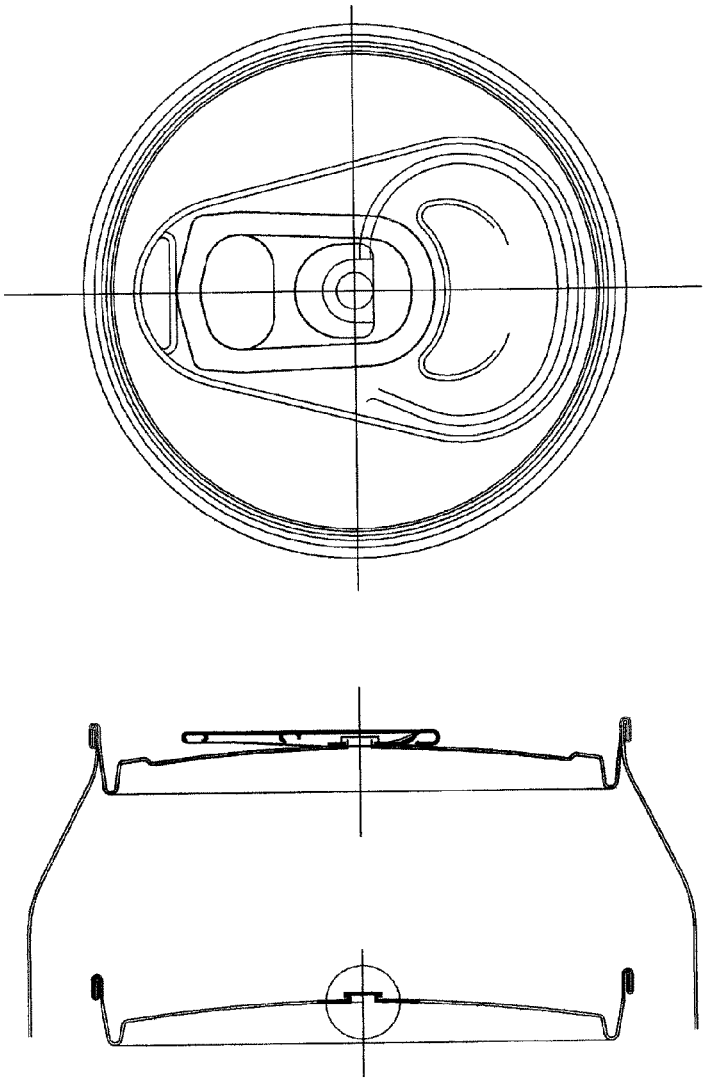
(PRIOR ART) FIG. 2
Figure 3:
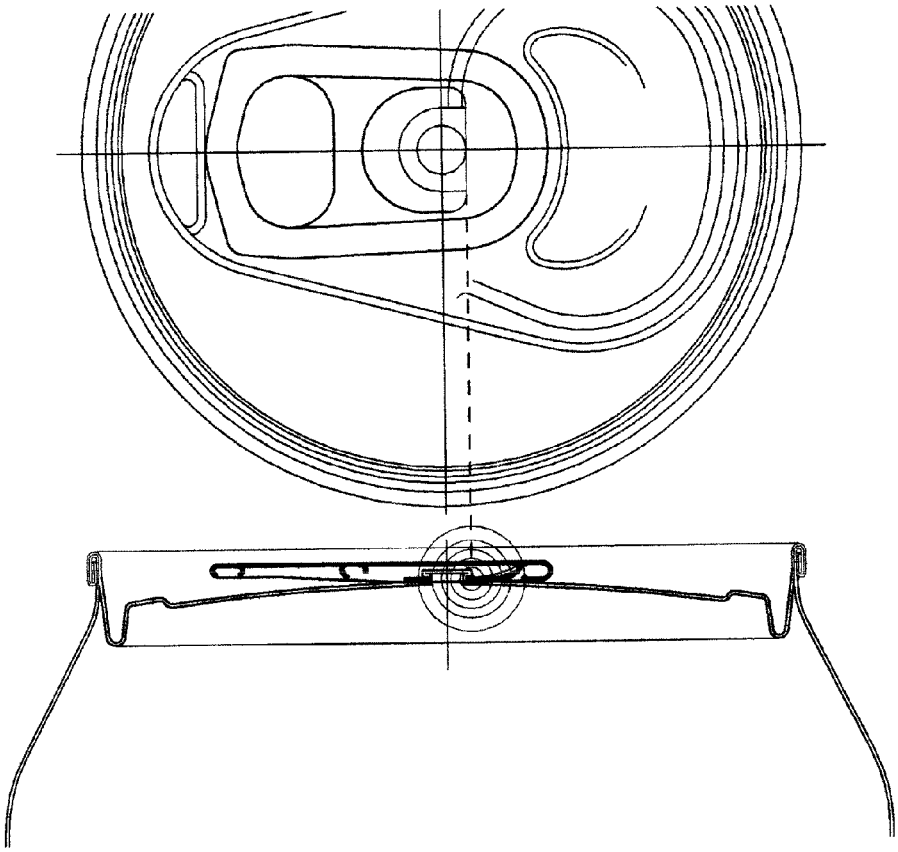
(PRIOR ART) FIG. 3
Figure 4:
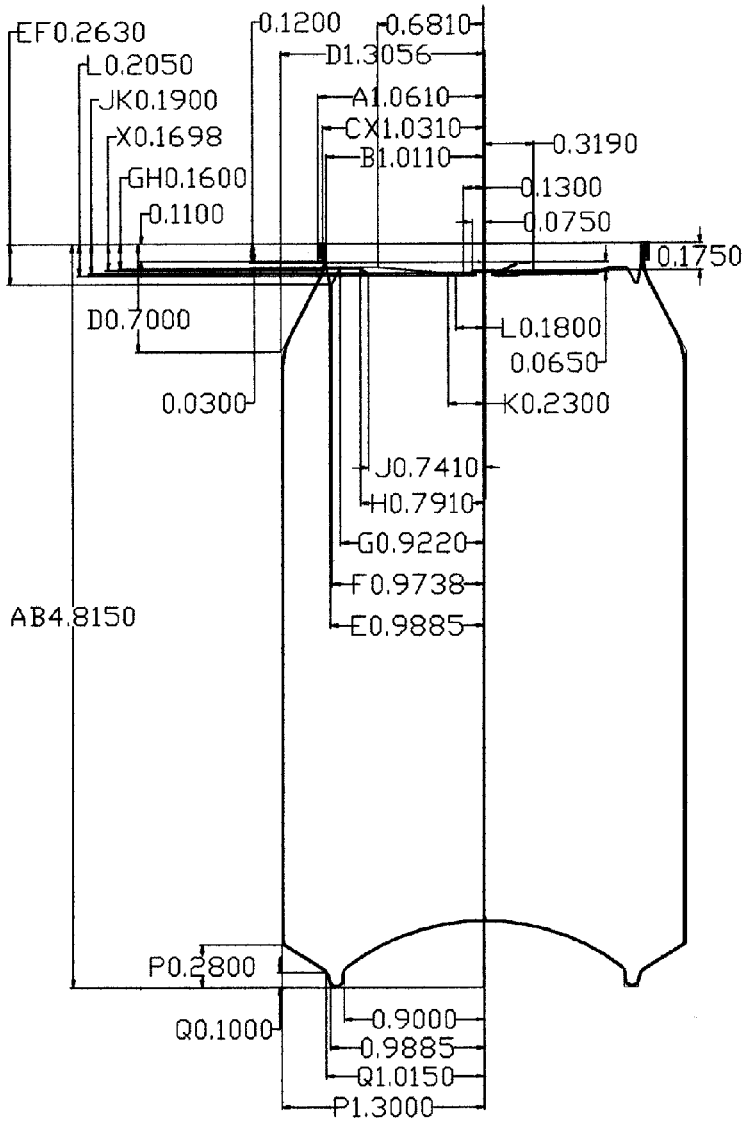
(PRIOR ART) FIG. 4
Figure 5:
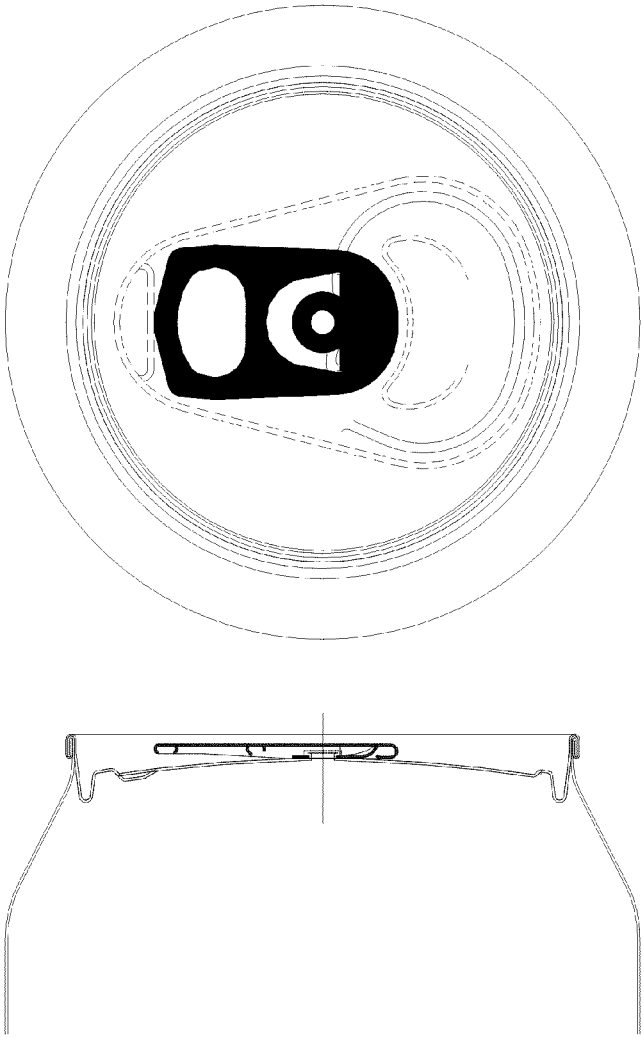
(PRIOR ART) FIG. 5
Figure 6:
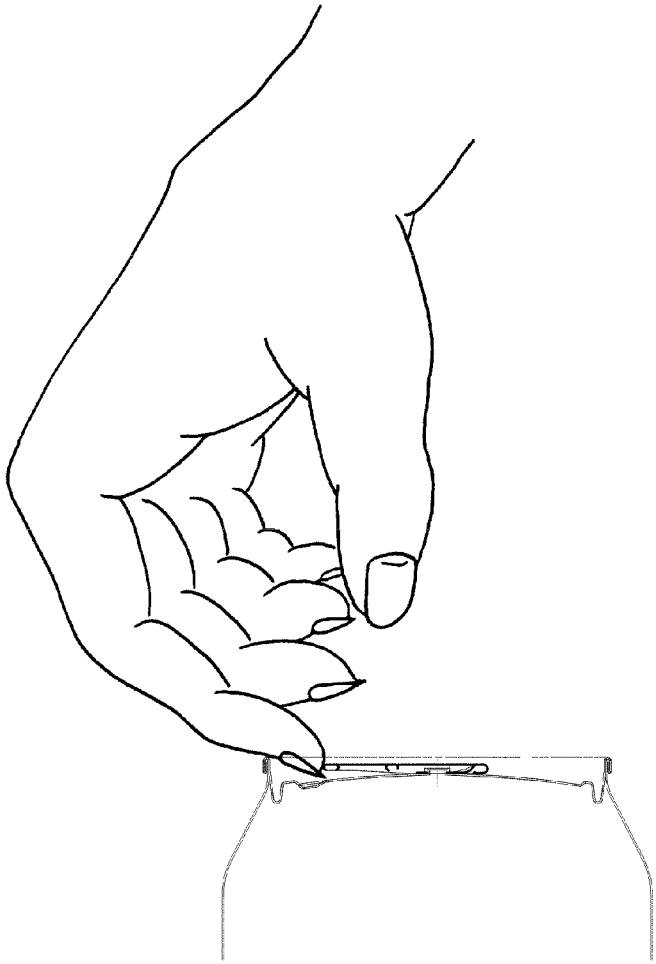
FIGS. 6 through 10 show the difficulties encountered when a user tries to open the can by trying to pull on the lifter end of the pull tab.
Figure 7:
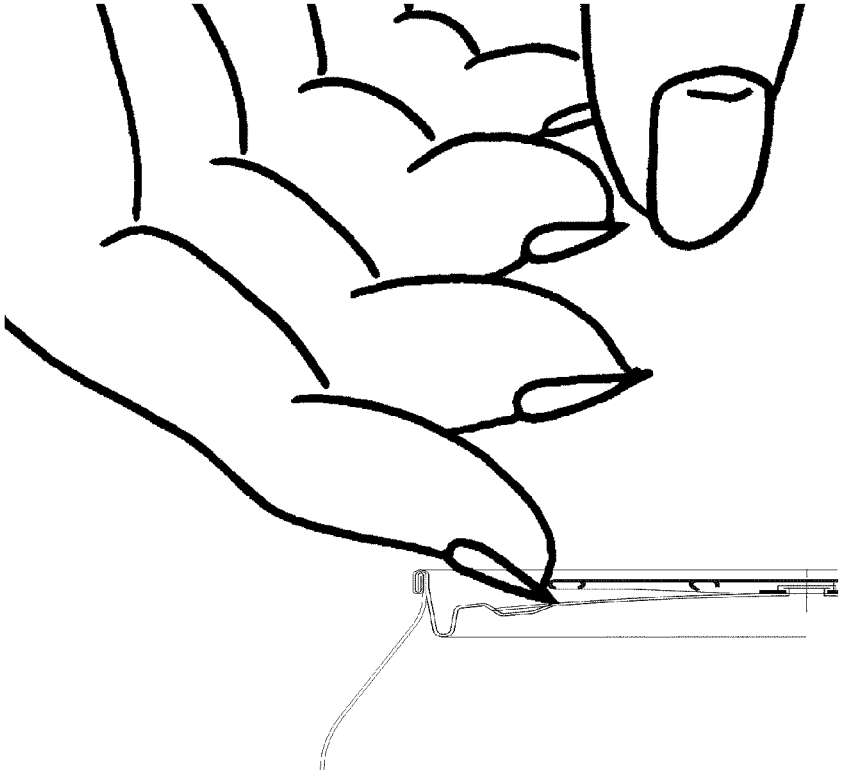
Figure 8:
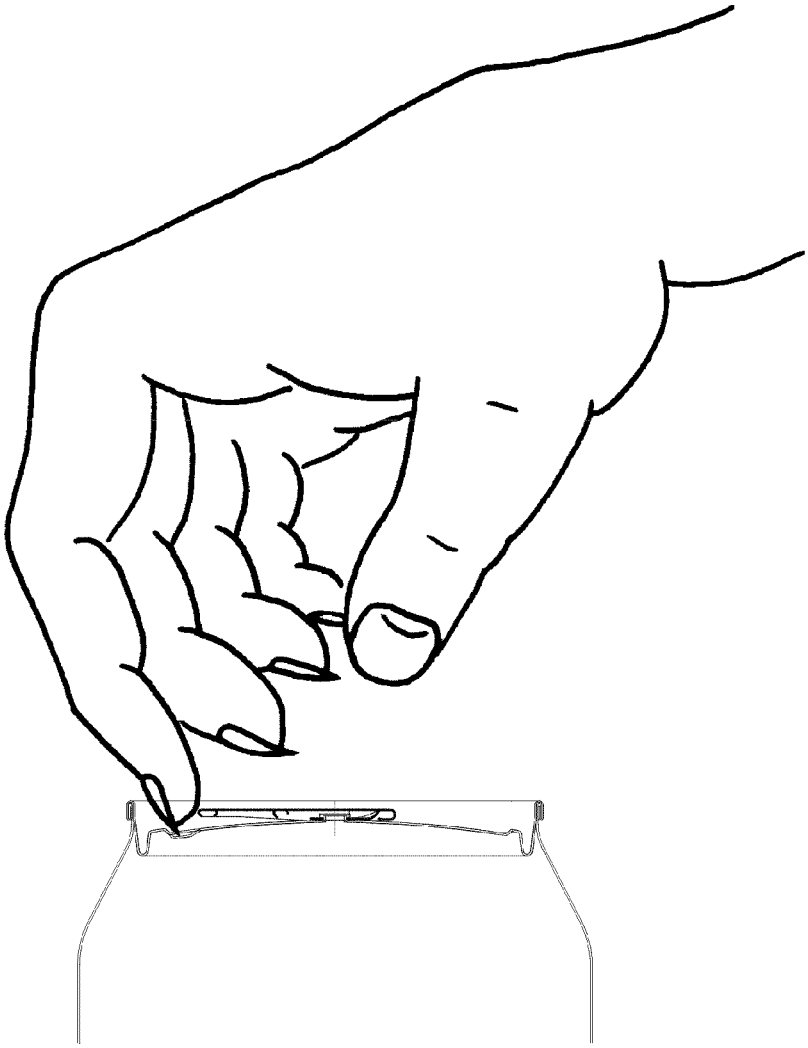
Figure 9:
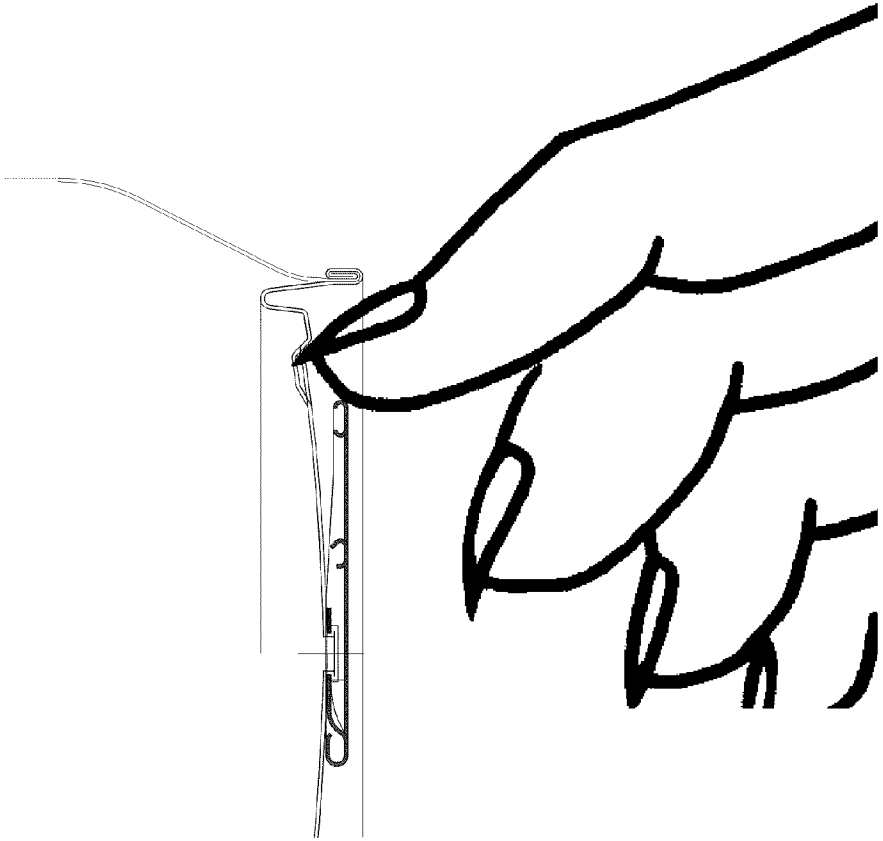
Figure 10:
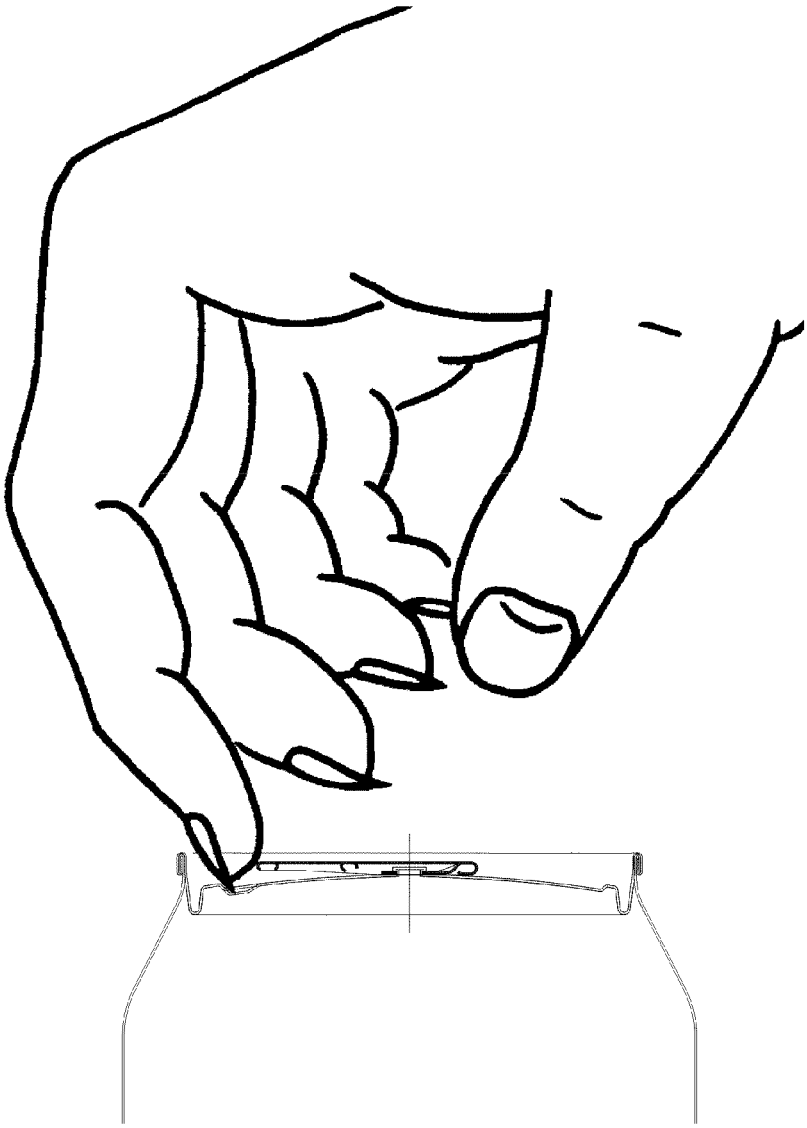
Figure 11:
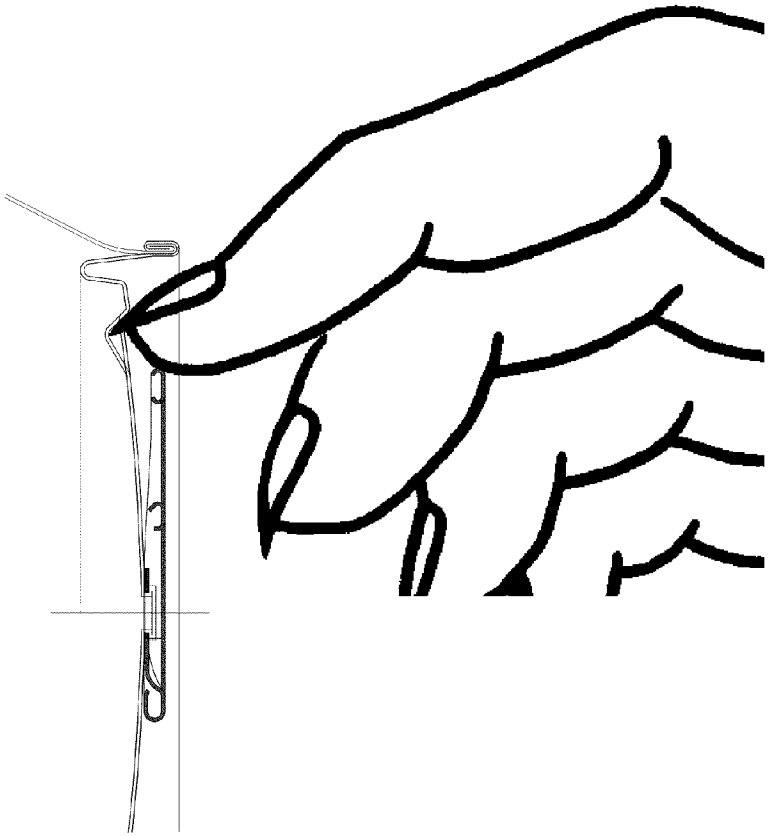
FIGS. 11 through 15 show that a small increase in the depth of the well, according to the present invention, underneath the lifter end of the pull tab can make life a bit easier and could make it easier to open the can.
Figure 12:
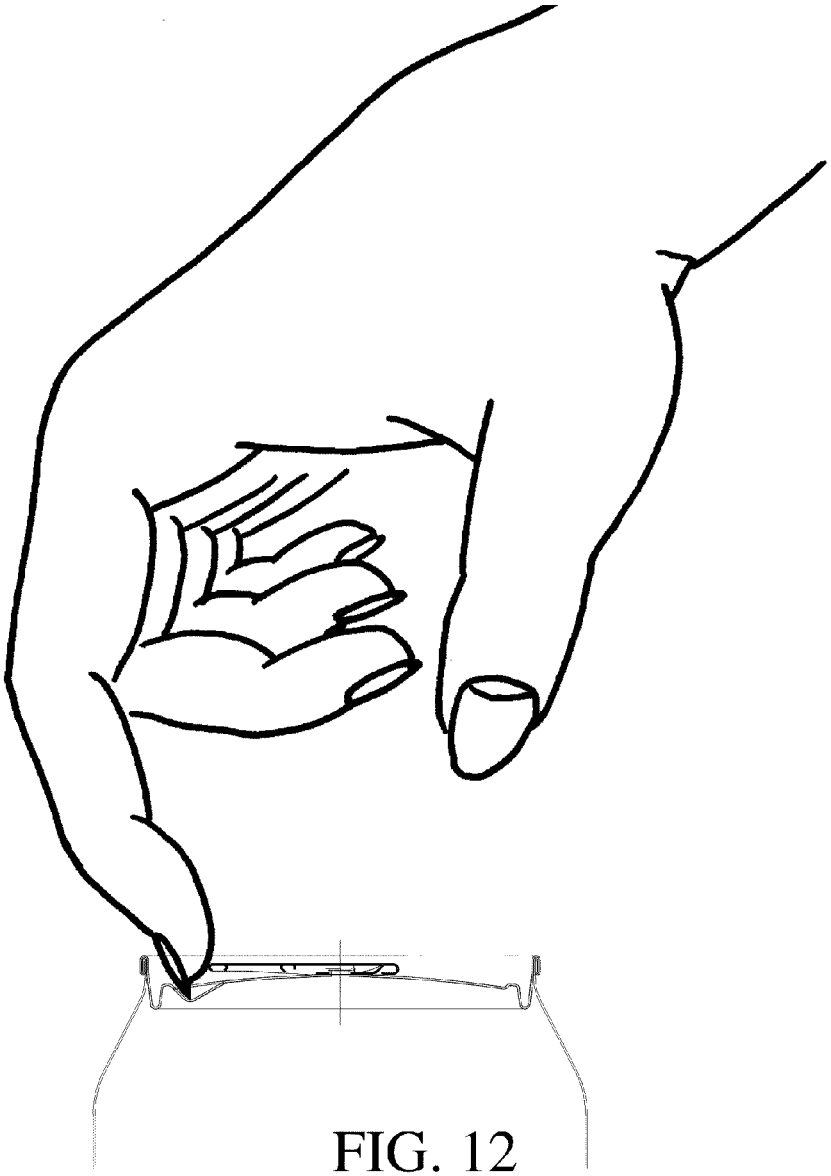
Figure 13:
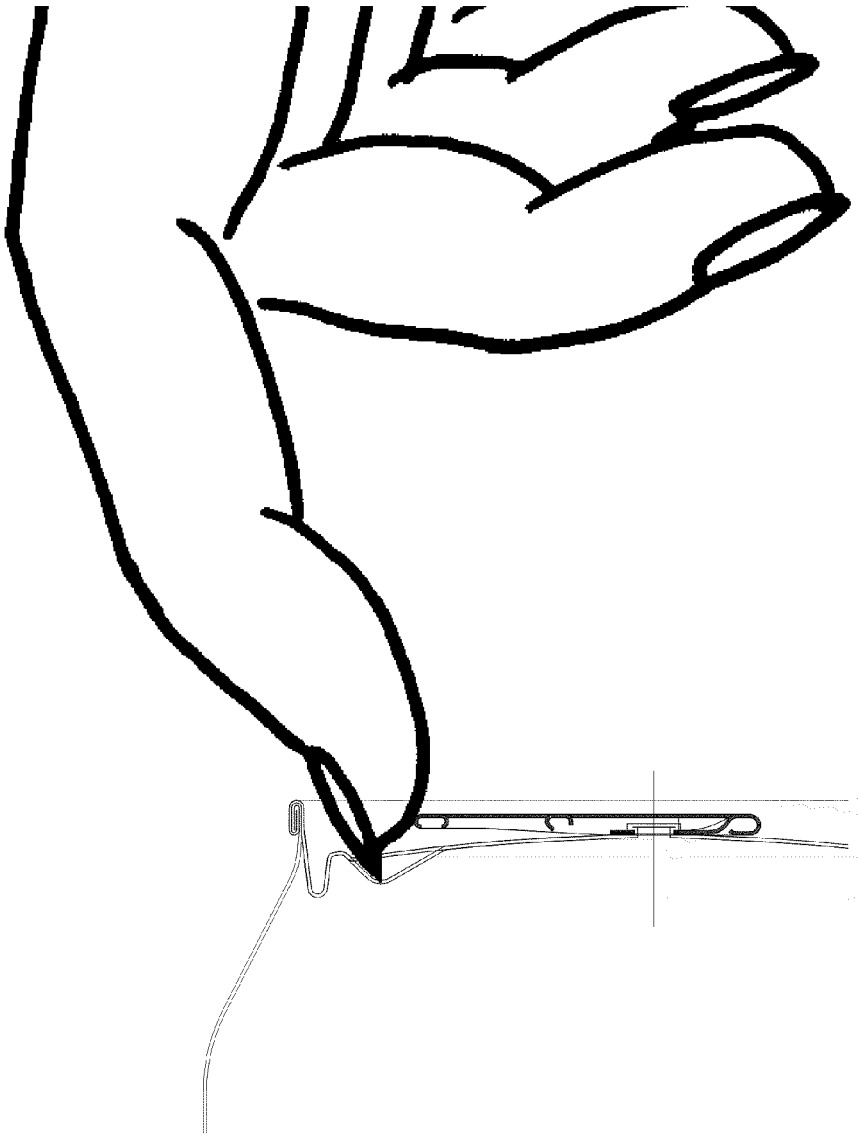
Figure 14:
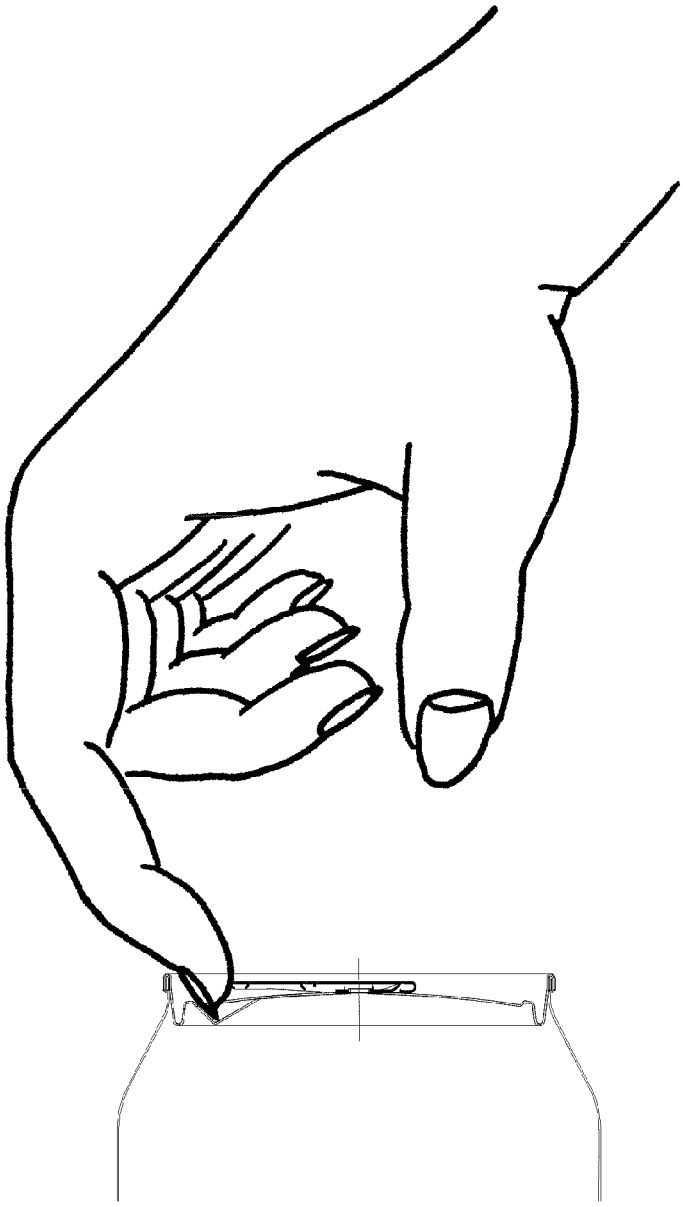
Figure 15:
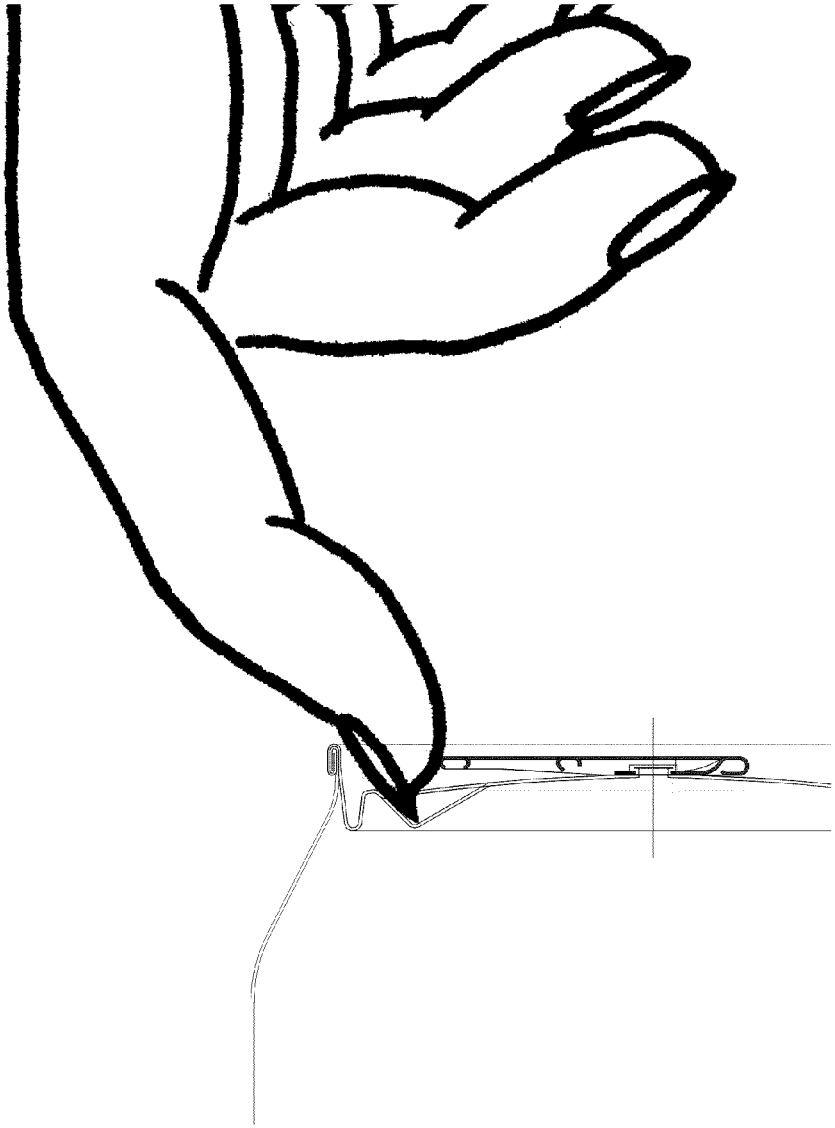
Figure 16:
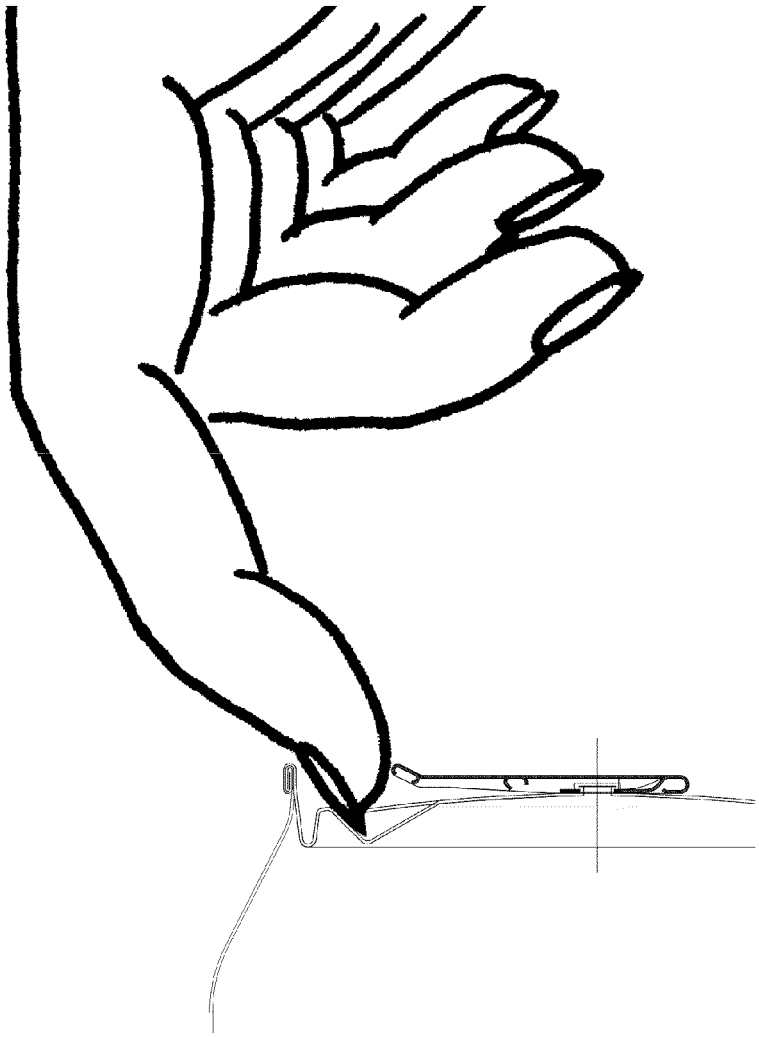
FIGS. 16 through 21 show additional improvements according to the present invention. Bending the lifting tip of the pull tab upwards can make a big difference. Combining this bend with increasing the depth of the well underneath this lifting tip can improve the situation even more so.
Figure 17:
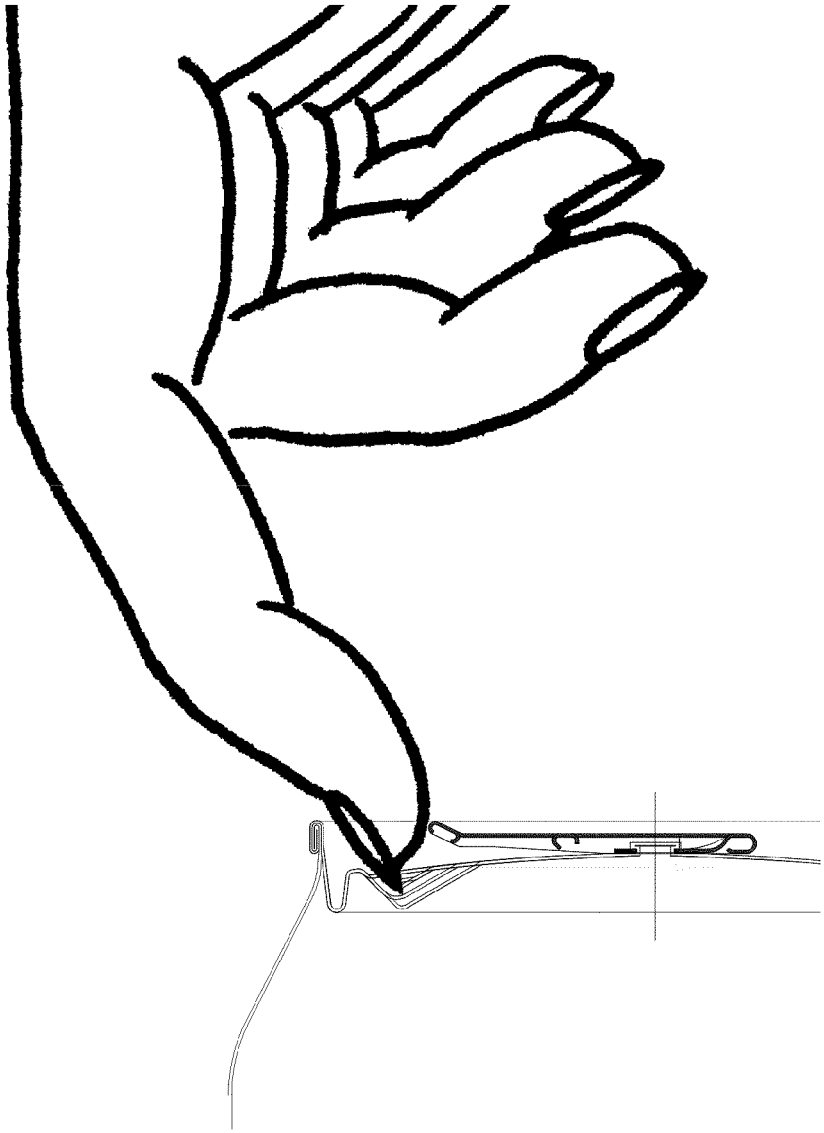
Figure 18:
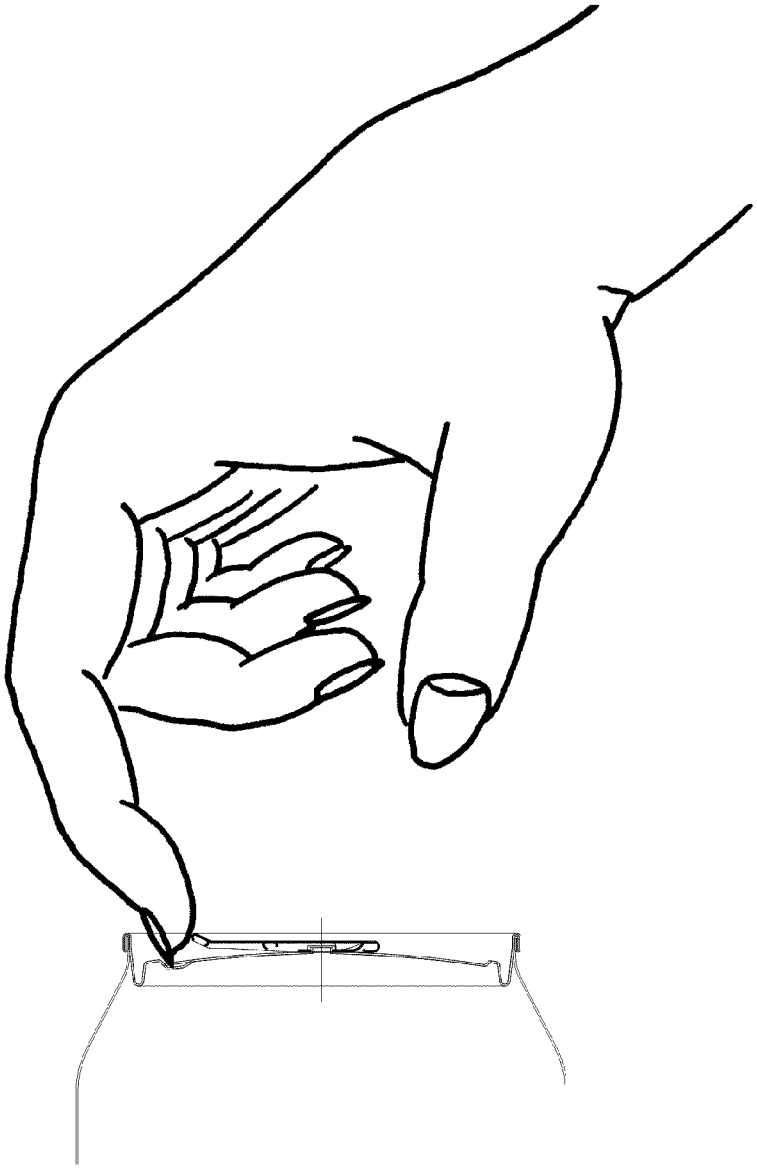
Figure 19:
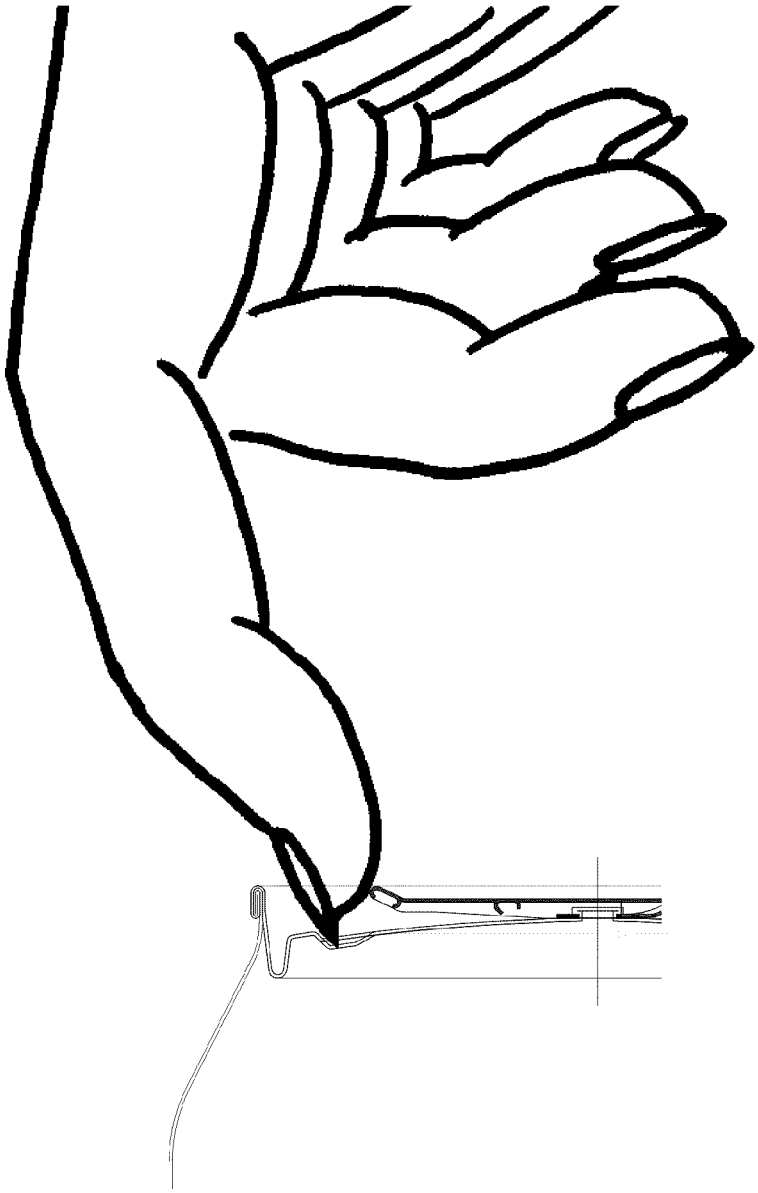
Figure 20:
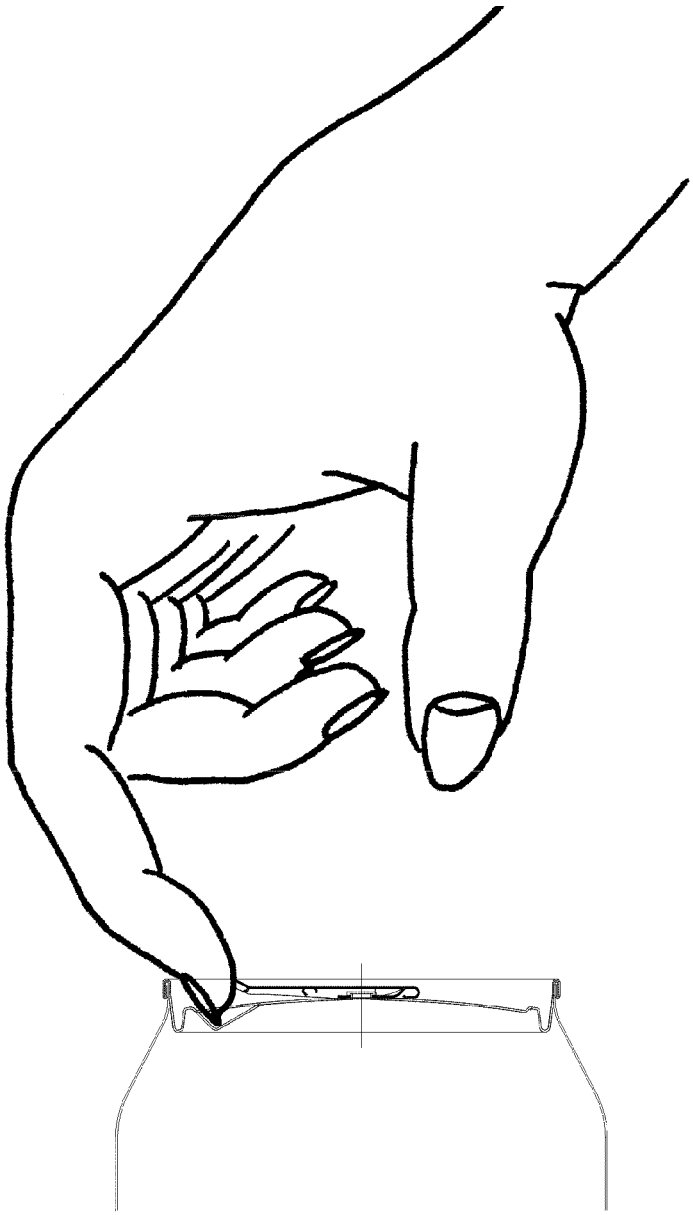
Figure 21:
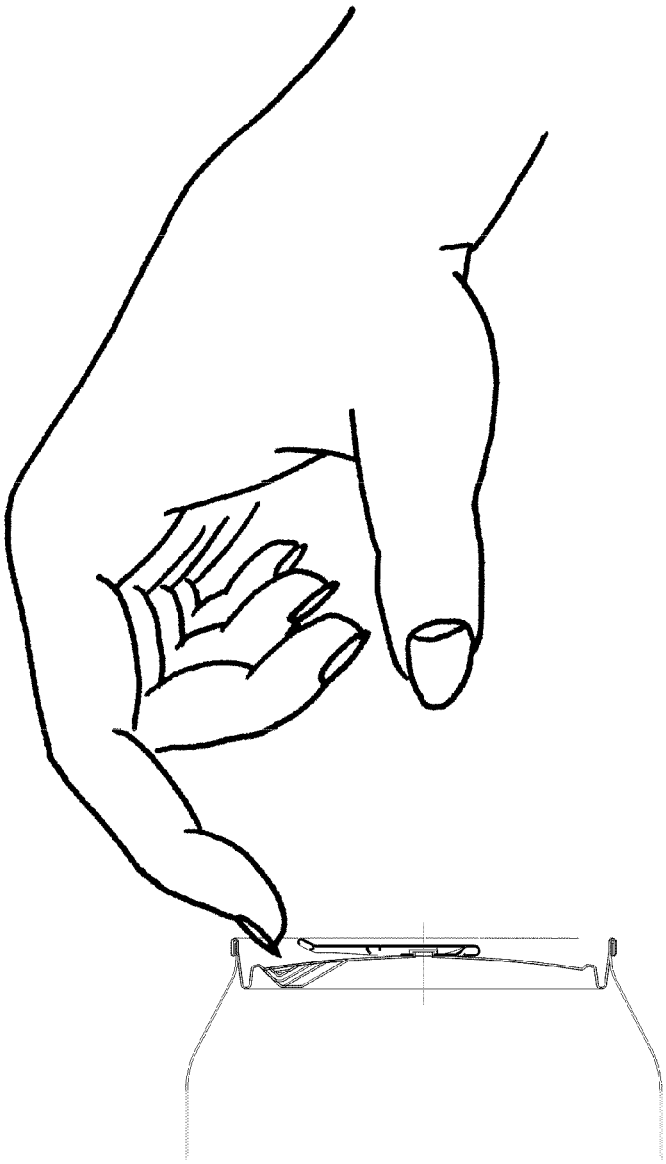
Figure 22:
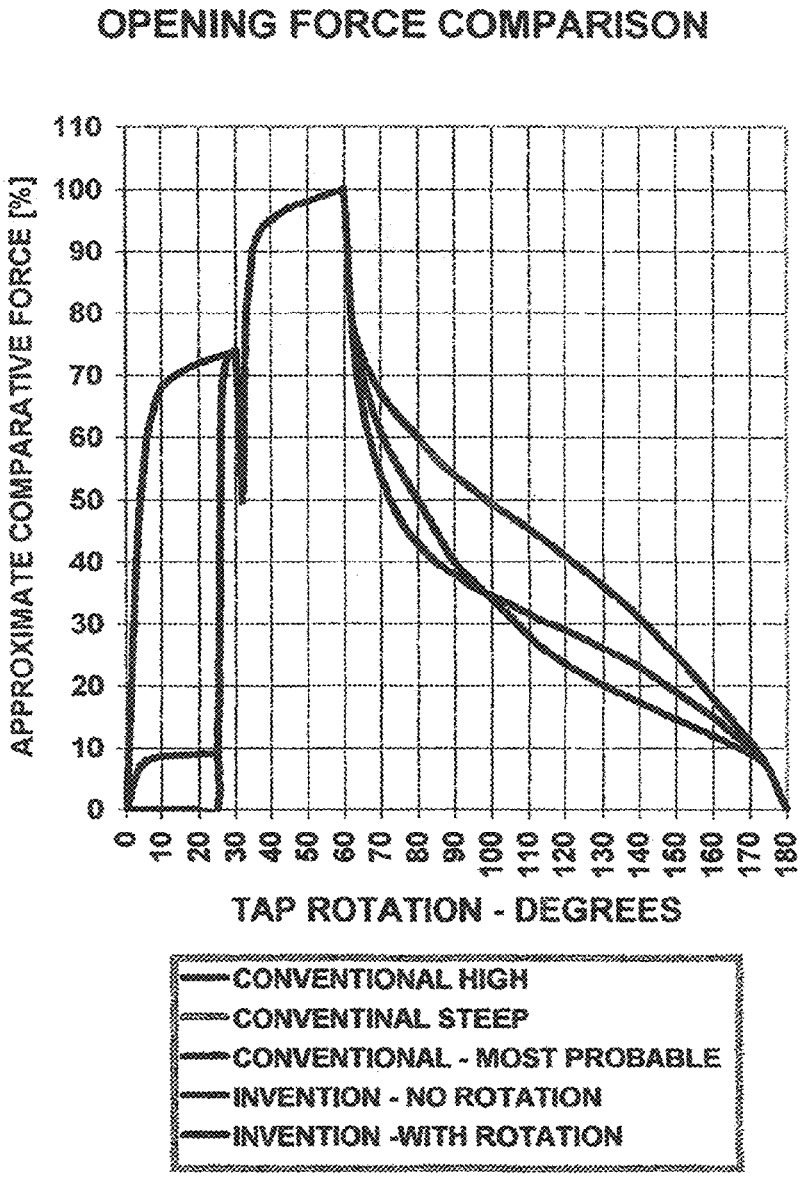
FIG. 22 shows the magnitude of the force that needs to be exerted at the lifter end of the pull tab in order to open the can. The horizontal axis shows the "rotation" or "lifting" angle of the pull tab with respect to the surface of the lid, while the vertical axis shows the typical force required at the lifter end of the pull tab, to bring the pull tab to the respective position/angle shown. The figure shows two superimposed sets of curves, one curve for the "conventional/prior art" conditions and the second for the "improved" conditions as per present invention. Both curves are identical except for the portion starting at zero degree and ending around 25 degrees, in this illustration. The force curve for the conventional pull tab starts at zero degree and rises immediately and very sharply/steeply right at the beginning of the lifting motion. As illustrated in the figure, the force reaches a high level, maybe over 70% of the max force, until the seal is popped; and then the force gets even higher yet until the seal is cracked. After that point, the force becomes relatively smaller since it will just have to bend the seal, which force is smaller that the ones previously described. The second curve, the one for the improved conditions, looks almost identical to the first one, except for one important portion of the curve. It is the portion of the curve between zero degrees and about the same point of 25 degrees. It is the lower curve in the figure. The magnitude of the improved condition force is shown by the lower curve and it could be around 10% or less of the maximum force needed in the whole process of opening the can. This is a result of the proposed designs of the embodiments of the present invention. This is quite an improvement.

Curve 5 in FIG. 22 (Graph 1) shows the effect of rotating the tab to elevate it before trying to lift it. The force-deflection curve would become "A TO C5 TO C TO D ETC.". Hence, the work represented by Area 2 would be eliminated as well, besides the Area 1.

I claim:

1. A combination of a container lid and a pull tab opener, a) said container lid applied to a container body, said container lid comprising b) a panel having a generally flat horizontal surface, and a scored area in said panel for defining a push-in seal, which is frangibly secured to said panel for enabling said push-in seal to be at least partially severed from said panel and c) said pull tab opener, comprising d) a rigid non-articulated elongated tab body, having a tab longitudinal axis and a tab transverse axis, said pull tab opener comprising e) a nose portion, ending with a nose end and a nose tip, at one end of said tab body, along said tab longitudinal axis, f) a lifter portion, ending with a lifter end and a lifter tip, at the opposite end of said tab body, along same said tab longitudinal axis, and g) a controlled flex donut plate, being disposed between said nose portion and said lifter portion, proximate the intersection of said tab longitudinal and transverse axes, h) two rigid side rails, connecting said nose portion and said lifter portion to each other and to said donut plate and running at a certain distance and a certain angle to said longitudinal axis of the pull tab opener, and i) a cross-bridge, connecting said two side rails together, running transverse to the tab longitudinal axis, at a certain distance from said donut plate, and j) said combination also comprising a rivet for pivotally securing said pull tab opener to said panel, said rivet being disposed at the intersection of said tab longitudinal and transverse axes, said rivet attaching said donut plate to said panel, and having a rivet axis, being generally vertical, perpendicular to the generally flat horizontal surface of said panel, allowing said pull tab opener to rotate in a horizontal clockwise or counter-clockwise direction, when the pull tab opener and container lid are viewed from a top down direction, k) said donut plate also being flexible enough to allow said tab body to have a vertical seesaw rotation or movement, i.e. to seesaw and to rotate in a vertical clockwise or counter-clockwise direction, about the tab transverse axis, when viewed from a cross-sectional side view direction, if and when a force is applied to any part of the tab body, e.g. a downward force on the nose portion or an upward force on the lifter portion, wherein an upward movement of said lifter portion creates a downward movement of said nose portion, l) said donut plate being flexible enough, presenting only a small amount of donut flexing resistance against the vertical seesaw rotation of the pull tab opener, m) said container lid also having an imaginary rivet-seal axis passing through and from said rivet to the general center of said push-in seal area, and said nose end being disposed proximate said push-in seal and said lifter end being disposed remote therefrom, and wherein n) the pull tab opener and container lid are shaped such that when the tab longitudinal axis is aligned with the rivet-seal axis, then the nose end will be overlying a portion of the push-in seal, but with a certain predetermined nose initial vertical clearance angle between the bottom surface of the nose end and top surface of the push-in seal, requiring that the tab body be rotated through a certain vertical angle, say by raising the lifter end of the pull tab opener a certain distance or angle, before the nose end touches the push-in seal, and wherein o) the process sequence of opening the container lid and breaking open said push-in seal comprises at least three distinguishably individual and separate incremental process steps, which occur consecutively or sequentially, wherein p) the first incremental process step or movement is to ensure that the nose end is overlying the push-in seal, by checking the initial position of the pull tab opener, and if the nose end is not overlying the push-in seal, then to horizontally rotate the pull tab opener about the rivet vertical axis, until the tab longitudinal axis is generally aligned, or in line, with the rivet-seal axis, which would bring the nose end to be generally overlying the push-in seal, while during this first movement, only a small amount of horizontal force will be required to rotate the pull tab opener horizontally against any friction at the rivet against the donut plate, q) o) the second incremental process step or movement comprises the step of vertically rotating and pivoting or seesaw-ing the pull tab opener, so as to close the nose initial vertical clearance angle, r) by moving the nose portion of the pull tab opener downwards towards the push-in seal, traversing said nose initial vertical clearance angle, until the bottom surface of the nose portion reaches and touches the top surface of the underlying push-in seal, but just before engaging the push-in seal, while during this vertical rotation step, s) a second incremental force, a vertical force in this case, is required to be applied or exerted on the pull tab opener, the magnitude of said second incremental force being equal to the force required to overcome only the donut flexing resistance, i.e. the resistance of the donut plate against being bent; and t) the subsequent third incremental process step comprises the step of urging the nose portion of the pull tab opener to break open the push-in seal, during which third step u) a third incremental force, being also a vertical force in this case, like the second force, is required to be applied or exerted, in addition to the second vertical incremental force, the magnitude of said third vertical incremental force being equal to the force required to break open the push-in seal, v) wherein said third incremental force is considerably larger than said first or second incremental forces;

w) in other words, x) said nose initial vertical clearance between the nose end and the push-in seal creates and introduces a delay in the onset of the larger third incremental force which is required to break open the push-in seal, thus making it easy to go through both the first and second incremental process steps, by applying only the smaller first and second incremental forces to the pull tab opener, before encountering the need to apply the larger third incremental force which is required to break open the push-in seal, and wherein y) the container lid has a cam feature with at least one cam ramp with a ramp surface, said cam surface being filleted and having smooth transitions, and wherein z) the pull tab opener has a cam follower feature, proximate said lifter end, and riding on the ramp surface of said cam feature, and wherein aa) by rotating said pull tab opener, horizontally, about the vertical rivet axis, a camming action takes place, wherein ab) the cam follower rides on the cam ramp, so that at the end of the camming action, the nose end of the pull tab opener would be overlying the push-in seal, and the lifter end of the pull tab opener would be raised to a level wherein the lifter tip gets raised to a higher level over the surface of the lid, higher than its level at the beginning of the camming action, thus creating a larger space between the lifter tip and the lid panel, thus in turn allowing the user to more easily place his/her finger tip under the lifter tip, in the effort to ultimately more easily open and crack the push-in seal, and wherein ac) while during all this camming action, the camming action does not totally eliminate all the nose initial vertical clearance angle, so that the nose end still remains above a certain minimum clearance elevation away and above the push-in seal, in other words, even at the end of the camming action, neither the nose end nor the nose tip will engage the push-in seal, so that the neither the nose end nor the nose tip will apply any force on the push-in seal, which makes it that the horizontal rotation of the pull tab opener and the camming action take place without the need of any force related to breaking or to opening the push-in seal.

2. A combination of a container lid and a pull tab opener, as in claim 1, wherein the combination also comprises at least one stop feature, to limit the horizontal rotation of the pull tab opener from exceeding the desired amount of rotation, so that at the end of the tab rotation the nose end of the pull tab opener would be located generally above and overlying the push-in seal, in a position wherein if the lifter portion or the lifter end is pulled higher than where it is at the end of the rotation and the camming action, then the nose end would get lowered down further and would touch the push-in seal, and upon further pushing the nose end down, e.g. by further lifting the lifter end of the pull tab opener, then the nose end would engage the push-in seal and upon further pushing the nose end down, e.g. by further pulling the lifter end higher yet, then the nose end and nose tip would break and open the push-in seal.

3. A combination of a container lid and a pull tab opener, as in claim 1, wherein At the beginning of the camming action, tab's longitudinal axis starts being generally in line with the rivet-seal axis, and the horizontal rotation of the pull tab opener and the camming action happen over a relatively narrow angle, i.e. short rotation, short angular motion of the pull tab opener, so that by the end of said angular rotation and of the camming action, the nose end is still in a position overlying the push-in seal, so that any subsequent lowering of the nose end, e.g. by raising of the lifter end would lower the nose end onto the push-in seal and would still break the push-in seal and accomplish all the normally expected functions of the pull tab opener.

4. A combination of a container lid and a pull tab opener, as in claim 1, wherein At the beginning of the camming action, the tab longitudinal axis is at a certain angle with respect to the rivet-seal axis, and wherein the camming rotation is such that it ends when the tab longitudinal axis is generally in line with the rivet-seal axis, and so that the nose end is positioned overlying said push-in seal, but still not touching nor breaking the push-in seal.

5. A combination of a container lid and a pull tab opener, as in claim 1, wherein said combination comprises two frangible push-in seals, instead of just one, and wherein each one of said two push-in seals is disposed on each side of an imaginary central axis of said lid panel, and wherein said combination also comprises two cams, each cam having its own cam ramp, and each one of said two cams being disposed on each side of said lid panel imaginary central axis, and wherein at the beginning of the camming action, the pull tab opener is disposed with the tab longitudinal axis generally in line with said lid panel imaginary central axis, and wherein the camming action requires a relatively large or wide angular motion of the pull tab opener, and wherein the nose is proximate and generally central between said two push-in seals and wherein the lifter and the tab cam follower are proximate to and generally central between said two cams, and wherein at the end of the camming action, by rotating the tab body horizontally, either clockwise or counter-clockwise, the lifter end will rise, thus lowering the nose end and bringing the nose tip in proximity to and overlying one of said two push-in seals, while still not touching the push-in seals.

6. A combination of a container lid and a pull tab opener, as in claim 5, wherein a trough is provided, along a certain arc of the perimeter of the lid panel, in the area underlying the path of the tab lifter end and lifter tip, during its rotation path, throughout the whole range of rotation of the pull tab opener.

7. A combination of a container lid and a pull tab opener, as in claim 1, wherein the cam feature is shaped as a recess below the lid panel surface, being disposed generally in line with the rivet-seal axis, but on the remote side of the push-in seal with respect to the rivet, and the cam feature has at least one ramp, the cam ramp starting proximate the rivet-seal axis, at a level below the lid panel surface and ramping up to the level of the lid panel surface, going either clockwise or counter-clockwise, along a generally curvilinear path around the rivet vertical axis, and wherein the tab longitudinal axis initial position is such that the tab longitudinal axis is initially centrally disposed generally in line with the rivet-seal axis, and the tab cam follower is disposed adjacent to the tab lifter end, e.g. at the cross-bridge of the pull tab opener, and wherein the camming action occurs, by rotating the pull tab opener horizontally in the appropriate direction, about the rivet vertical axis, so that the cam follower will travel along the cam ramp and will raise the lifter end of the pull tab opener and wherein said pull tab opener rotation, during the complete camming action, is generally a small angle, so that the nose end will overlay the push-in seal during said camming action.

8. A combination of a container lid and a pull tab opener, as in claim 7, wherein the cam feature has two such ramps, one going clockwise and the second going counter clockwise, with respect to the rivet vertical axis, wherein the camming action occurs, by rotating the pull tab opener horizontally in either a clockwise direction or in a counter clockwise direction, about the rivet vertical axis, to still achieve the same result, i.e.

so that the cam follower will travel along the cam ramp and will raise the lifter end of the pull tab opener and wherein said pull tab opener rotation, during the complete camming action, is generally a small angle, so that the nose end will overlay the push-in seal during said camming action.

9. A combination of a container lid and a pull tab opener, as in claim 1, wherein the cam feature is shaped as a protrusion above the lid panel surface, and the cam feature has one ramp, shaped along a generally curvilinear path, around the rivet vertical axis, said ramp starting at the level of the lid panel surface and ramping upwards until a summit point, and wherein said summit point is disposed generally in line with the rivet-seal axis, but on the remote side of the push-in seal with respect to the rivet, and wherein the pull tab opener has a cam follower, disposed proximate the cross bridge, and wherein the camming action occurs, by rotating the pull tab opener horizontally in the appropriate direction, about the rivet vertical axis, so that the cam follower will travel along the cam ramp and will raise the lifter end of the pull tab opener and when the cam follower of the pull tab opener reaches the summit point of the cam ramp, the lifter end of the pull tab opener would be raised to a higher level above the lid panel, higher than its height at the beginning of the camming action, and at which time, the pull tab opener longitudinal axis would be generally in line with the rivet-seal axis, and the nose end of the pull tab opener will be disposed generally above the push-in seal.

10. A combination of a container lid and a pull tab opener, as in claim 1, wherein the cam feature is shaped as a protrusion above the lid panel surface, and the cam feature has one ramp, shaped along a generally curvilinear path, around the rivet vertical axis, said ramp starting at the level of the lid panel surface and ramping upwards until a summit point, and wherein said summit point is disposed generally offset to one side of the rivet-seal axis, but on the remote side of the push-in seal with respect to the rivet, and wherein the pull tab opener utilizes one of the side rails as the cam follower, and wherein the camming action occurs, by rotating the pull tab opener horizontally in the appropriate direction, about the rivet vertical axis, so that the cam follower will travel along the cam ramp and will raise the lifter end of the pull tab opener and when the cam follower of the pull tab opener reaches the summit point of the cam ramp, the lifter end of the pull tab opener would be raised to a higher level above the lid panel, higher than its height at the beginning of the camming action, and at which time, the pull tab opener longitudinal axis would be generally in line with the rivet-seal axis, and the nose end of the pull tab opener will be disposed generally above the push-in seal.

11. A combination of a container lid and a pull tab opener, as in claim 1, wherein the cam feature is shaped as protrusions above the lid panel surface, and the cam feature has two ramps, each one of said two ramps is disposed generally to one side of the rivet-seal axis, at an appropriate distance from said axis, in order to properly cooperate with its respective cam follower, each ramp shaped along a generally curvilinear path, around the rivet vertical axis, said ramp starting at the level of the lid panel surface and ramping upwards until a summit point, and wherein said summit point is disposed generally offset to one side of the rivet-seal axis, but on the remote side of the push-in seal with respect to the rivet, and wherein the pull tab opener utilizes both of the side rails as the cam followers, and wherein the camming action occurs, by rotating the pull tab opener horizontally in the appropriate direction, about the rivet vertical axis, so that the cam followers will travel along the cam ramps and will raise the lifter end of the pull tab opener and when the cam followers of the pull tab opener reach the summit point of the cam ramps, the lifter end of the pull tab opener would be raised to a higher level above the lid panel, higher than its height at the beginning of the camming action, and at which time, the pull tab opener longitudinal axis would be generally in line with the rivet-seal axis, and the nose end of the pull tab opener will be disposed generally above the push-in seal.

12. A combination of a container lid and a pull tab opener, as in claim 11, wherein the cam ramps are shaped such that the top surface of the ramps ridge, which will be in contact with the bottom surface of the side rails, which are acting as the cam followers, is inclined at a certain inclined angle with respect to the generally flat horizontal surface of the lid panel, said inclined angle varying along the length of the ramp, wherein at the lower end of the ramp, the inclined angle is practically zero, i.e. horizontal or parallel to the lid panel, and as the ramp gets higher, the inclined angle gets steeper, and by the time the ramp is at the summit point, the inclined angle gets to its maximum inclination, wherein the inclination of the ramp surface with respect to the generally flat horizontal surface of the lid panel, will generally match the inclination of the bottom surface of the side rails, i.e. the cam followers, said inclination angle varying during the camming process, so as to provide a wider contact surface area between the cam ramp and the cam followers, in other words, in a cross-sectional side view through the lid and the cam, the top surface of the cam will look almost trapezoidal, so that this top surface would match the surface of the pull tab at any particular "mating" position during the camming process.

13. A combination of a container lid and a pull tab opener, as in claim 1, wherein the pull tab opener has at least one raised edge above the level of the general top surface of the pull tab opener, to facilitate in the rotating of the pull tab opener.

14. A combination of a container lid and a pull tab opener, as in claim 1, wherein the pull tab opener has at least one raised flange, along the side of at least one of the side rails of the pull tab opener, to facilitate in the rotating of the pull tab opener.

15. A combination of a container lid and a pull tab opener, as in claim 1, wherein the pull tab opener nose portion is bent upwards, to enhance the nose initial vertical clearance angle.

16. A combination of a container lid and a pull tab opener, as in claim 1, wherein the pull tab opener lifter portion, or at least the lifter end, is bent upwards, to enhance the finger space between the pull tab opener and the lid panel.

* * * * *